US009572410B2

(12) United States Patent
Fiedler

(10) Patent No.: US 9,572,410 B2
(45) Date of Patent: Feb. 21, 2017

(54) MECHANICAL CLOSURE HAVING A LOCKING DEVICE

(75) Inventor: Joachim Fiedler, Hannover (DE)

(73) Assignee: Fidlock GmbH, Hannover (DE)

( * ) Notice: Subject to any disclaimer, the term of this patent is extended or adjusted under 35 U.S.C. 154(b) by 1008 days.

(21) Appl. No.: 13/390,759

(22) PCT Filed: Aug. 23, 2010

(86) PCT No.: PCT/EP2010/062262

§ 371 (c)(1),
(2), (4) Date: Jun. 20, 2012

(87) PCT Pub. No.: WO2011/023661

PCT Pub. Date: Mar. 3, 2011

(65) Prior Publication Data

US 2012/0248793 A1 Oct. 4, 2012

(30) Foreign Application Priority Data

Aug. 24, 2009 (DE) ..... 10 2009 038 370
Jan. 29, 2010 (DE) ..... 10 2010 006 798
Jul. 13, 2010 (DE) ..... 20 2010 010 300 U

(51) Int. Cl.
*E05C 19/16* (2006.01)
*A45C 13/10* (2006.01)
(Continued)

(52) U.S. Cl.
CPC ..... *A45C 13/1069* (2013.01); *A44B 11/258* (2013.01); *A44B 11/2592* (2013.01);
(Continued)

(58) Field of Classification Search
CPC ..... A45C 13/1069; A45C 13/1084; A45C 13/1092; A45C 13/123; A45C 13/126; E05B 13/103; E05B 13/105;E05B 37/16; E05B 47/0038; E05B 47/004; E05B 65/52; E05B 37/12; A44B 1/34; A44B 1/38; A44B 11/258; A44B 11/2584; A44B 11/263; A44B 17/0023; A44B 17/0041; A44B 11/2592; A44D 2203/00; Y10T 24/32; Y10T 292/096; Y10T 292/0969; Y10T 70/7486; Y10T 70/7407
(Continued)

(56) References Cited

U.S. PATENT DOCUMENTS 4,575,908 A 3/1986 Gloomis et al.
4,793,032 A * 12/1988 Crowle ..... A44B 11/266 24/607
(Continued)

FOREIGN PATENT DOCUMENTS

DE WO 2008006355 A2 * 1/2008 ..... A44B 11/2511
WO 2008006357 A2 1/2008
(Continued)

*Primary Examiner* — Kristina Fulton
*Assistant Examiner* — Christine M Mills
(74) *Attorney, Agent, or Firm* — The Webb Law Firm

(57) ABSTRACT

The invention relates to a lock device, having a first connecting module and a second connecting module. The first connecting module can here be arranged in a closing direction on the second connecting module and is mechanically catch-lockingly engaged in a closing position with the second connecting module, and the first connecting module can be detached from the second connecting module by a movement of the first connecting module or of a part of the first connecting module in an opening direction, which differs from the closing direction. Here, a locking device (7; 9, 9*a-f*) is provided to prevent a movement of the first connecting module (1) or of the part (1*a*) of the first connecting module (1) in the opening direction (Y), when the first connecting module (1) and the second connecting module (2) are positioned in the closing position, wherein
(Continued)

the locking device (7, 9, 9*a-f;* 100, 101, 102; 206, 207) can be unlocked to move the first connecting module (1) or the part (1*a*) of the first connecting module (1) in the opening direction (Y).

18 Claims, 63 Drawing Sheets

(51) Int. Cl.

| | |
|---|---|
| ***A44B 11/25*** | (2006.01) |
| ***A45C 13/12*** | (2006.01) |
| ***E05B 13/10*** | (2006.01) |
| ***E05B 37/12*** | (2006.01) |
| ***E05B 37/16*** | (2006.01) |
| ***E05B 47/00*** | (2006.01) |
| ***E05B 65/52*** | (2006.01) |

(52) U.S. Cl.
CPC ..... *A45C 13/1084* (2013.01); *A45C 13/123* (2013.01); *A45C 13/126* (2013.01); *E05B 13/103* (2013.01); *E05B 37/12* (2013.01); *E05B 37/16* (2013.01); *E05B 47/004* (2013.01); *E05B 47/0038* (2013.01); *E05B 65/52* (2013.01); *A44D 2203/00* (2013.01); *Y10T 70/7407* (2015.04); *Y10T 70/7486* (2015.04); *Y10T 292/096* (2015.04); *Y10T 292/0969* (2015.04)

(58) Field of Classification Search
USPC ..... 24/303; 292/1, 251.5, DIG. 37
See application file for complete search history.

(56) References Cited

U.S. PATENT DOCUMENTS

| | | | | |
|---|---|---|---|---|
| 5,377,392 | A * | 1/1995 | Morita | 24/303 |
| 5,533,240 | A * | 7/1996 | Murai | 24/615 |
| 5,548,879 | A * | 8/1996 | Wu | A44B 11/263 24/616 |
| 6,694,578 | B1 | 2/2004 | Nicoll | |
| 7,207,091 | B2 * | 4/2007 | Dunaye | 24/303 |
| 2009/0031541 | A1 | 2/2009 | Pribonic | |
| 2010/0283269 | A1 | 11/2010 | Fiedler | |
| 2010/0308605 | A1 | 12/2010 | Fiedler | |
| 2011/0131770 | A1 | 6/2011 | Fiedler | |

FOREIGN PATENT DOCUMENTS

| | | | |
|---|---|---|---|
| WO | 2009010049 | A2 | 1/2009 |
| WO | 2009092368 | A2 | 7/2009 |

* cited by examiner

Fig.6b
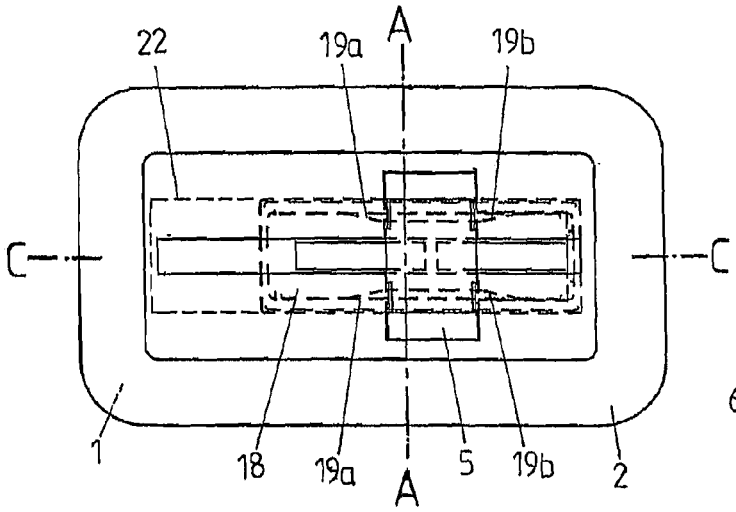
Fig.6d
(A-A)
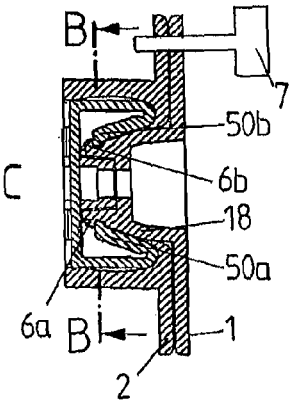
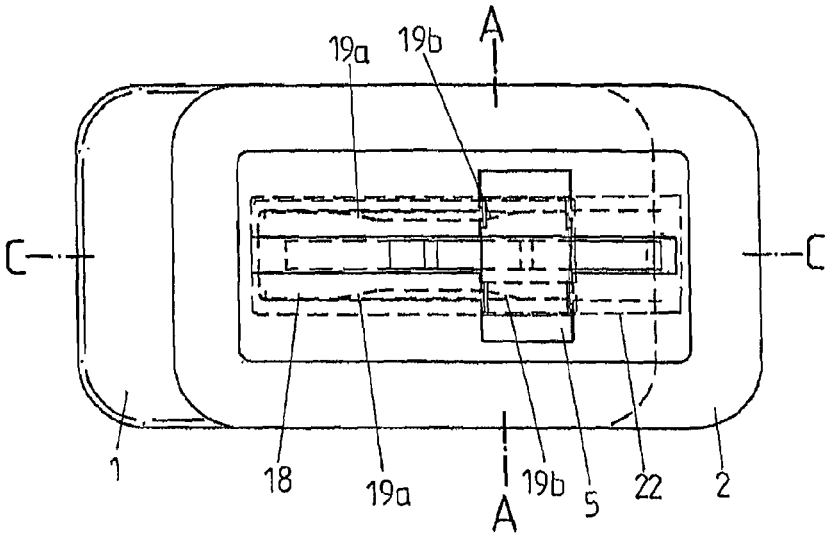
Fig. 6c
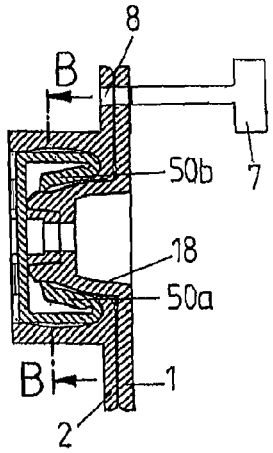
Fig.6e
(A-A)

(A-A)

(A-A)

(A-A)

(H-H)

(F-F)

(H-H)

(F-F)

(H-H)

(F-F)

MECHANICAL CLOSURE HAVING A LOCKING DEVICE

CROSS-REFERENCE TO A RELATED APPLICATION

This application is a National Phase Patent Application of International Patent Application Number PCT/EP2010/062262, filed Aug. 23, 2010, which claims priority of German Patent Application Number 10 2009 038 370.0, filed on Aug. 24, 2009, of German Patent Application Number 10 2010 006 798.8, filed on Jan. 29, 2010 and of German Utility Model Number 20 2010 010 300.5, filed on Jul. 13, 2010.

BACKGROUND OF THE INVENTION

Field of the Invention

The invention relates to a lock device.

Description of Related Art

Such a lock device has a first connecting module and a second connecting module, of which the first connecting module can be arranged in a closing direction on the second connecting module and is then mechanically catch-lockingly engaged in a closing position with the second connecting module.

The lock device can be opened in that the first connecting module can be detached from the second connecting module by terminating the catch locking engagement by a movement of the first connecting module, or of a part of the first connecting module serving as actuating element, in an opening direction, which differs from the closing direction.

In a lock device known from WO 2008/006357 A2 a first connecting module and a second connecting module each have for example one or multiple magnets which attractingly act between the first connecting module and the second connecting module in such a way that the first connecting module catch-lockingly engages with the second connecting module. Locking the lock takes place here in a closing direction which is directed essentially perpendicular to the planes of extension of the first connecting module and the second connecting module. As the first connecting module or an actuating element of the first connecting module is turned or shifted relative to the second connecting module, the catch locking elements of the first connecting module and of the second connecting module come out of engagement, wherein by the movement at the same time the magnetic attracting force between the first connecting module and the second connecting module—caused by a movement of the magnets relative to each other—is weakened, so that the first connecting module can be detached from the second connecting module. As, to support the closing movement, magnets are provided whose effect weakens upon opening, both the closing process and the opening process can take place in an easy and haptically pleasant manner.

In a lock device known from WO 2009/010049 A2, in which a first connecting module and a second connecting module can, magnetically supported, be catch-lockingly brought into engagement with each other, releasing the catch locking engagement takes place by a shifting or turning movement of the first connecting module, or of a part of the first connecting module, relative to the second connecting module, wherein by the shifting or turning movement a catch locking element of the one connecting module runs up onto a slope of the other connecting module and is thereby pushed out of engagement with an allocated catch locking element of the other connecting module, so that the catch locking engagement of the first connecting module and the second connecting module is terminated.

The lock devices of WO 2008/006 357 A2 and of WO 2009/01 00 49 A2 have in common that the catch-locking locking of the first connecting module with the second connecting module can be released in the closing position by a movement of the first connecting module, or of a part of the first connecting module (in the form of an actuating element), relative to the second connecting module in an opening direction, which differs from the closing direction to establish the locking. As a user in a suitable manner actuates the first connecting module, or an actuating element provided on said connecting module, by moving it in the opening direction, the first connecting module is detached from the second connecting module. Thereby, releasing the locking can take place essentially unobstructed and free by suitable actuation of the first connecting module or of the part of the first connecting module (in the form of an actuating element).

It is desirable that releasing the lock device can only take place when this is also intended. In particular, it can also be desirable, to make possible a release only under specific circumstances and by specific persons, for example to provide an anti-theft protection.

SUMMARY OF THE INVENTION

It is the object of the present invention to provide a lock device of the kind mentioned in the beginning, which in a simple and user-friendly manner is secured against an unintended release.

In a lock device of the kind mentioned in the beginning, a locking device is provided to prevent a movement of the first connecting module, or of the part of the first connecting module, in the opening direction when the first connecting module and the second connecting module are positioned in the closing position, wherein the locking device can be unlocked to move the first connecting module or the part of the first connecting module in the opening direction.

It is an idea of the present invention to provide a locking device, which prevents an unintended movement of the first connecting module, or of the part of the first connecting module, for releasing the lock device. The locking device in the closing position thereby retains the first connecting module, or the part of the first connecting module which is to be actuated to release the lock device, so that it cannot be moved in the opening direction and thereby the lock device also cannot be opened. The locking device is here designed in such a way that it can be unlocked, and when the locking device is unlocked a movement of the first connecting module or the part of the first connecting module in the opening direction is possible, so that the catch locking engagement of the first connecting module with the second connecting module can be terminated and the first connecting module can be detached from the second connecting module.

The locking device represents a safeguarding measure which prevents an unintended release of the lock device. In this manner, the lock device securely holds together the first connecting module and the second connecting module and guarantees a secure connection also during operation and under strain.

The phrase, the opening direction differs from the closing direction, shall presently be understood to mean that the opening direction points in another direction than the closing direction and is not directed parallel to it. In particular, the opening direction is thus not directed contrary to the closing direction.

The movement of the first connecting module, or of the part of the first connecting module which is to be actuated to open the lock device, can particularly be a shifting movement transverse to the closing direction, a rotation movement in a plane transverse to the closing direction or a pivoting movement on a rotation axis transverse to the closing direction. It is essential herein that the opening direction (which can also be a direction of rotation) differs from the closing direction, so that the connection of the first connecting module to the second connecting module to close the lock device takes place in the closing direction, the opening, however, is caused by a movement in an opening direction different from the closing direction, for example running transverse to the closing direction.

In the closing position the first connecting module and the second connecting module are mechanically catch-lockingly engaged with each other. For this purpose, at least one spring lock element, i.e. an elastically mounted locking element, is provided on the first connecting module or on the second connecting module, which engages with at least one blocking piece on the other connecting module to form a spring catch locking. The spring lock element can for example be an elastic catch locking element as a kind of clip. The blocking piece can for example be a locking catch, which the spring lock element positive-lockingly acts on.

Additionally, magnetic means can be provided, which, to support the transfer of the first connecting module into the closing position, cause a magnetic attracting force between the first connecting module and the second connecting module. By providing the magnetic means the lock device is lockable in an easy and haptically pleasant manner, in that the closing process upon attaching the first connecting module onto the second connecting module is magnetically supported and the mechanical catch locking engagement is established in an automatic manner.

The spring catch locking can be catch-lockingly engaged by arranging the first connecting module in the closing direction on the second connecting module, wherein herein the at least one spring lock element comes into positive-locking engagement with the at least one blocking piece. Upon establishing the closing position the first connecting module and the second connecting module are attracted by the magnetic means, so that the spring catch locking can advantageously engage largely automatically.

But the lock device can also act purely mechanically—and thus have no magnetic means—and be lockable by manually attaching the connecting modules onto each other and by applying a compressive force in the closing direction.

Releasing the lock device takes place in that the first connecting module, or the part of the first connecting module which is to be actuated, is moved relative to the second connecting module in such a way that the at least one spring lock element and the at least one blocking piece of the spring catch locking come out of engagement.

In a first exemplary embodiment the at least one spring lock element and the at least one blocking piece of the spring catch locking can for this purpose be shifted relative to each other in such a way that the at least one spring lock element along the opening direction gets out of range of the at least one blocking piece, so that the catch locking engagement is terminated. The idea herein is that the spring lock element is shifted as far in the opening direction relative to the blocking piece until it gets out of range of the blocking piece and is thereby no longer held positive-lockingly by the blocking piece. In this shifted position, the catch locking engagement is thereby terminated. Shifting the spring lock element relative to the blocking piece can take place by a tangential, linear movement or also by a turning movement of the first connecting module, or of the part of the first connecting module which is to be actuated, relative to the second connecting module.

In an alternative embodiment it can also be provided that the at least one spring lock element is shifted relative to the at least one blocking piece in such a way that the at least one spring lock element is pushed out of engagement with the at least one blocking piece by running up onto a run-up slope transverse to the opening direction. The idea is here, that upon moving the spring lock element in the opening direction the spring lock element runs up onto a slope, which acts upon the spring lock element in such a way that said spring lock element is pushed out of engagement with the at least one blocking piece transverse to the opening direction, so that the positive-locking engagement of the spring lock element with the blocking piece is terminated. This can, yet again, take place by a linear shifting movement or by a turning movement of the first connecting module, or of the part of the first connecting module which is to be actuated, relative to the second connecting module.

In a third exemplary embodiment the at least one spring lock element and the at least one blocking piece of the spring catch locking are designed as a kind of thread, so that by turning the first connecting module, or the part of the first connecting module which is to be actuated, relative to the second connecting module the at least one spring lock element and the at least one blocking piece can be screwed out of engagement. The spring lock element and the blocking piece each have for this purpose at least one thread groove, which in the closing direction can in a spring-elastic manner be catch-lockingly brought into engagement with each other. As the spring lock element and the blocking piece are then screwed apart, the spring lock element can be brought out of engagement with the blocking piece, so that the catch locking engagement is terminated and the first connecting module can be taken away from the second connecting module.

Advantageously the magnetic means, used where applicable, are designed in such a way that by the movement of the first lock part, or of the part of the first lock part which is to be actuated, in the opening direction at the same time also the magnetic means are moved relative to each other in such a way that the magnetic attracting force between the first connecting module and the second connecting module is weakened. For the realization of the magnetic means in this context at least one magnet each, or on the one hand at least one magnet and on the other hand at least one magnetic, for example ferromagnetic, anchor (e.g. in the form of a steel or iron sheet), can be arranged on the first connecting module and on the second connecting module respectively. By the movement of the first connecting module, or of the part of the first connecting module which is to be actuated, in the opening direction then also the at least one magnet or the magnetic anchor of the first connecting module and the at least one magnet or the magnetic anchor of the second connecting module are moved relative to each other in such a way that the magnetic attracting force weakens.

When for example a magnet each is provided on the first connecting module and on the second connecting module respectively, to close the lock device these lie frontally opposite to each other with different poles so that they attract each other and establish the catch locking engagement of the first connecting module with the second connecting module.

By moving the first connecting module, or the part of the first connecting module which is to be actuated, in the opening direction then for example the magnets can be moved tangentially relative to each other, so that they no longer lie frontally opposite to each other and the magnetic attracting force between them is weakened.

When on each connecting module two or more magnets are used, it is also conceivable that by the movement of the first connecting module, or of the part of the first connecting module which is to be actuated, like poles of the magnets are approximated to each other, so that the magnetic attracting force can, where applicable, even be reversed into a magnetic force of repulsion to thereby also magnetically support the opening of the lock device.

In an advantageous embodiment, furthermore, restoring means are provided to transfer the first connecting module, or the part of the first connecting module which is to be actuated, into a position in which the first connecting module can be catch-lockingly engaged with the second connecting module. The restoring means, for example formed by a mechanical spring, have the effect that upon attaching the first connecting module onto the second connecting module these are in due manner adjusted relative to each other in such a way that—with the support of the magnetic means—the catch locking engagement can be established. In other words, by the effect of the restoring means the first connecting module, or the part of the first connecting module which is to be actuated, is returned again from the position, into which it had been moved in the opening direction for opening, so that by attaching the first connecting module onto the second connecting module the lock device can readily be closed again.

In an advantageous embodiment these restoring means can also be realized by the magnetic means, so that additional means for example in the form of a mechanical spring are not required. The magnetic means, by the magnetic attracting force acting between their magnetic elements, herein have the effect that the first connecting module or its parts, which are provided for the catch locking engagement, automatically come into their position required for the catch locking engagement.

The locking device can for example have at least one locking element, movably arranged on the first connecting module or on a part of the first connecting module, to engage with a recess on the second connecting module or on a second part of the first connecting module in such a way that a movement of the first connecting module, or of the part of the first connecting module which is to be actuated, in the opening direction to detach the first connecting module from the second connecting module is prevented. The locking element can for example be designed as a locking bolt, which lockingly connects the first connecting module to the second connecting module, so that the first connecting module cannot be moved relative to the second connecting module and, thereby, opening the lock device is impossible.

It is also possible that the locking element lockingly connects a part of the first connecting module, which is to be actuated to open the lock device, to a fixed part of the first connecting module, so that the part which is to be actuated cannot be moved, for example cannot be turned or shifted, in the opening direction. It is essential herein that the locking element prevents a movement of the part of the first connecting module, which is to be actuated to open the lock device, so that opening the lock device is only possible when the locking element is unlocked, that is, no longer engages with the allocated recess.

For a secure locking, multiple locking elements can be provided which are to be actuated in an unlocking manner to open the lock device.

In an advantageous embodiment the locking device is designed for actuation by means of a key or a numerical code. Unlocking the locking device takes place then only by using a key or by entering a numerical code, so that the locking device at the same time also provides an anti-theft protection, in the scope of which unauthorized persons are unable to open the lock device.

It is furthermore possible and advantageous that the locking device is designed to automatically come into its locked position upon arranging the first connecting module on the second connecting module, so that in the closing position the first connecting module catch-lockingly engages with the second connecting module in an automatic manner and at the same time the lock device is locked in such a way that opening the lock device is only possible by unlocking the locking device. The locking elements of the locking device can for this purpose for example be preloaded by mechanical springs, so that upon establishing the closing state the locking elements automatically come into engagement with the allocated recesses in a locking manner.

Instead of forming the locking device by a separate locking element, movably arranged on the first connecting module, which has to be unlocked to unlock the lock device, in an alternative embodiment it can also be provided that the locking device can be unlocked by moving the first connecting module or a part of the first connecting module in an unlocking direction. The unlocking direction herein differs from the opening direction and is not directed parallel to it. For example, the unlocking direction can be directed transverse to the opening direction or, when the movement in the opening direction is configured as a linear movement, can be configured as a direction of rotation. It is also possible—but not imperative—that the unlocking direction differs both from the opening direction and from the closing direction and is not directed parallel to either of these.

Unlocking the lock device thereby takes place not by actuation of a separate locking elements, but by a movement of the first connecting module or of a part of the first connecting module, so that the locking device can be integrally formed with the first connecting module or a part of the first connecting module. The idea herein is to develop for the unlocking movement a further degree of freedom for the movability of the first connecting module or of a part of the first connecting module. In this way, the first connecting module can be attached onto the second connecting module in the closing direction, can be detached from the second connecting module by a movement in the opening direction, differing from the closing direction, for example directed transverse to the closing direction, but for this purpose has to be previously unlocked by a movement in the unlocking direction, differing at least from the opening direction.

In a concrete embodiment the locking device can be formed by a locking element, fixedly arranged on the first or the second connecting module, which in a locked, closed state of the lock device engages with a groove on the other of first and second connecting module. The opening direction can herein for example be directed transverse to the closing direction and the unlocking direction can be designed as a direction of rotation on the closing direction, wherein by turning the first connecting module or a part of the first connecting module in the unlocking direction the locking element can be brought out of engagement with the groove, to be able to move the first connecting module or the part of the first connecting module in the opening direction relative to the second connecting module and to thereby be able to open the lock device.

To ensure that upon closing the lock device and transferring the connecting modules into their closed, locked state the locking device securely locks, restoring means can be provided, which have the effect that the first connecting module or the part of the first connecting module, upon attachment onto the second connecting module, comes into a position in which it catch-lockingly engages with the second connecting module, and at the same time the locking device is locked. This return can, for example, be realized by additional spring means, pre-loading the first connecting module or the part of the first connecting module in a locked position, or by the magnetic means, which have the effect that the first connecting module or the part of the first connecting module, upon attachment onto the second connecting module, is for example turned in such a way that the locking device is automatically locked.

For example, the magnetic means can be formed by two magnets, identical in construction and not rotationally symmetric—for example rectangular—which stand opposite to each other with unlike poles and thereby attract each other and try to assume a position, in which both magnets stand congruently opposite to each other. When using rectangular magnets there are for example two positions, turned relative to each other by 180°, in which the magnets stand attracting congruently opposite to each other. These two positions then correspond to positions of the first (or the part of the first) connecting module and the second connecting module relative to each other, in which the first and the second connecting module can be locked with each other.

Alternatively, the magnetic means can also be polarized in such a way that magnets on the first connecting module and magnets on the second connecting module stand opposite to each other with multiple polarities and upon attaching the connecting modules onto each other automatically adjust into a preferential position, in which a locking can take place.

In another concrete embodiment the first connecting module or a part of the first connecting module can be pivotable on a rotation axis, directed transverse to the closing direction, in the opening direction to open the lock device relative to the second connecting module. In this case the locking device in the locked state prevents a pivoting movement of the first connecting module or of a part of the first connecting module, wherein the locking device is for example formed by a locking element, arranged on the one of first and second connecting module, and an engaging element, arranged on the other of first and second connecting module and in the locked state engaging with the locking element, and the locking device can be unlocked by a movement of the first connecting module or of a part of the first connecting module in an unlocking direction, differing from the opening direction.

In this case the first connecting module is in a closing direction attached onto the second connecting module and can be detached again from the second connecting module by moving at least a part of the first connecting module in a pivoting direction corresponding to the opening direction. The unlocking direction can in this case for example be directed transverse to or contrary to the closing direction and thereby differs from the opening direction.

In turn, restoring means can be realized by additional spring means or by the magnetic means provided anyway, which have the effect that the first connecting module or the part of the first connecting module upon closing the lock device automatically comes into a position in which it, upon attaching the connecting modules onto each other, comes into its locked state and can only be opened by a movement in the unlocking direction and a subsequent movement in the opening direction.

As the unlocking of the locking device takes place by a movement of the first connecting module or of a part of the first connecting module, the opening process divides into two movement components of the first connecting module or of a part of the first connecting module. First, to open the lock device, the first connecting module or a part of the first connecting module has to be moved by a predetermined distance in the unlocking direction to in this manner release the locking device. Afterwards, the first connecting module or the part of the first connecting module is then moved in the opening direction so that the mechanical catch locking engagement between the first connecting module and the second connecting module can be terminated and the connecting modules can thereby be separated from each other. The result is a haptically pleasant opening process, which at the same time guarantees a secure hold in the closed position of the lock device and, thereby, a secure connection of components which are to be connected.

In an exemplary embodiment the lock device is for example made of a first connecting module and a second connecting module, wherein

- in the first connecting module at least one magnet and in the second connecting module at least one anchor or a second magnet is arranged,
- in the first connecting module a spring lock element and in the second connecting module a blocking piece is arranged, which together form a spring catch locking, during the closing process between the first connecting module and the second connecting module the spring catch locking is closed by the attraction of magnet and anchor or second magnet,
- to open, magnet and anchor are shifted laterally or tangentially, wherein
  - additionally, spring lock element and blocking piece are moved against each other, so that the spring catch locking is laterally bypassed during the opening process without the spring lock element being pushed aside, or
  - the spring lock element is gradually pushed aside during a lateral shifting by means of a force-deflecting slope, or
  - spring lock element and blocking piece are designed thread-like, catch-lockingly engage upon closing and are opened upon opening by screwing,
- an unlockable locking device is provided, which prevents the lateral or tangential opening movement between spring lock element and blocking piece, but does not impede the engaging movement of the first connecting module and the second connecting module.

The advantage of this lock device is that opening cannot take place unintended, as two actuations are needed: Unlocking and lateral shifting or rotating to open. On the other hand, the lock device closes in a very pleasant manner, as the magnet closes the catch locking automatically. After the engagement the locking is then manually locked.

BRIEF DESCRIPTION OF THE DRAWINGS

The idea underlying the invention shall subsequently be further explained with the help of the exemplary embodiments illustrated in the figures. In the figures:

FIGS. 6*a*-6*i* show views of a sixth embodiment of a lock device;

DETAILED DESCRIPTION

FIGS. 1*a* to 1*e* show a first exemplary embodiment of a lock device having a first connecting module 1 and a second connecting module 2. The lock device can for example be used as a lock for a bag, a backpack, a suitcase or any other container or as a rope link or strap link or be employed everywhere, where two elements are to be connected to each other enduringly and detachable.

Figure 1A:
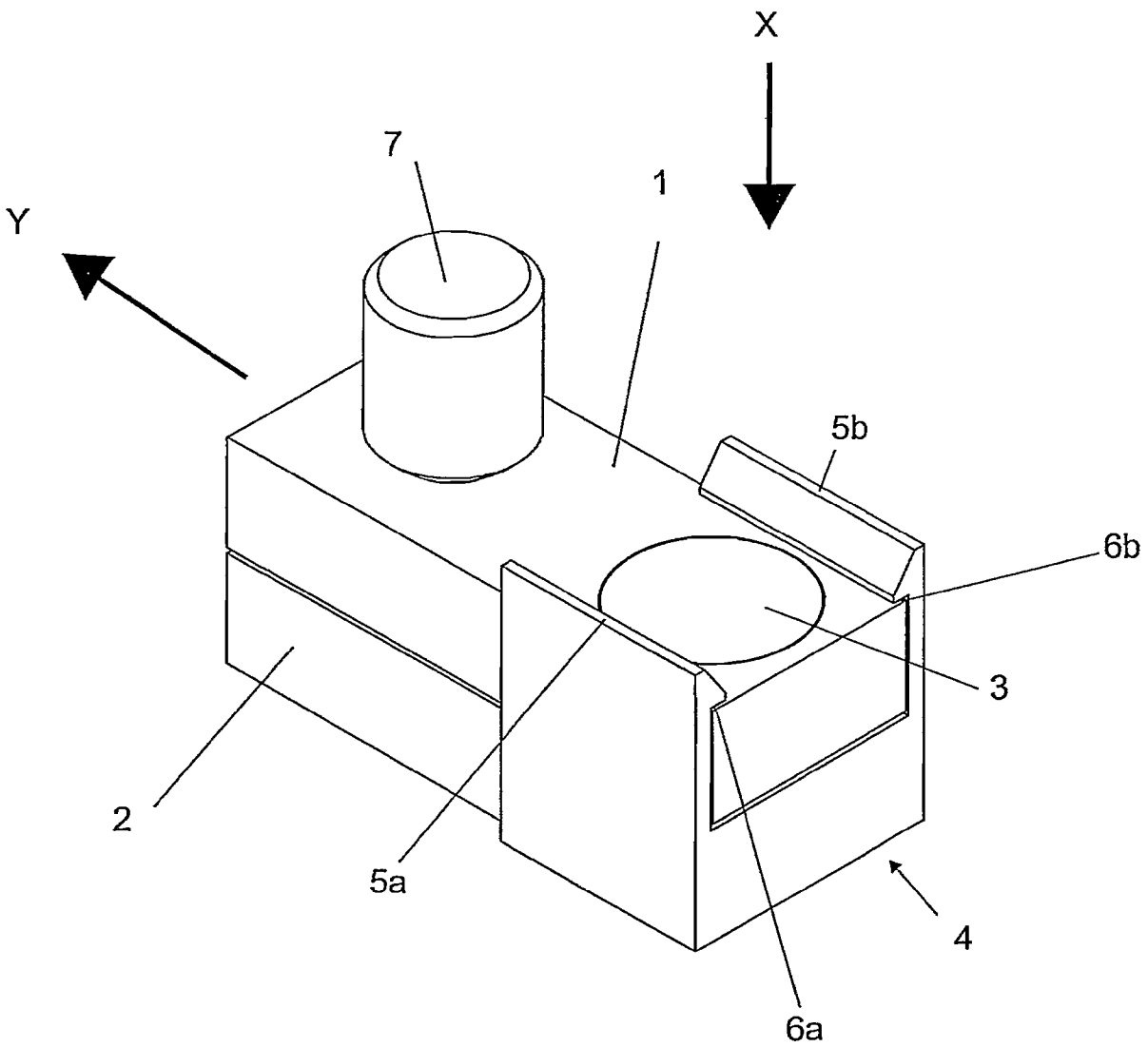
FIGS. 1*a*-1*e* show schematic views of a first embodiment of a lock device.

FIG. 1*a* shows the lock device in a closing position, in which the first connecting module 1 and the second connecting module 2 are mechanically catch-lockingly engaged with each other, in that spring lock elements 5*a*, 5*b*, arranged on the second connecting module 2, engage positive-lockingly with edges of the first connecting module 1, serving as blocking pieces 6*a*, 6*b*, so that the connection of the first connecting module 1 and the second connecting module 2 is mechanically secured against a load acting contrary to a closing direction X.

For the realization of magnetic means as a kind of a magnet-anchor system a magnet 3, 4 each (or on the one hand a magnet and on the other hand a magnetic anchor) is arranged on the first connecting module 1 and the second connecting module 2 respectively, which in the closing position, illustrated in FIG. 1*a*, stand frontally opposite to each other with contrary poles and attract each other magnetically. The magnetic means 3, 4 serve to support the closing process and to cause the establishing of the mechanical catch locking engagement largely automatically, so that the lock device is lockable in an easy and, for a user, haptically pleasant manner.

The lock device, illustrated in the closing position in FIG. 1*a*, can be opened by moving the first connecting module 1 in an opening direction Y, pointing transverse to the closing direction, relative to the second connecting module 2. Hereby, the edges of the first connecting module 1, serving as blocking pieces 6*a*, 6*b*, slide out of engagement with the spring lock elements 5*a*, 5*b* (see FIG. 1*c*), so that the first connecting module 1 can be taken away from the second connecting module 2 (see FIG. 1*d*).

To prevent an unintended opening of the lock device, a locking device is provided which prevents a lateral opening movement in the opening direction Y between the spring lock elements 5*a*, 5*b* and the blocking pieces 6*a*, 6*b*. The locking device is in the exemplary embodiment according to FIGS. 1*a* to 1*e* formed by a locking element 7 in the form of a locking bolt, which is guided movably on the first connecting module 1 and in the closing position according to FIG. 1*a* engages with an allocated, matching recess 8 (see FIG. 1*e*) on the second connecting module 2 in such a way that the first connecting module 1 cannot be shifted in the opening direction Y.

The locking element 7 can be pre-loaded in a locking position against the first connecting module 1 by the use of a mechanical spring in such a way that upon closing the lock device it automatically comes into the locking position, illustrated in FIG. 1*a*.

The locking element 7 on its end which engages with the recess 8 can be formed, for example be bevelled, in such a way that a movement in the opening direction Y is blocked, but not a movement in another direction, for example a movement counter to the opening direction Y.

Figure 1B:
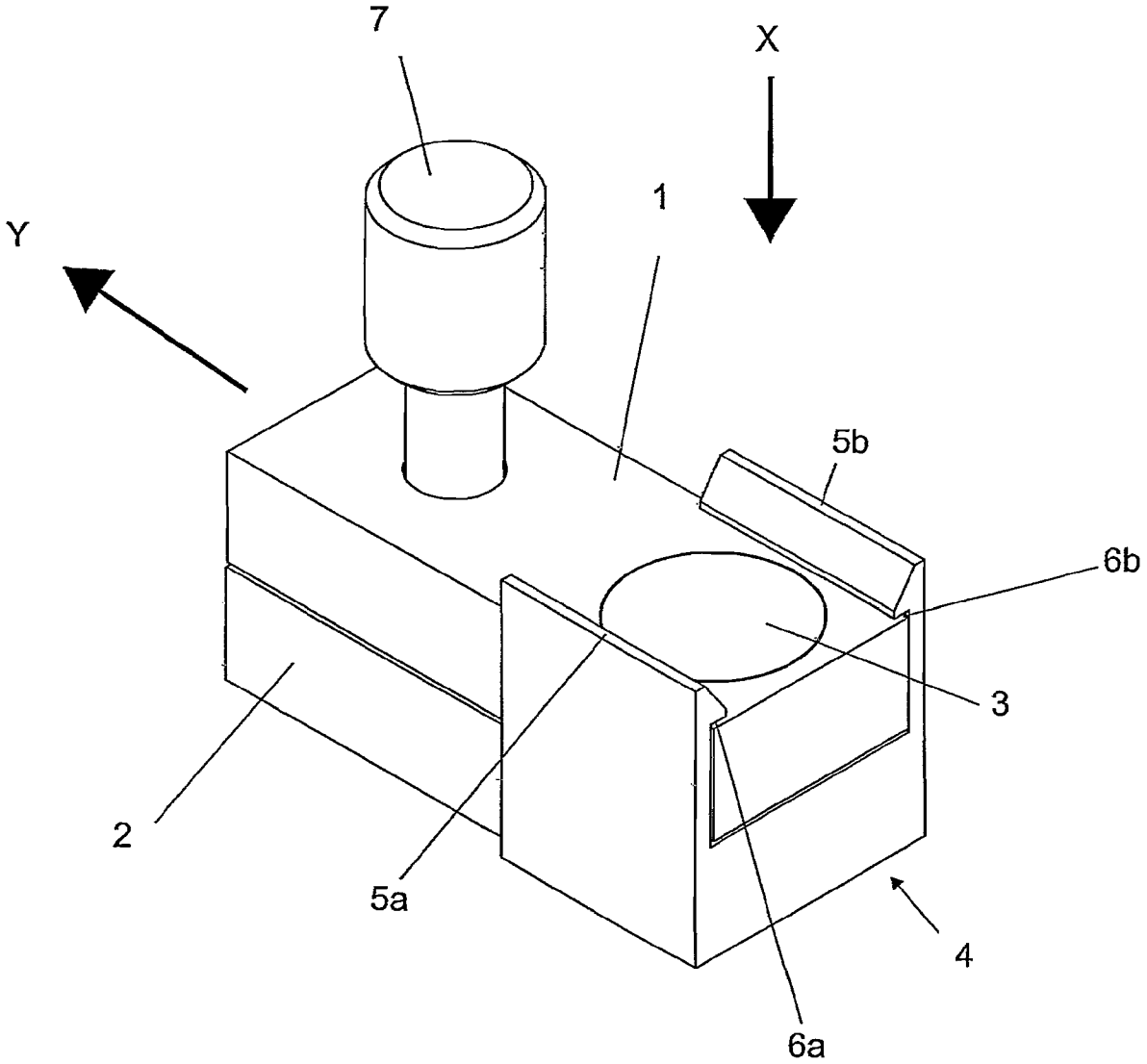

To open the lock device the locking device is to be unlocked by actuating the locking element 7 in that the locking element 7 is removed from the recess and thereby the positive-locking locking is terminated. FIG. 1*b* shows the lock device after unlocking. The locking element 7 is in this case actuated so far that it no longer engages with the recess 8 of the second connecting module 2, so that the first connecting module 1 is unlocked, i.e. can be shifted in the opening direction Y.

Figure 1C:
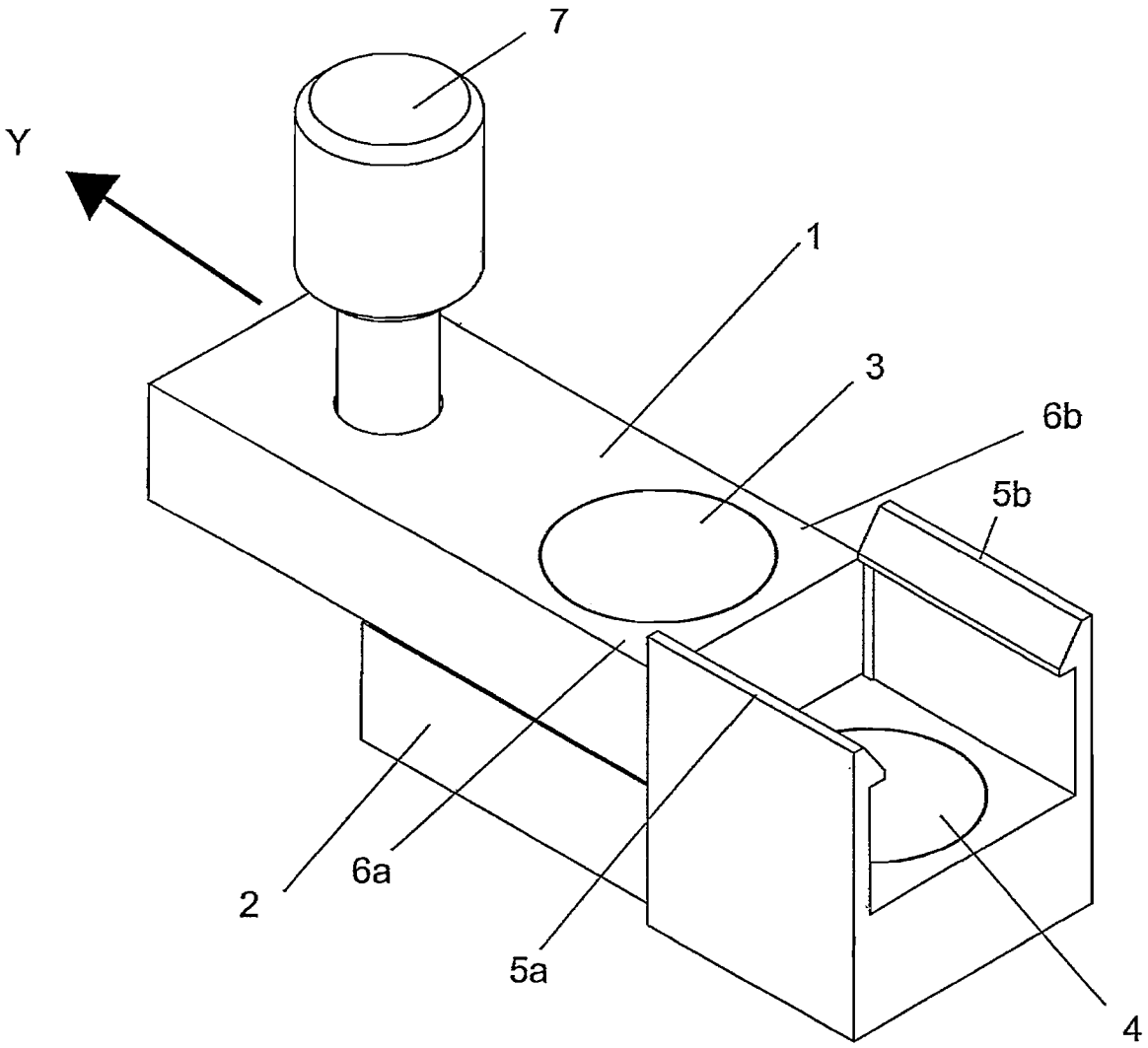

In the position illustrated in FIG. 1*c* the first connecting module 1 is so far shifted relative to the second connecting module 2 in the opening direction Y that the blocking pieces 6*a*, 6*b* and the spring lock elements 5*a*, 5*b* are laterally brought out of engagement, without the spring lock elements 5*a*, 5*b* having been spread for this purpose. At the same time, by the movement in the opening direction Y the magnets 3, 4 have been tangentially shifted relative to each other with their poles facing each other, so that the magnetic attracting force of the magnets 3, 4 has weakened and detaching the first connecting module 1 from the second connecting module 2 is readily possible. As the forces to be applied both for releasing the catch locking engagement by lateral shifting and for the shearing removal of the magnets 3, 4 away from each other are small, pleasant haptics also for opening are the result.

Figure 1D:
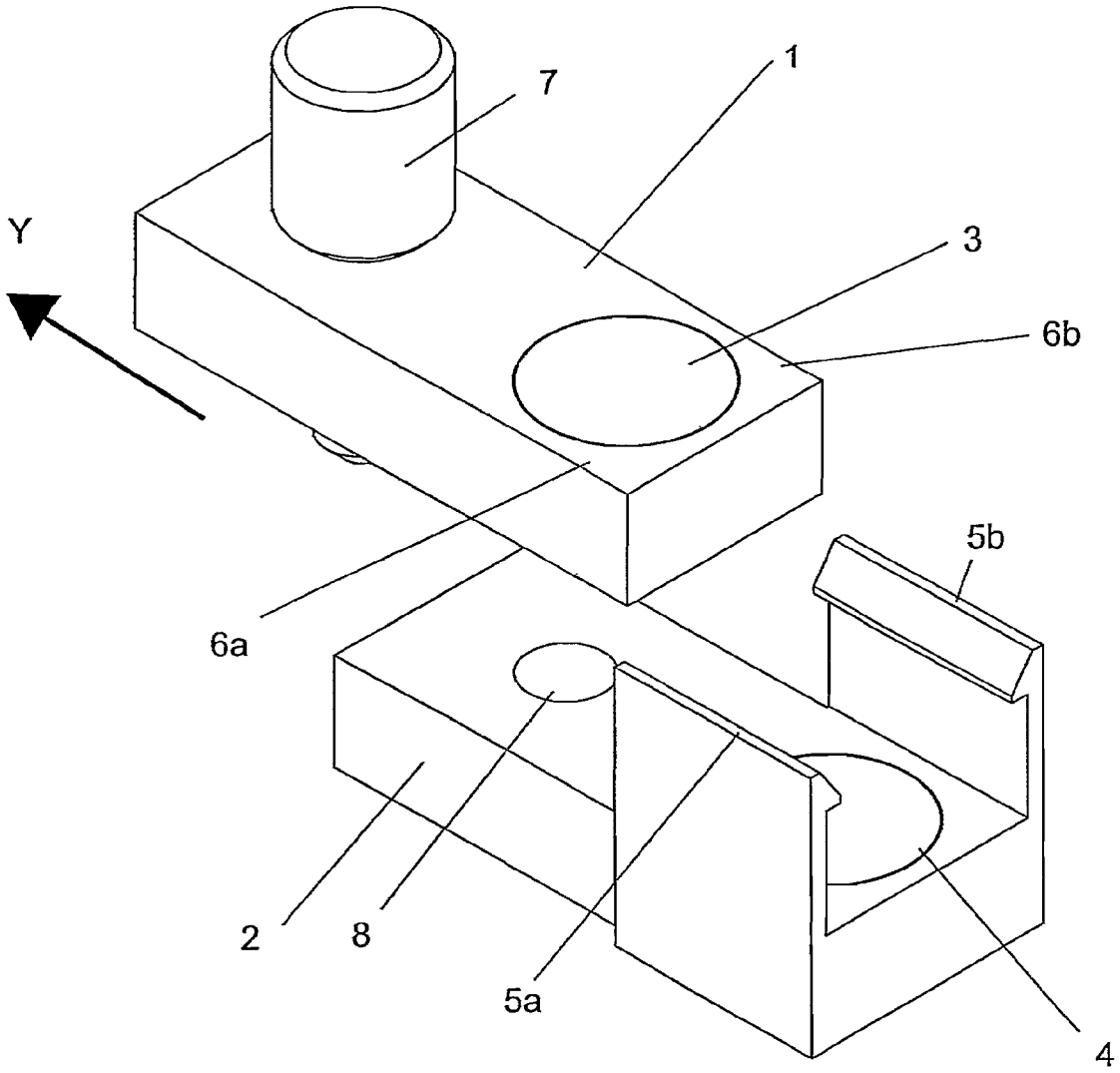

FIG. 1*d* shows the lock device in the opened state with connecting modules 1, 2 separated from each other. The magnets 3, 4 are spatially separated from each other, and the catch locking engagement of the spring lock elements 5*a*, 5*b* and the blocking pieces 6*a*, 6*b* is positioned out of engagement.

Figure 1E:
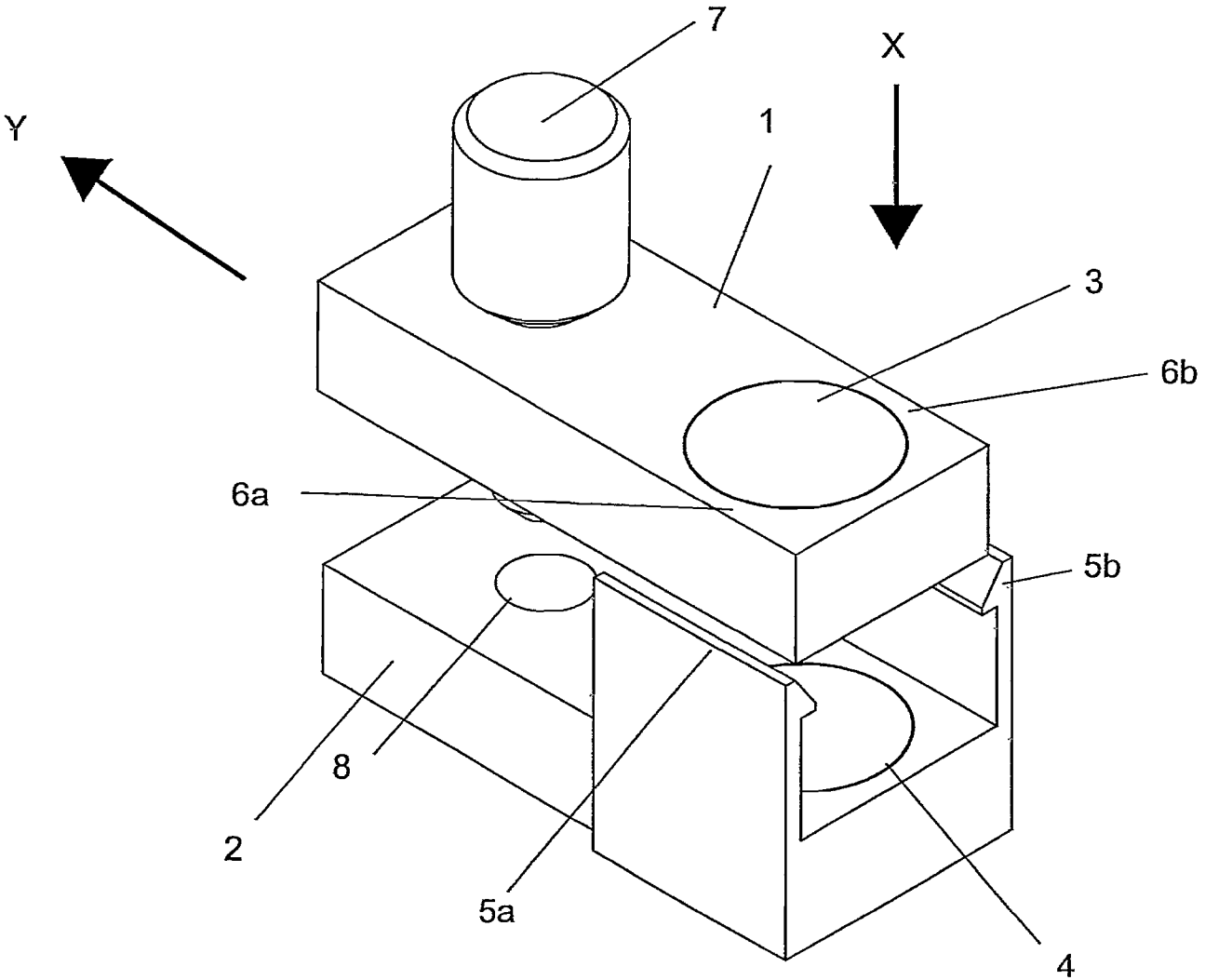

When the lock device is to be closed again, the first connecting module 1, as shown in FIG. 1*e*, has to be brought into a position, in which it can mechanically catch-lockingly engage with the second connecting module 2. For this purpose, additional restoring means e.g. in the form of a mechanical return spring can be provided (not illustrated in FIG. 1*e*), which bring the first connecting module 1 into the position shown in FIG. 1*e*, that is move it counter to the opening direction Y into such a position, that the blocking pieces 6*a*, 6*b* can come into catch-locking engagement with the spring lock elements 5*a*, 5*b*.

Additional restoring means can also be dispensed with, in that the return is taken on by the magnetic attracting force of the magnets 3, 4. By the magnetic attracting force the first connecting module 1 is automatically pulled into a position in which it can catch-lockingly engage with the second connecting module 2, and the catch locking engagement is automatically established. A sufficiently strong dimensioning of the magnetic attracting force is a prerequisite.

To close the lock device the first connecting module 1 and the second connecting module 2 are attached onto each other, wherein the closing process takes place magnetically supported by the magnetic attracting force of the magnets 3, 4 and thus the catch locking engagement of the first connecting module 1 with the second connecting module 2 is essentially established automatically. When the locking element 7 has previously been returned by a spring pre-load into its locking position, upon closing in the closing direction X the locking element 7 also automatically engages with the recess 8 again, so that the lock device is secured against an unintended opening without a further actuation of the locking element 7.

In a second exemplary embodiment, illustrated in FIGS. 2*a* to 2*f*, a safeguard against an unauthorized opening, particularly for an anti-theft protection, is also provided by a locking device. The lock device has yet again a first connecting module 1*a*, 1*b* and a second connecting module 2, wherein the first connecting module 1*a*, 1*b* is made of two parts, namely a first module part 1*a*, formed as a movable slide serving as actuating element, and a second module part 1*b*, slidingly guiding the first module part 1*a* in the opening direction Y.

The same reference signs as in FIGS. 1*a* to 1*e* are assigned to components with the same function in the figures, as also in all subsequent exemplary embodiments, as far as this is useful.

At this point it shall be noted that the first connecting module 1*a*, 1*b* of the lock device can also be designed as one part, analogous to the embodiment according to FIGS. 1*a* to 1*e*.

A magnet 3 is arranged on the first module part 1*a*, which in the closing position (FIG. 2*a*) stands frontally attracting opposite to a magnet 4 (or a magnetic anchor) on the second connecting module 2. Moreover, blocking pieces 6*a*, 6*b* are arranged on the first connecting module 1*a* which in the closing position engage positive-lockingly with spring lock elements 5*a*, 5*b* on the second connecting module 2 and form a spring catch locking with the spring lock elements 5*a*, 5*b*. The spring catch locking and the strength of the magnets 3, 4 is herein measured in such a way that by the effect of the magnetic attracting force the catch locking is closed automatically.

The second module part 1*b* of the first connecting module is in the closing position (FIG. 2*a*) fixed via lateral guiding rails 12*a*-12*d* on the second connecting module 2 in such a way that it is not movable relative to the second connecting module 2, particularly not in the opening direction Y. In the closing position the first module part 1*a* is thereby together with the second module part 1*b* held onto the second connecting module 2.

Figure 2A:
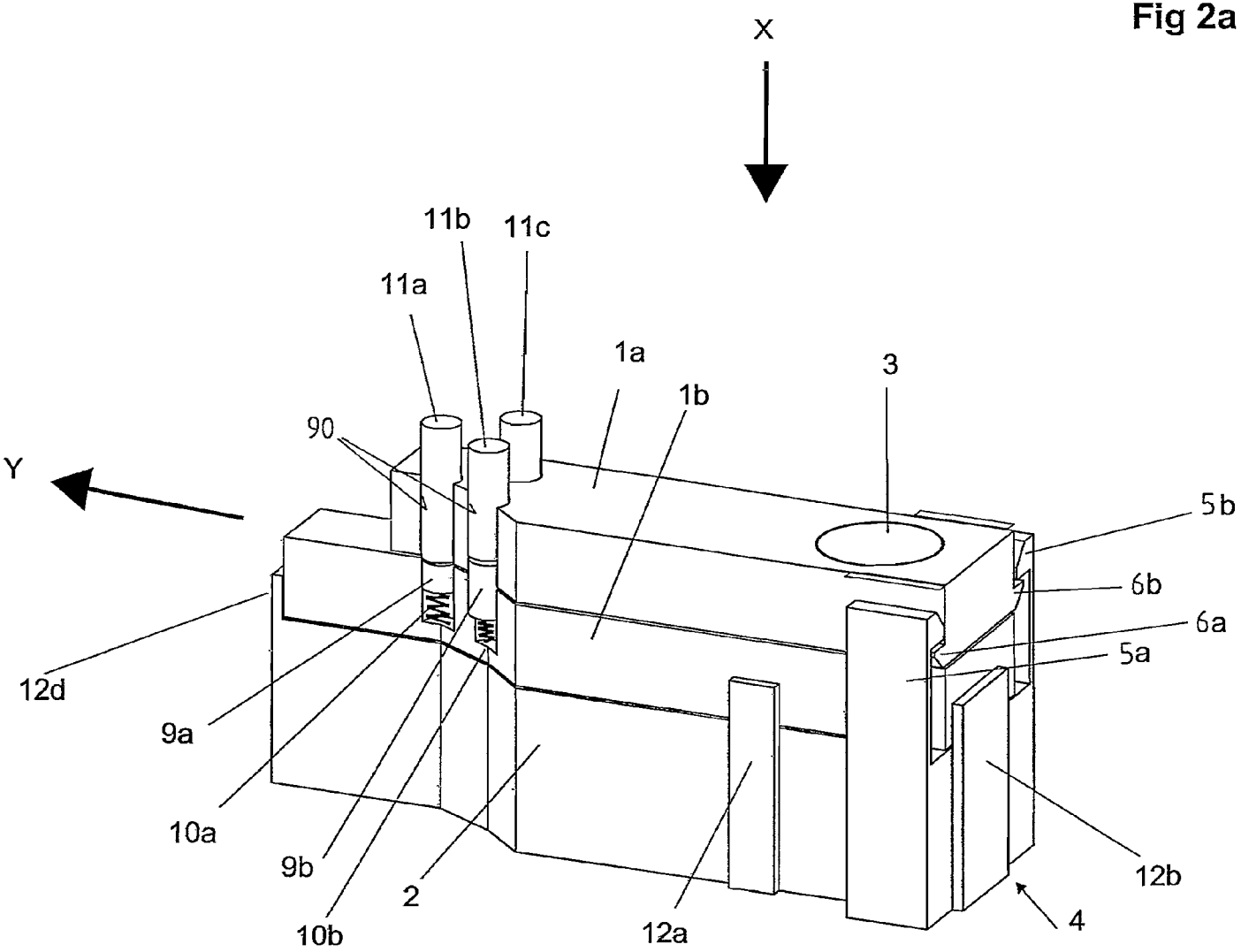
FIGS. 2*a*-2*f* show schematic views of a second embodiment of a lock device.
Figure 2B:
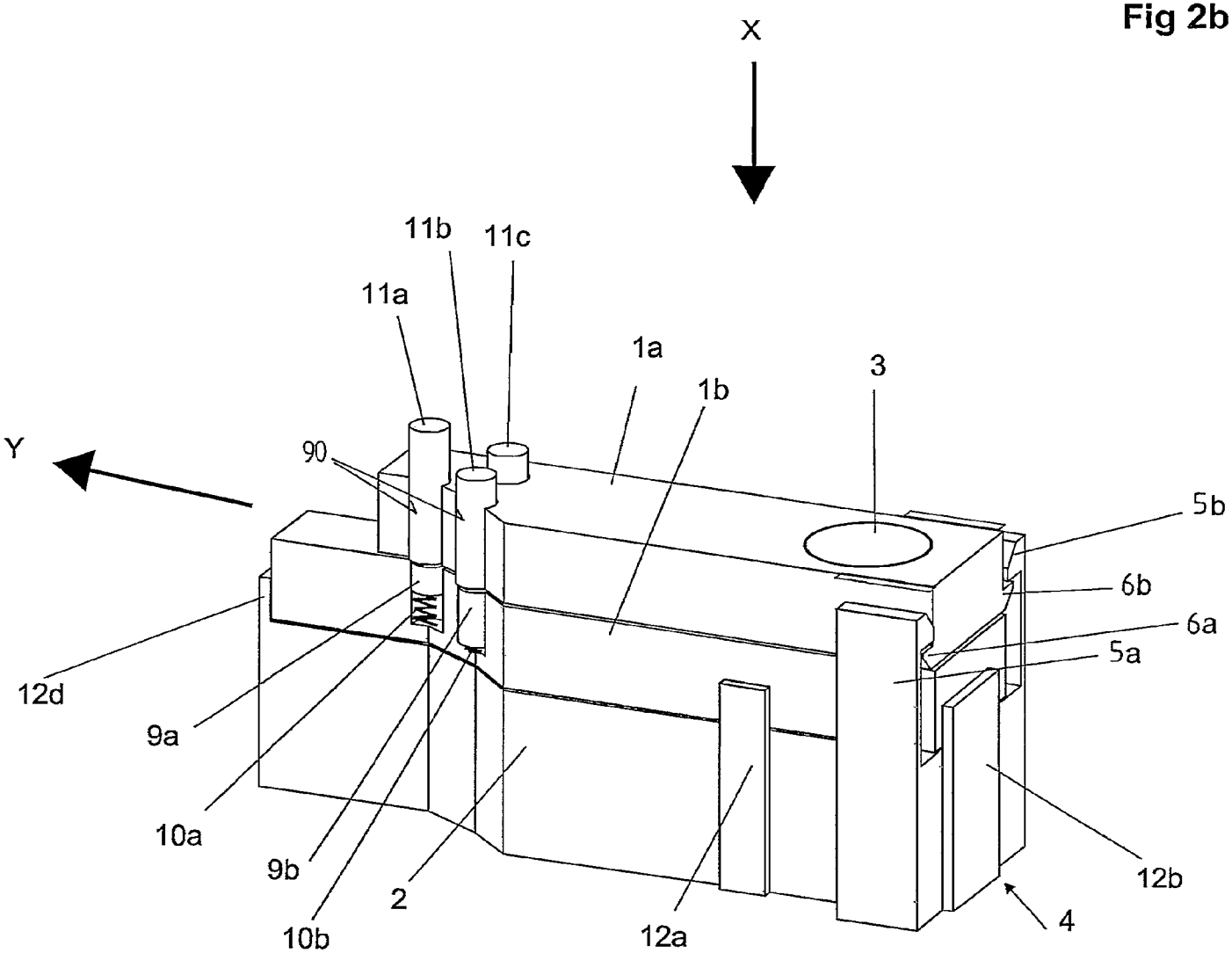
Figure 2C:
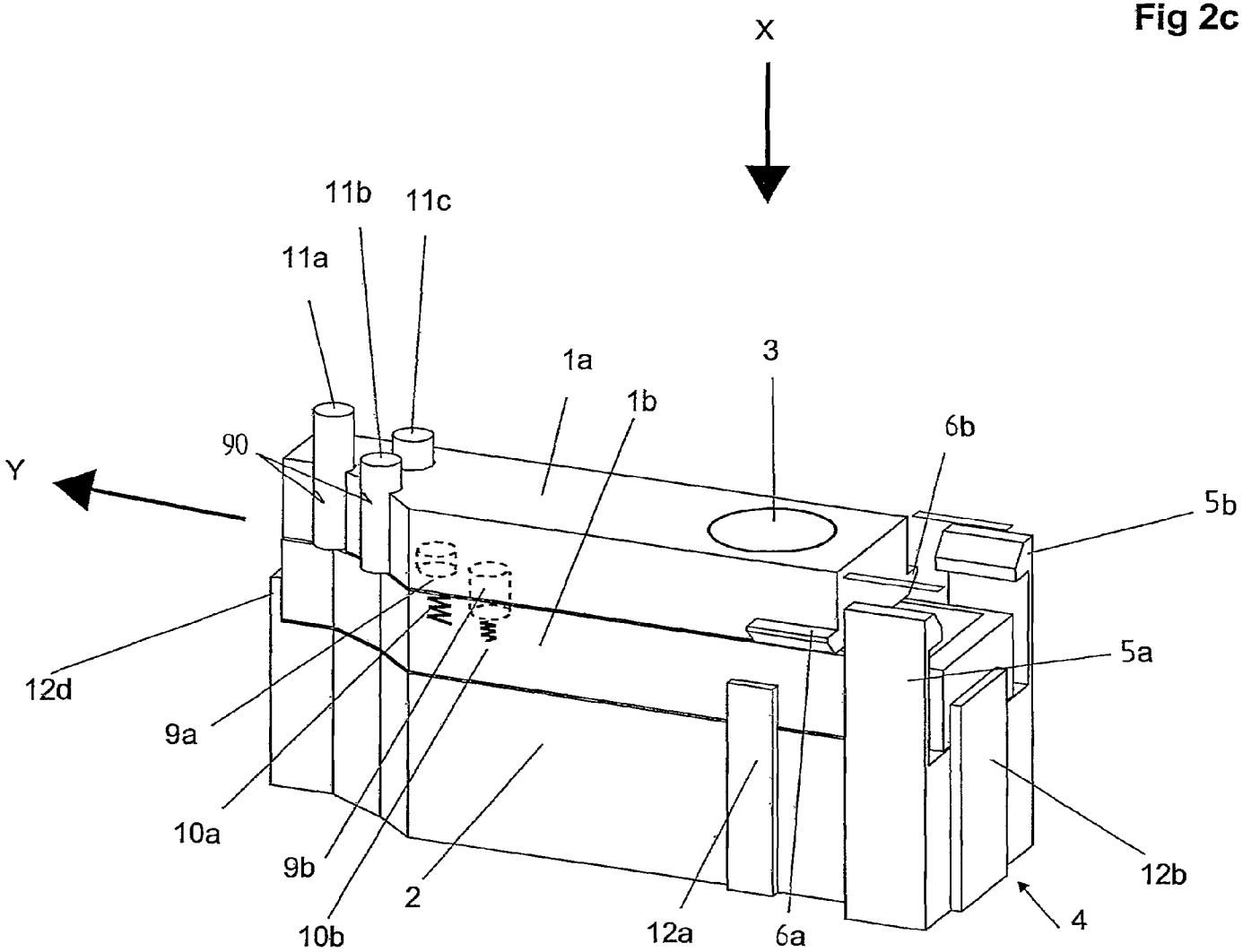

To open the lock device the first module part 1*a*, which serves as actuating element, is moved in the opening direction Y relative to the second module part 1*b*, until the blocking pieces 6*a*, 6*b* come out of engagement with the spring lock elements 5*a*, 5*b* (see FIG. 2*c*). In the closing position the first module part 1*a* and the second module part 1*b* are here, however, locked with each other via a locking device, realized by locking elements 9*a*, 9*b*, 9*c* and actuating bolts 11*a*, 11*b*, 11*c*, so that opening the lock device is only possible when the locking device has previously been unlocked (FIG. 2*b*).

For the realization of the locking device multiple locking elements 9*a*, 9*b*, 9*c* are arranged on the second module part 1*b*, which are pre-loaded via return springs 10*a*, 10*b*, 10*c* against the second module part 1*b* and in the closing position engage with allocated recesses 90 of the locking of the first module part 1*a*, so that the first module part 1*a* cannot be shifted relative to the second module part 1*b* and is thereby fixed in the opening direction Y relative to the second connecting module 2.

By pushing in the actuating bolts 11*a*, 11*b*, 11*c*, which stand in operative connection with the locking elements 9*a*, 9*b*, 9*c*, the locking elements 9*a*, 9*b*, 9*c* can be brought out of engagement with the recesses 90 to release the locking between the first module part 1*a* and the second module part 1*b*. Here, in the locking position illustrated in FIG. 1*a*, not all the locking elements 9*a*, 9*b*, 9*c* engage with an allocated recess, wherein from outside it cannot be seen by a user which actuating bolts 11*a*, 11*b*, 11*c* are to be actuated and which are not and whether the individual locking elements 9*a*, 9*b*, 9*c* in the non-actuated state are positioned in locking engagement or not and whether they lock or unlock by the actuation.

In the present exemplary embodiment the actuating bolts 11*a*, 11*b*, 11*c* are to be actuated so that the locking elements 9*a*, 9*b*, 9*c* are pushed into the second module part 1*b* against the force of the respective return spring 10*a*, 10*b*, 10*c* and stop at a predetermined position. Two variants of bolt lengths of the locking elements 9*a*, 9*b*, 9*c* are provided:

Either the length of the upper actuating bolt 11*a*, 11*b*, 11*c* and lower locking element 9*a*, 9*b*, 9*c* is measured in such a way that the plane of osculation of the upper actuating bolt 11*a*, 11*b*, 11*c* and the lower locking element 9*a*, 9*b*, 9*c* lies specifically on the shifting plane between the first module part 1*a* and the second module part 1*b*. The locking element 9*a*, 9*b*, 9*c* is in this case unlocked in the non-actuated state, i.e. without actuation it does not stand opposed to a shifting of the first module part 1*a* and the second module part 1*b*, but blocks after actuation.

Or the length of the upper actuating bolt 11*a*, 11*b*, 11*c* and lower locking element 9*a*, 9*b*, 9*c* is measured in such a way that only after an actuation the plane of osculation of the upper actuating bolt 11*a*, 11*b*, 11*c* and the lower locking element 9*a*, 9*b*, 9*c* lies in the shifting plane of the first module part 1*a* and the second module part 1*b*. In this case the locking element 9*a*, 9*b*, 9*c* locks in the non-actuated state and is unlocked by an actuation.

Multiple such bars together form a combination lock, which with an increasing number of bars offers more and more combination possibilities.

In FIG. 2*b* the lock device is illustrated in the unlocked state. The actuating bolts 11*b*, 11*c* are pushed in and the allocated locking elements 9*b*, 9*c* are unlocked. The first module part 1*a* can, thereby, be shifted in the opening direction Y to open the lock device.

FIG. 2*c* shows the lock device after the lateral shift of the first module part 1*a* in the opening direction Y (directed transverse to the closing direction X) in the non-engaged position, in which on the one hand the magnets 3, 4 are shifted relative to each other and on the other hand the spring catch locking of the blocking pieces 6*a*, 6*b* and the spring lock elements 5*a*, 5*b* is laterally brought out of engagement. The lock device can in this state be released.

Figure 2D:
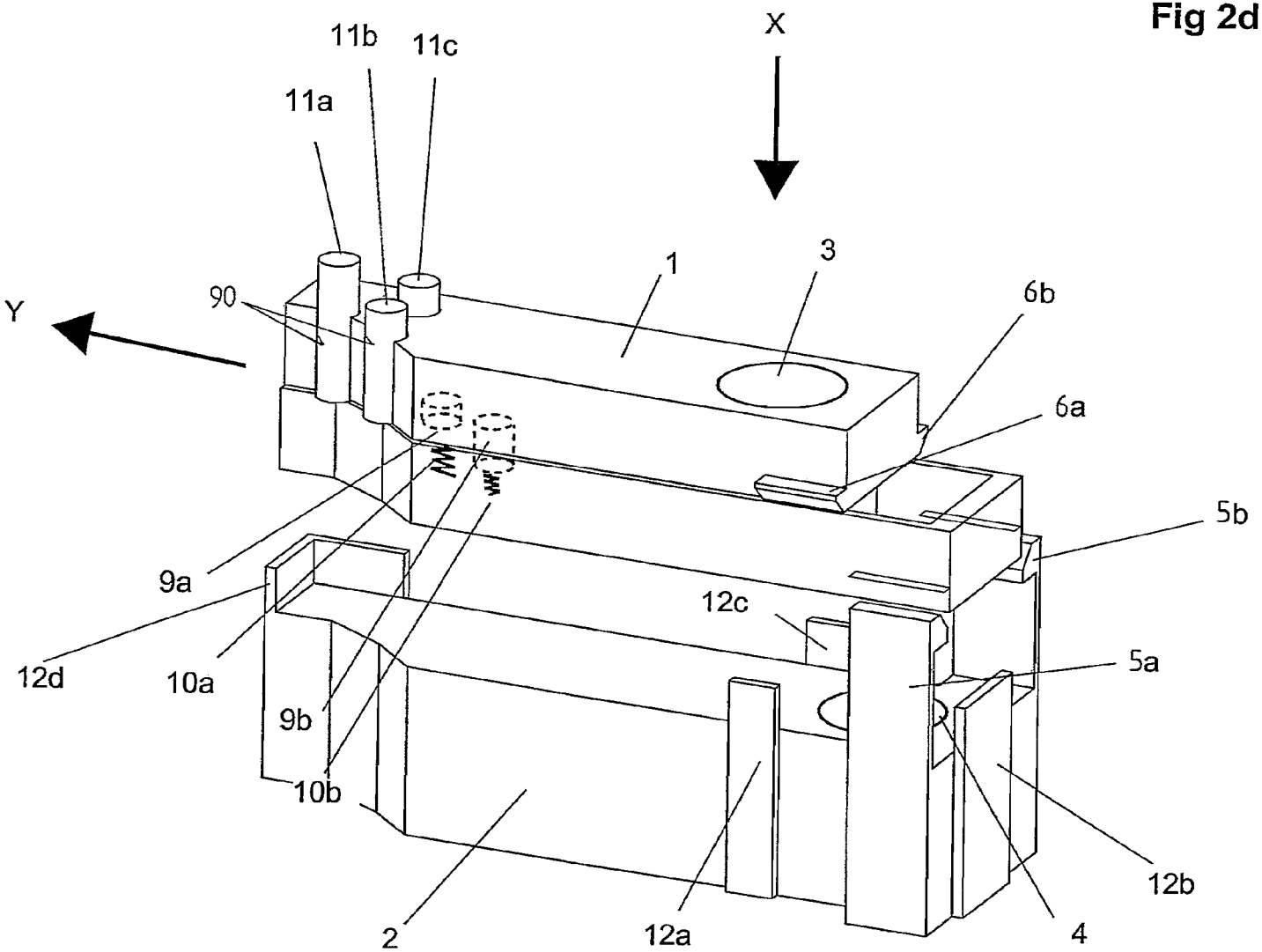

In FIG. 2*d* the two connecting modules 1*a*, 1*b*, 2 are illustrated in the opened state completely separated from each other.

Figure 2E:
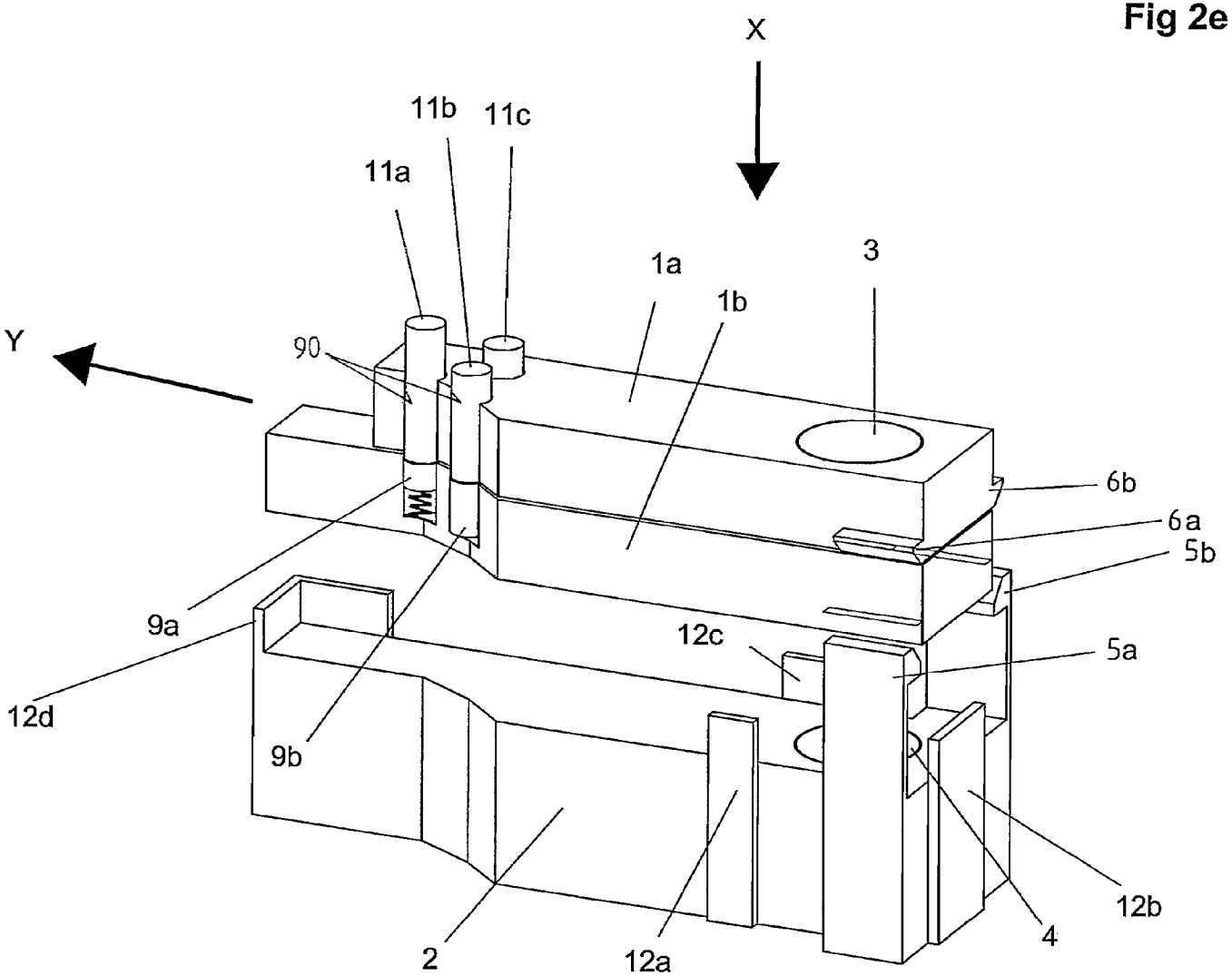
Figure 2F:
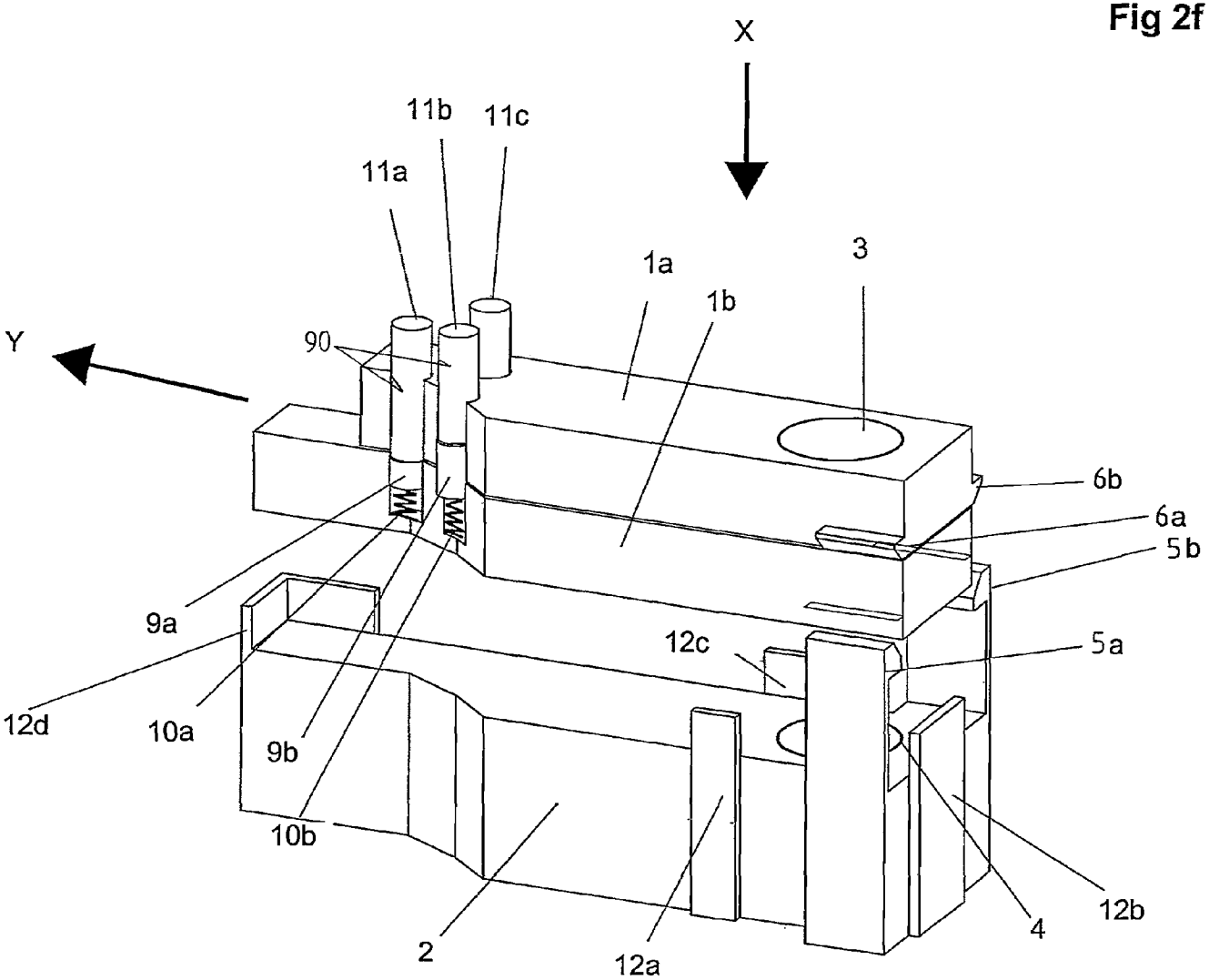

In the position illustrated in FIG. 2*e* the first module part 1*a*, designed as a slide, is returned into a position, in which the blocking pieces 6*a*, 6*b* can again be catch-lockingly engaged with the spring lock elements 5*a*, 5*b* to close the lock device. The return can take place manually, by suitable design of the magnets 3, 4 (or anchors) or by additional restoring means e.g. in the form of a mechanical return spring, which pre-load the first module part 1*a* against the second module part 1*b* in the direction of the catch locking position, illustrated in FIG. 2*e*.

Caused by the return springs 10*a*, 10*b*, 10*e* (FIG. 2*f*), furthermore, also the locking elements 9*a*, 9*b*, 9*c* are returned into their starting position.

The locking device of the exemplary embodiment according to FIGS. 2*a* to 2*f* can be further developed in that an opening means of the kind of a key actuates the locking elements 9*a*, 9*b*, 9*c* in a due manner after an adjusted insertion by correspondingly pre-formed pins. In this case, only the inserting and shifting (or turning) of the opening means is required for opening. It is then also possible that a locking element 9*a*, 9*b*, 9*c* can assume not only two positions, but e.g. three or more, so that an unlocking only takes place when the respective locking element 9*a*, 9*b*, 9*c* has been shifted into the correct position, which strongly increases the number of possible combinations.

In a further exemplary embodiment of a lock device in the form of a strap buckle, e.g. for the use as a buckle for a helmet, illustrated in FIGS. 3*a* to 3*f*, in a closing position a second connecting module 2 in the form of a so-called male part engages with a first connecting module 1 in the form of a so-called female part and can only be detached again by a lateral shifting in an opening direction Y, however, only after unlocking by actuating an unlocking button 17.

Figure 3A:
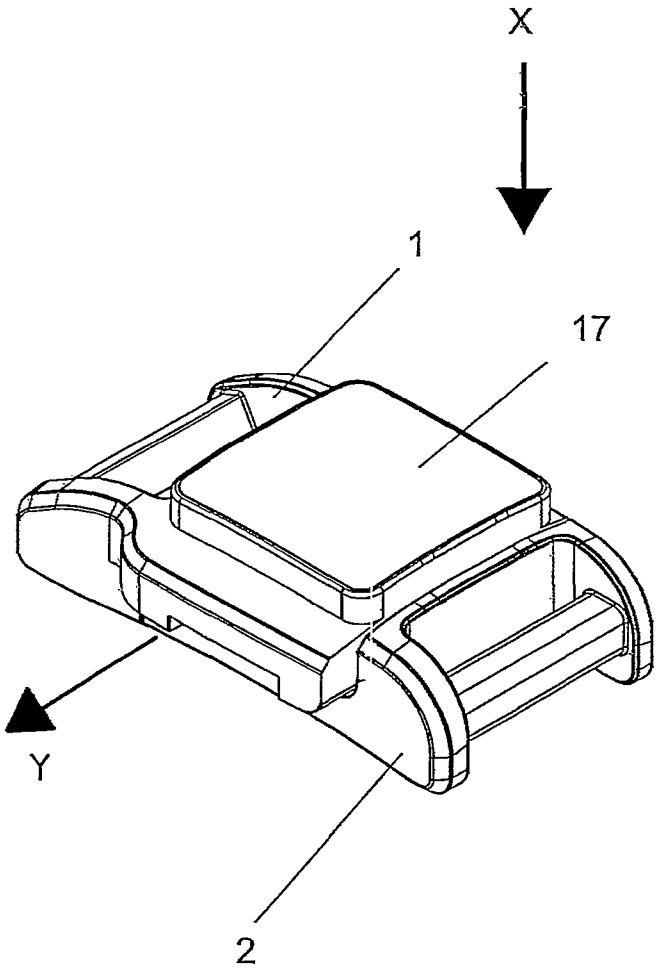
FIG. 3*a* shows a perspective view of a third embodiment of a lock device.
Figure 3B:
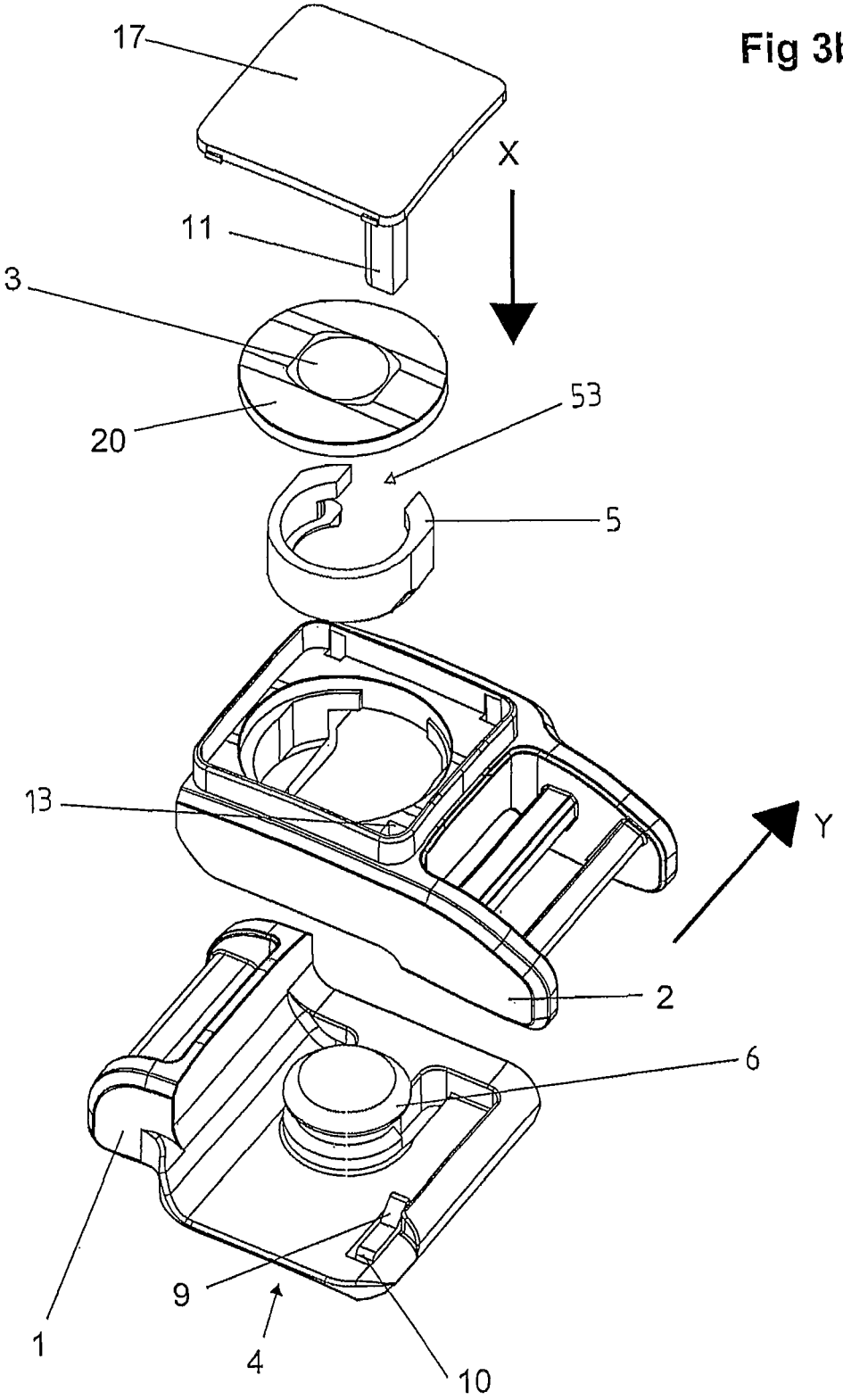
FIGS. 3*b*, 3*c* show perspective exploded views of the lock device according to FIG. 3*a;*
Figure 3C:
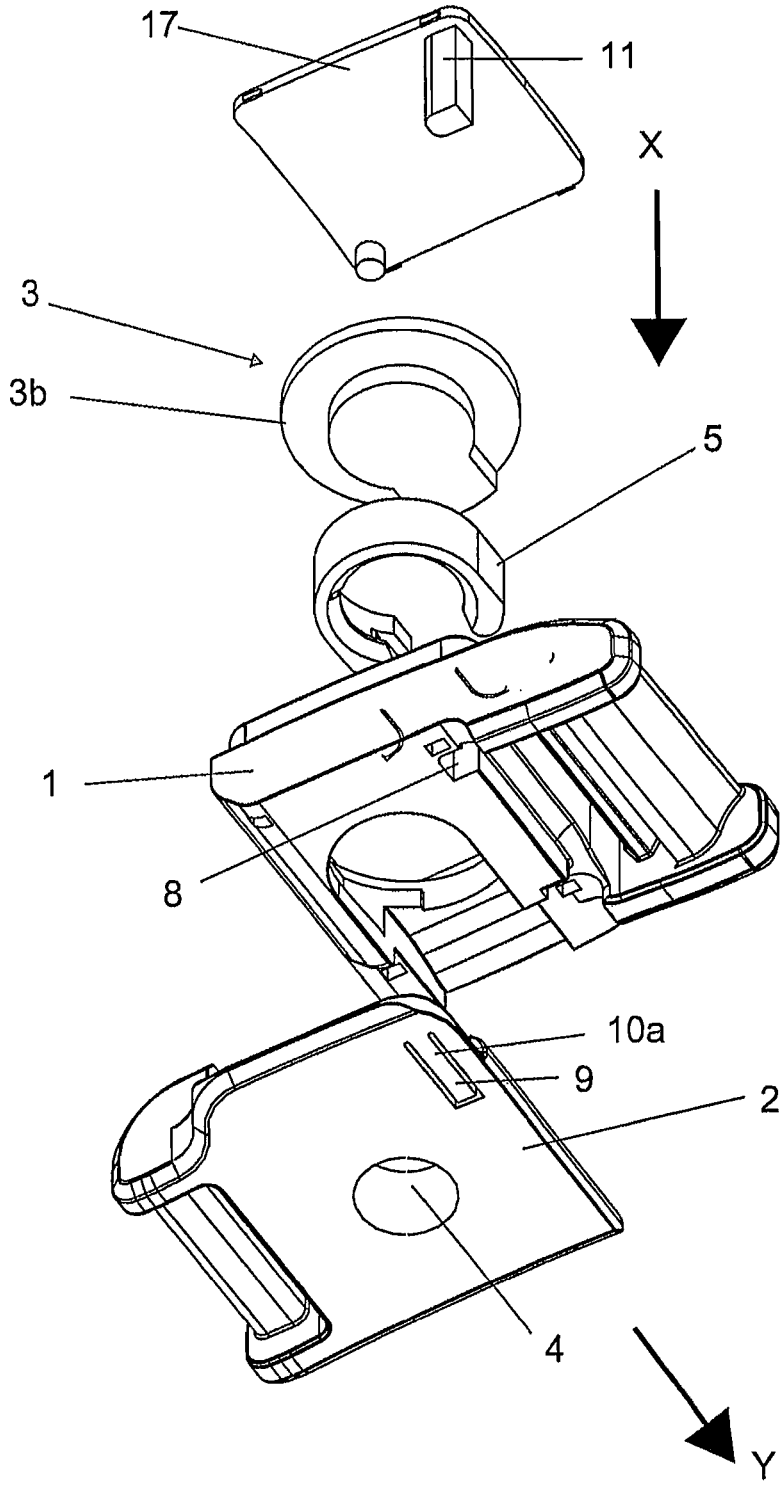

FIGS. 3*b* and 3*c* show the lock device with its individual parts in two exploded views in a diagonal top angle perspective (FIG. 3*b*) and in a diagonal low angle perspective (FIG. 3*c*).

A spring lock element 5 in the form of a spreading ring, which is arranged on a base plate 20 in such a way that the spring lock element 5 state can move aside in a radial direction to establish the closing, is part of the second connecting module 2 (female part). A magnet 3 is arranged on the base plate 20 in such a way that after the closing it lies attracting opposite a magnet 4 on the first connecting module 1 (male part).

In a closing position (FIG. 3*a*, 3*e*) a blocking piece 6 in the form of a mushroom-shaped knob engages positive-lockingly with the spring lock element 5 in the form of the spreading ring and thereby catch-lockingly connects the first connecting module in a positive-locking manner to the second connecting module 2.

Figure 3D:
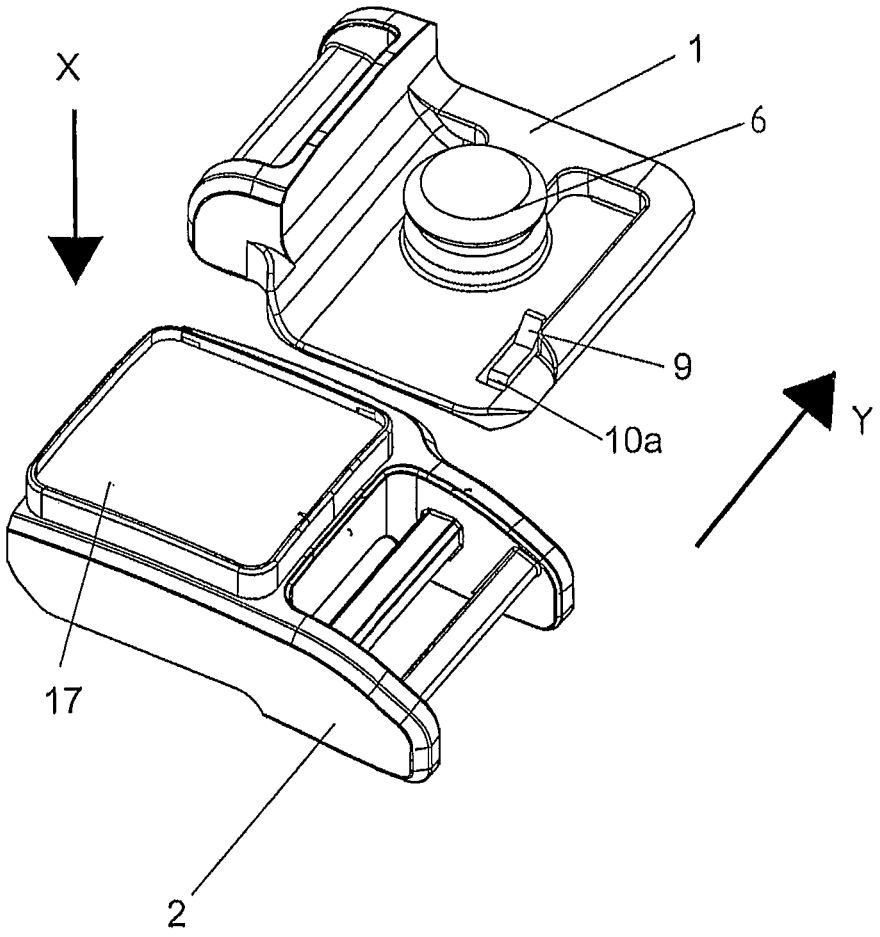
FIGS. 3*d*-3*f* show views of the lock device according to FIG. 3*a* in the opened state, in the closed state and upon establishing the closing state.
Figure 3E:
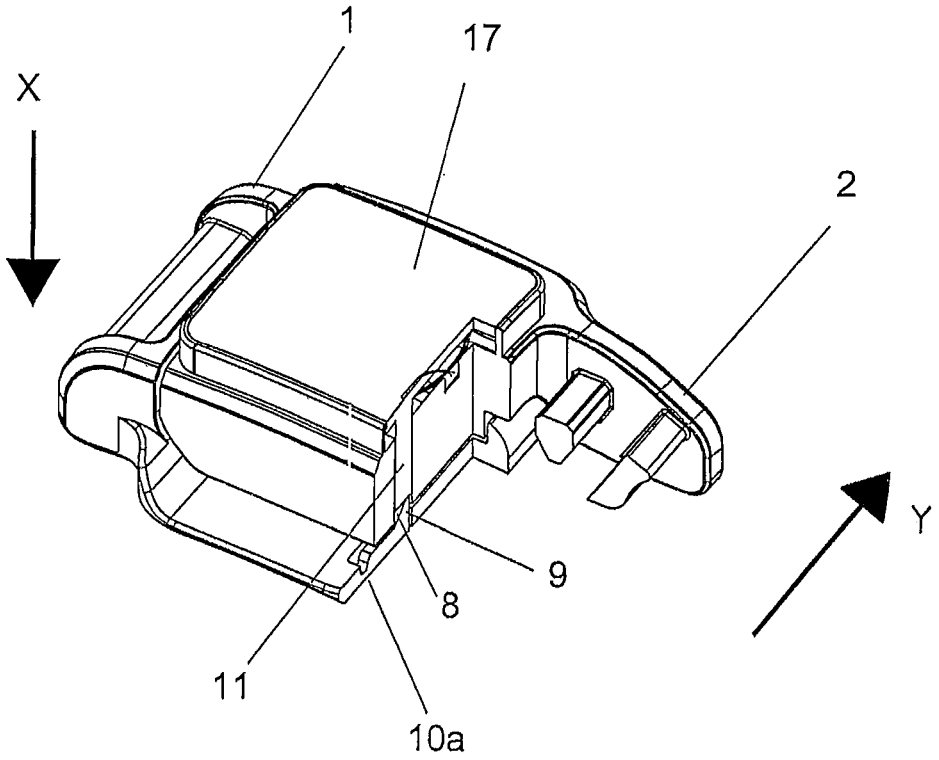
Figure 3F:
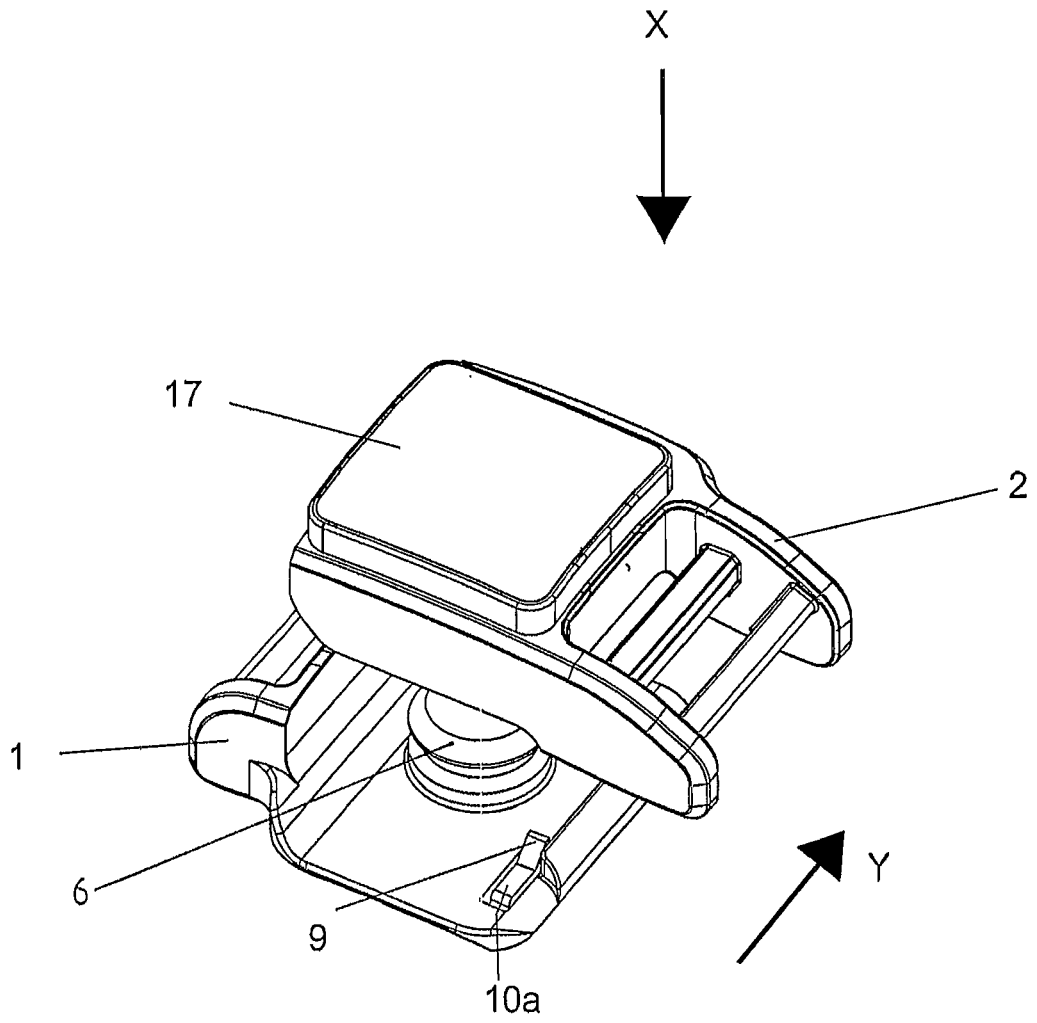

To establish the closing position the first connecting module is attached onto the second connecting module 2 in the closing direction X, so that the blocking piece 6 catch-lockingly engages with the spring lock element 5 (FIG. 3*f*). Establishing the catch locking engagement takes place by the magnetic attraction of the magnets 3, 4 (one of which can also be constructed as a magnetic anchor) largely automatically upon attaching the first connecting module 1 onto the second connecting module 2.

The spring lock element 5 in the form of the spreading ring has a lateral recess 53, so that the spring lock element 5 is not closed circumferentially, but instead is open to one side. Thereby, it is possible, by shifting the first connecting module 1 relative to the second connecting module 2 in the opening direction Y transverse to the closing direction X, to shift the spring lock element 5 out of engagement with the blocking piece 6, so that the catch-locking, positive-locking connection of the first connecting module 1 to the second connecting module 2 is terminated and the lock device can be released. By the shifting in the opening direction Y at the same time the magnets 3, 4 are also removed from each other so that their magnetic attracting force weakens and the first connecting module 1 can readily and in a haptically pleasant manner be detached from the second connecting module 2.

In the closing position a locking element 9, arranged on the second connecting module 2, engages with an allocated recess 8 on the first connecting module 1 (see FIG. 3*c*) in such a way that the first connecting module 1 counter to a movement in the opening direction Y is locked with the second connecting module 2. The locking element 9 is elastically arranged on the second connecting module 2 via a return spring 10*a* in the form of an elastic section, so that the locking is established automatically when the first connecting module 1 comes into the closing position on the second connecting module 2.

To unlock the lock device, the unlocking button 17 has to be actuated, which is mounted movable via an actuating bolt 11 on the second connecting module 2 on a guiding rail 13 in the form of a shaft-like recess. The actuating bolt 11 stands in operative connection with the locking element 9 on the first connecting module 1 and acts, upon actuating the unlocking button 17, by applying a compressive force in the closing direction X upon the locking element 9 in such a way that the locking element 9 comes out of engagement with the recess 8 on the second connecting module 2 (FIG. 3*e*).

After actuating the unlocking button 17 the first connecting module 1 can be shifted in the opening direction Y relative to the second connecting module 2. FIG. 3*d* shows the first and the second connecting module 1, 2 after the shift in the opening direction Y has taken place. The connecting modules 1, 2 are separated from each other, the lock device is opened.

Figure 4A:
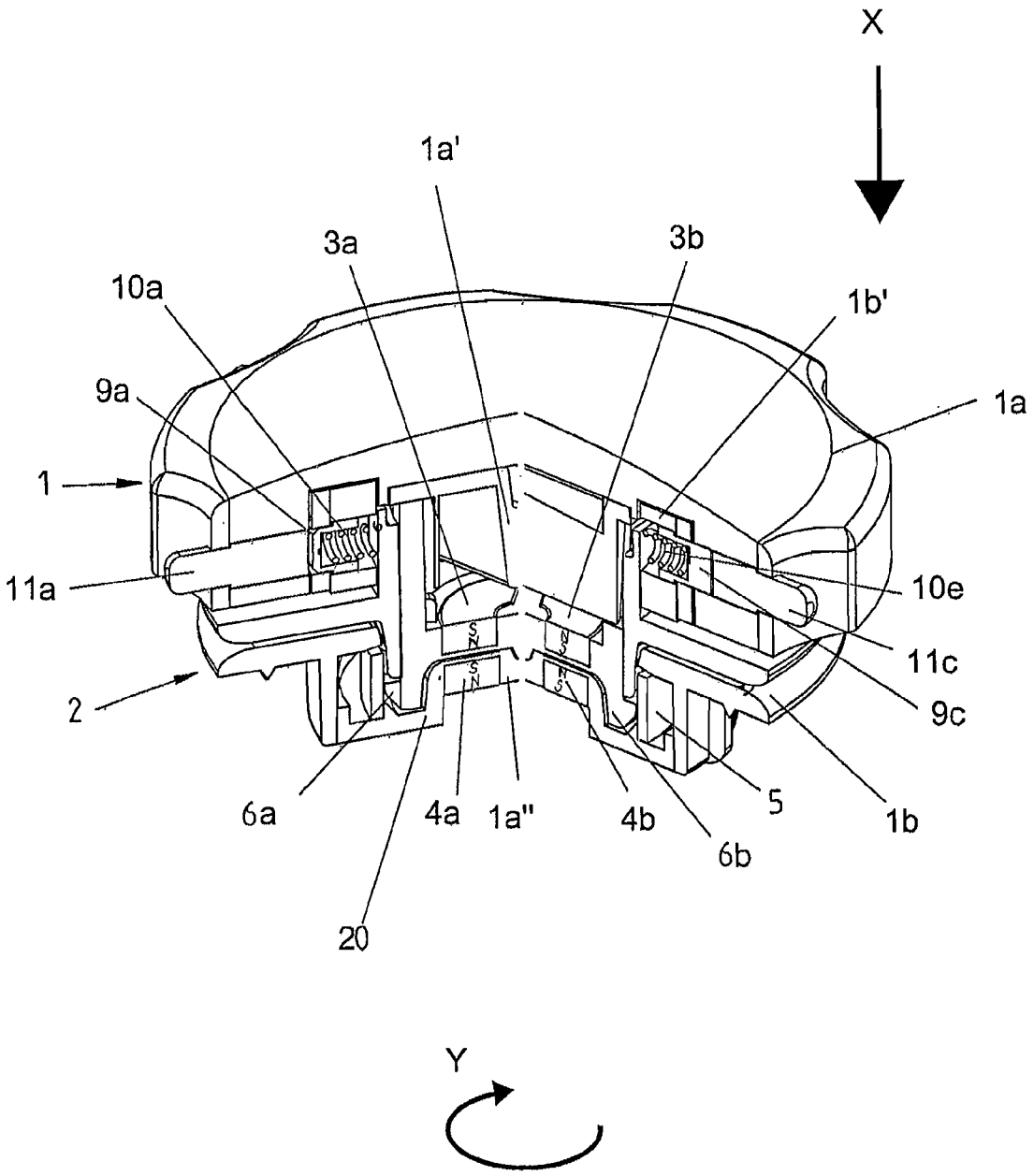
FIGS. 4*a*-4*f* show perspective partial views of a fourth embodiment of a lock device.
Figure 4B:
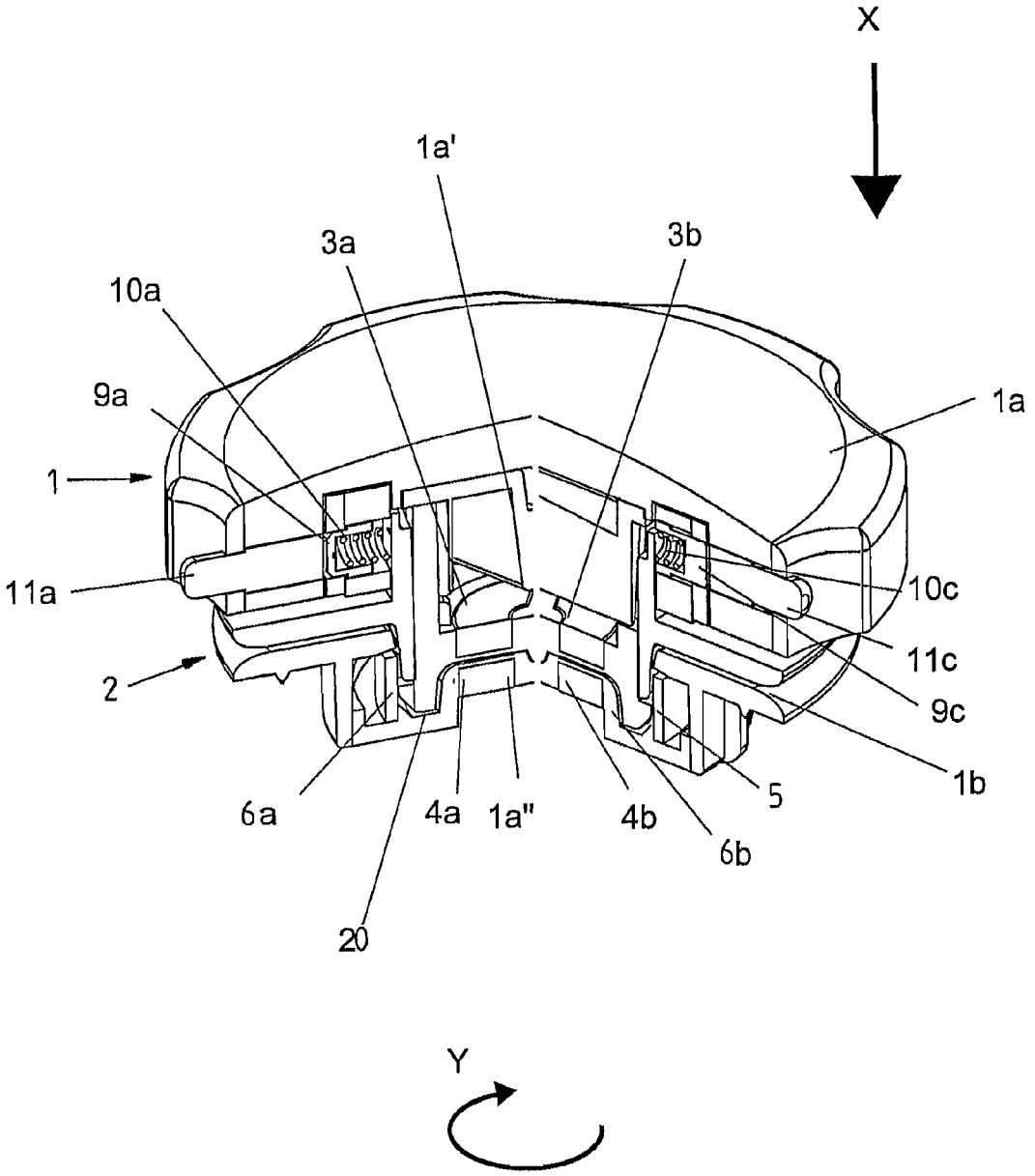
Figure 4C:
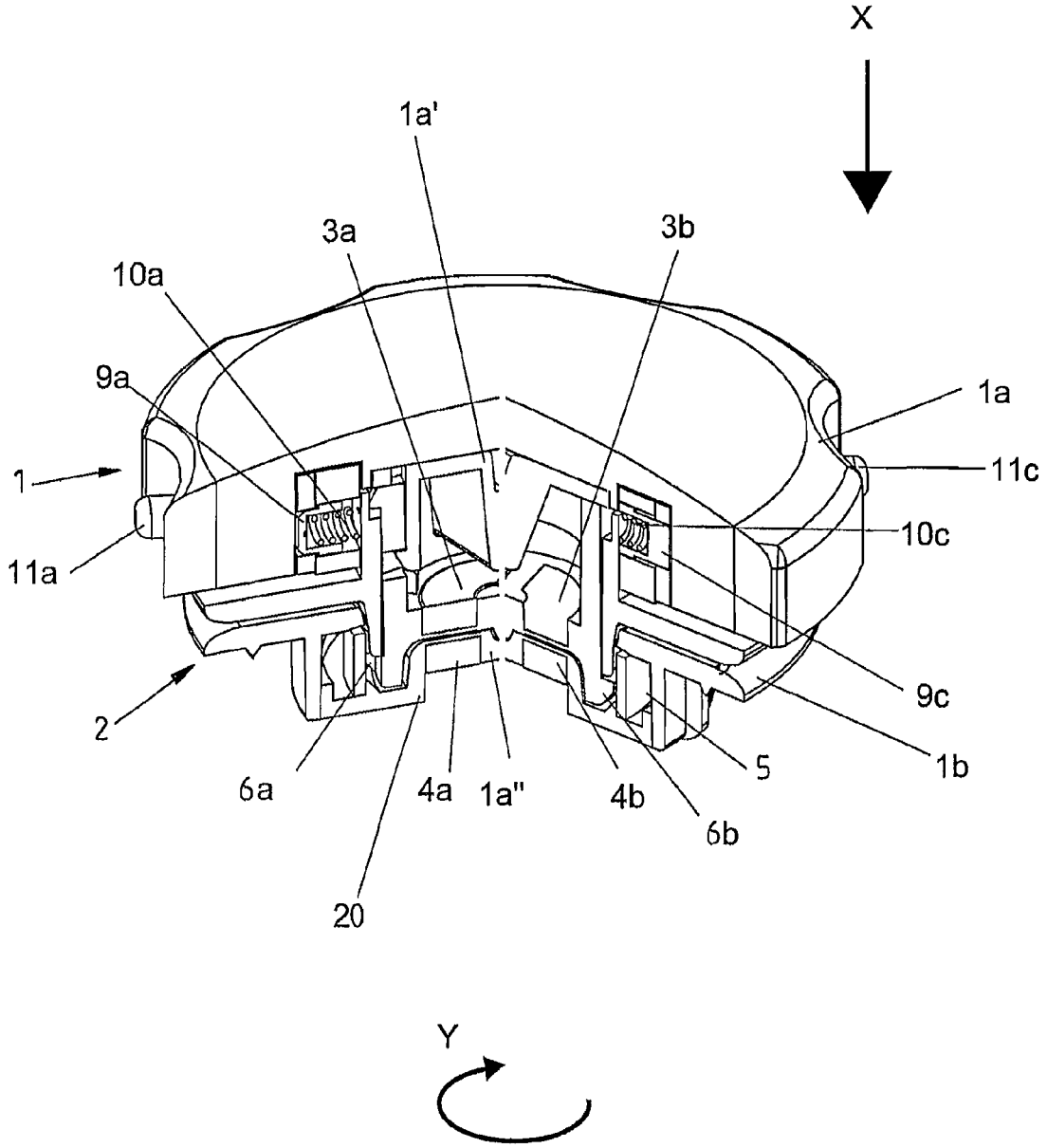
Figure 4D:
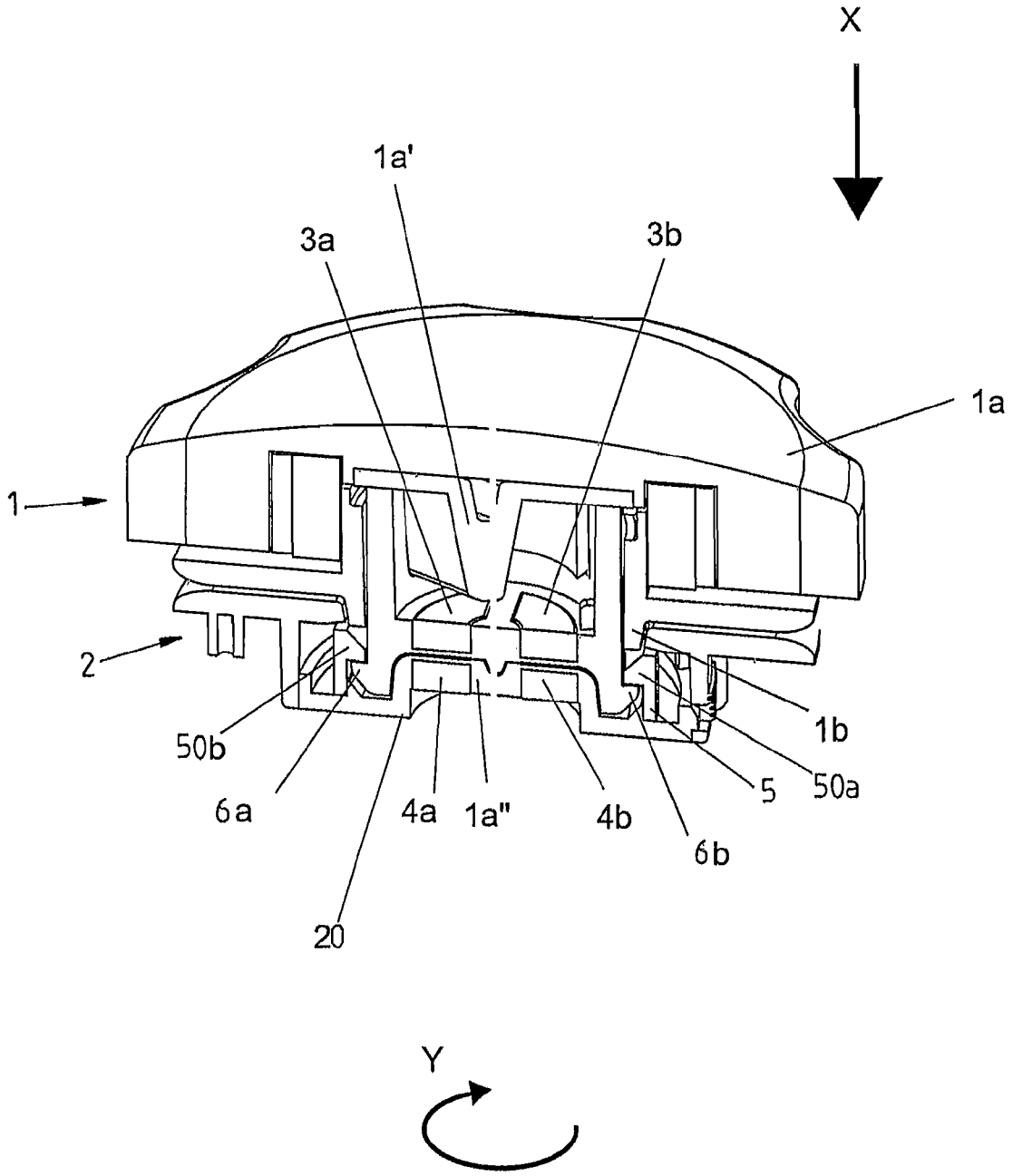
Figure 4E:
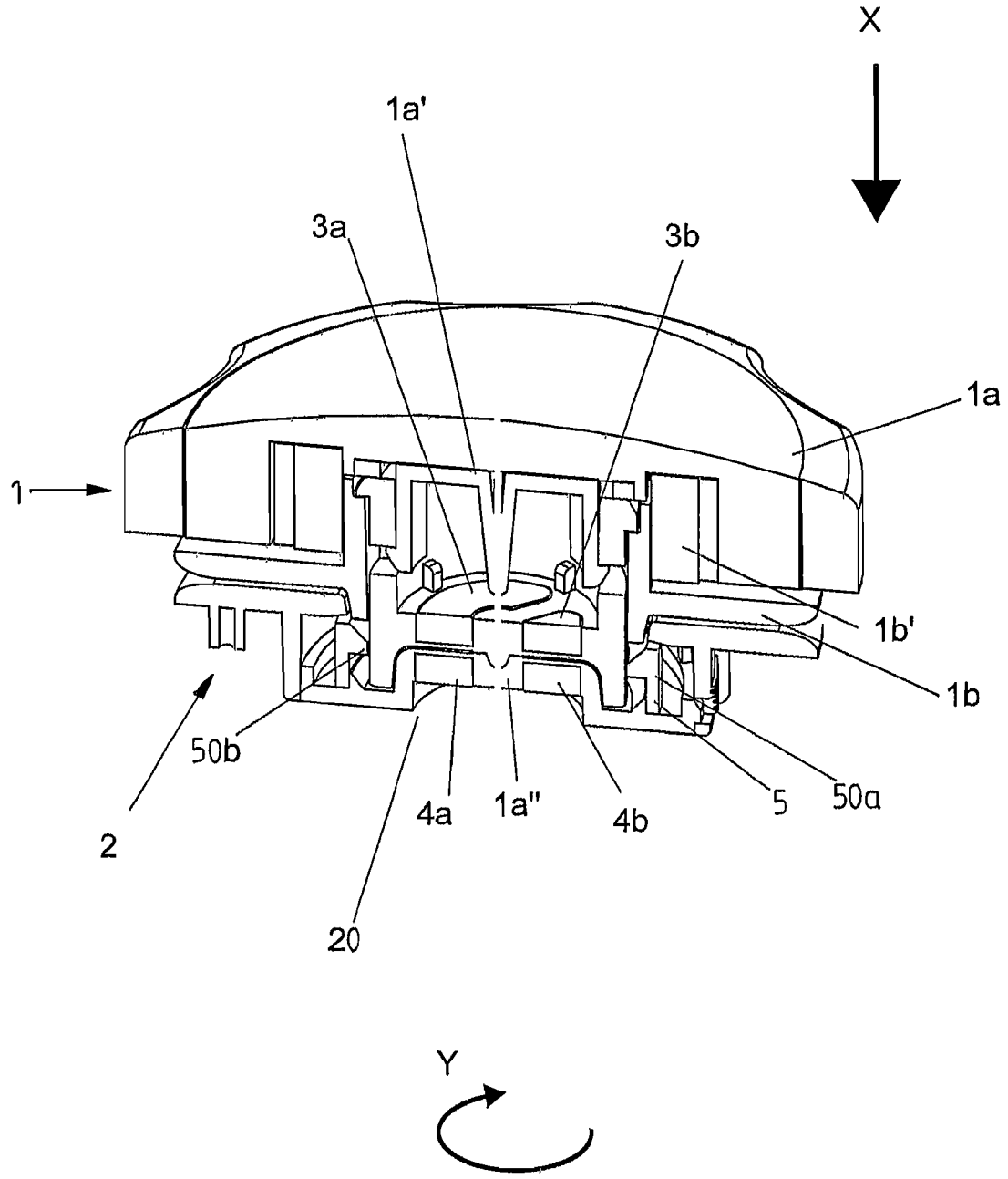
Figure 4F:
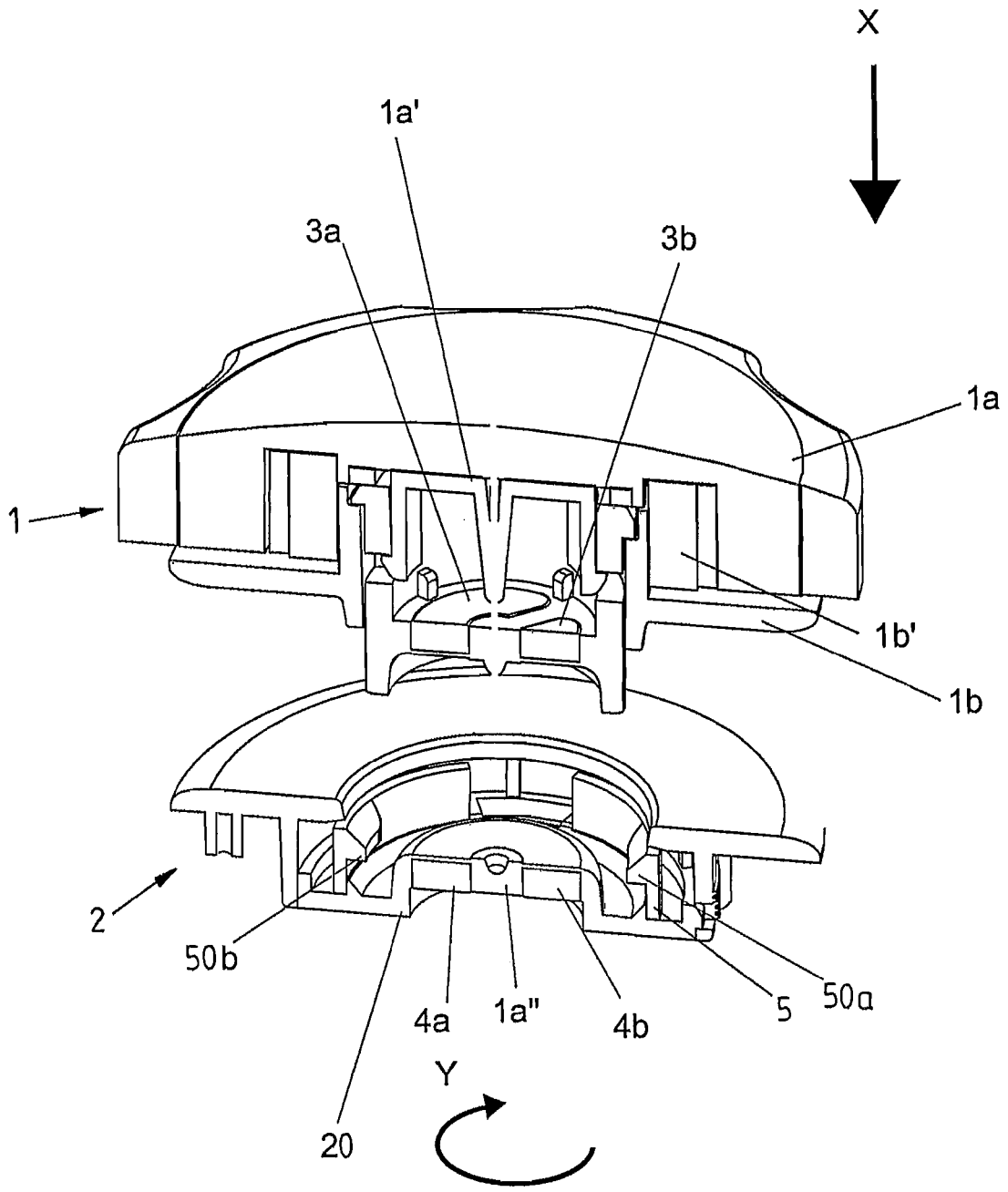
Figure 4G:
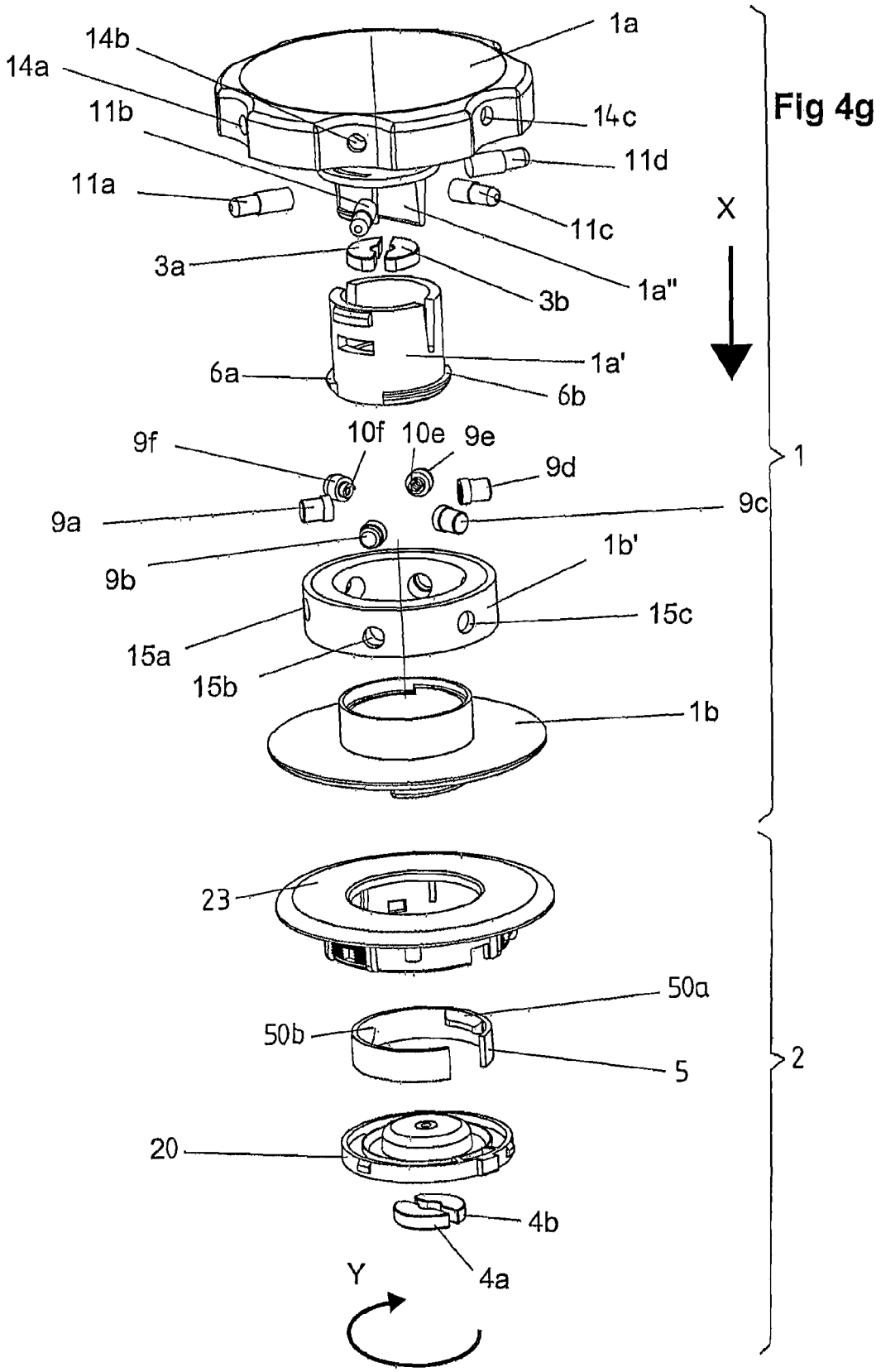
FIG. 4*g* shows a perspective exploded view of the lock device according to FIGS. 4*a*-4*f;*

A further exemplary embodiment of a lock device, illustrated in various partial sectional views in FIGS. 4*a* to 4*f* and in an exploded view in FIG. 4*g*, is designed as a rotation lock, in which a first connecting module 1 is in a closing position mechanically catch-lockingly engaged with a second connecting module 2 and can be detached from the second connecting module 2 by turning a module part 1*a* in the form of a rotary knob.

The lock device has four magnets 3*a*, 3*b*, 4*a*, 4*b*, of which the magnets 3*a*, 3*b* are arranged on a rotation core 1*a*', fixedly connected to the module part 1*a*, and the magnets 4*a*, 4*b* are arranged on a base plate 20 of the second connecting module 2. The magnets 3*a*, 4*a* and 3*b*, 4*b* attract each other in pairs, wherein by turning the magnets relative to each other—analogously to as this is specified for example in WO 2008/006357 A2—the magnetic attracting force can be weakened and be reversed into a magnetic repulsion.

As can be seen in the exploded view according to FIG. 4*g*, the first connecting module 1 is made of a rotary functional module, consisting of the module part 1*a* in the form of the rotary knob and the rotation core 1*a*', and a fixed functional module, made of a module part 1*b* and a ring-shaped thrust bearing 1*b*', arranged torque-proof on said module part 1*b*.

The second connecting module 2 has a fixed module part 23, on which a spring lock element 5 in the form of a spreading ring, in sections open towards the side, and a base plate with the magnets 4*a*, 4*b* are arranged torque-proof.

The spring lock element 5 has locking catches 50*a*, 50*b*, which in a closing position engage positive-lockingly with blocking pieces 6*a*, 6*b* of the kind of locking catches on the rotation core 1*a*' and catch-lockingly connect the first connecting module 1 to the second connecting module 2 in a positive-locking manner.

The magnets 3*a*, 3*b* and 4*a*, 4*b* are polarized in pairs in such a way that upon attaching the first connecting module 1 onto the second connecting module 2 to close the lock device in the closing direction X unlike poles mutually attract each other and cause a turning of the rotation core 1*a*' together with the module part 1*a* into a position, in which the blocking pieces 6*a*, 6*b* of the rotation core 1*a*' can enter into engagement with the locking catches 50*a*, 50*b* of the spring lock element 5. For this purpose, on the one hand the magnets 3*a*, 3*b* have unlike poles (N and S) on their side facing the second connecting module 2 and on the other hand the magnets 4*a*, 4*b* also have unlike poles (S and N) on their side facing the first connecting module 1, so that in a turning position a torque and at the same time a magnetic attracting force into the due closing position is created.

FIG. 4*a* and FIG. 4*d* show the lock device in its closing position, wherein in FIG. 4*d* the spring catch locking, established via the spring lock element 5 and the blocking pieces 6*a*, 6*b* by positive-locking encompassing, is visible. The magnets 3*a*, 3*b* of the rotation core 1*a*' and the magnets 4*a*, 4*b* of the second connecting module 2 here lie frontally with unlike poles and thereby attracting opposite to each other.

On the first connecting module 1*a* locking device is provided having actuating bolts 11*a*-11*f*, arranged on the module part 1*a* and guided in recesses 14*a*-14*f*, which stand in operative connection with locking elements 9*a*-9*f*, mounted elastically on the thrust bearing 1*b*' via return springs 10*a*-10*f*, wherein the locking elements 9*a*-9*f* in a locking position engage lockingly with the recesses 14*a*-14*f* and can be unlocked by actuation via the actuating bolts 11*a*-11*f*.

Yet again, the locking device can realize a combination lock, in which predetermined actuating bolts 11*a*-11*f* have to be actuated for unlocking, analogous to as this has been specified above.

Analogous to as it is specified above, the locking elements 9*a*-9*f* and also the actuating bolts 11*a*-11*f* have, depending on the predetermining, one of two different lengths:

Either the locking element 9*a*-9*f* is not actuated in the locking position, i.e. it is so long that in the non-actuated state it blocks the module part 1*a* (and thereby also the rotation core 1*a*') and is upon actuation pushed by the actuating bolt 11*a*-11*f* in the unlocking position. This is the case in the present exemplary embodiment e.g. in the locking element 9*c*.

Or the locking element 9*a*-9*f* lies non-actuated in the unlocking position, i.e. it is so short that in the non-actuated state it gives free the module part 1*a*. Upon actuation, however, the locking element 9*a*-9*f* engages with the thrust bearing 1*b*' and locks the module part 1*a*. This is the case in the present exemplary embodiment e.g. in the locking element 9*a*.

FIG. 4*b* shows the lock device in the unlocked state after pushing the predetermined actuating bolts 11*a*-11*f*, which unlock the locking elements 9*a*-9*f* in such a way that the module part 1*a* can be turned in the opening direction Y. The combination of the actuating bolts 11*a*-11*f* and locking elements 9*a*-9*f* is here determined in advance upon installation, wherein essentially also embodiments of the locking device, to be actuated by a key or a numerical code, are conceivable, which can, where applicable, also be subsequently programmable, i.e. can be set to a key or a code.

FIG. 4*c* shows the lock device after a partial turning of the first module parts 1*a* and thereby also of the rotation core 1*a*' in the opening direction Y. The catch locking engagement in this position is still engaged, and the magnets 3*a*, 3*b*, 4*a*, 4*b* still stand attracting opposite to each other.

In the position illustrated in FIG. 4*e*, after turning the module part 1*a* in the opening direction Y, the magnets 3*a*, 3*b*, 4*a*, 4*b* are turned relative to each other in such a way that they stand opposite to each other at least in sections with like poles (i.e. the magnet 3*a* stands in sections opposite to the magnet 4*b* and the magnet 3*b* to the magnet 4*a*), so that the force of the magnets 3*a*, 3*b*, 4*a*, 4*b*, attracting in the closing position, reverses into a force of repulsion. At the same time, the blocking pieces 6*a*, 6*b* of the rotation core 1*a*' have come out of engagement with the locking catches 50*a*, 50*b* of the spring lock element 5, so that the rotation core 1*a*' can be taken out from the second connecting module 2 and thereby the first connecting module 1 altogether—magnetically supported by the repulsive force of the magnets 3*a*, 3*b*, 4*a*, 4*b* turned relative to each other—can be detached from the second connecting module 2 in a simple and haptically pleasant manner.

FIG. 4*f* shows the lock device in the opened state. To close the lock device again, the first connecting module 1 can yet again be attached onto the second connecting module 2, wherein the rotation core 1*a*' is turned by the attracting force of the magnets 3*a*, 3*b*, 4*a*, 4*b* into its position required for the catch locking engagement, and the catch locking engagement is, moreover, established automatically or almost automatically by the magnetic attracting force acting between the magnets 3*a*, 3*b*, 4*a*, 4*b*.

Figure 5A:
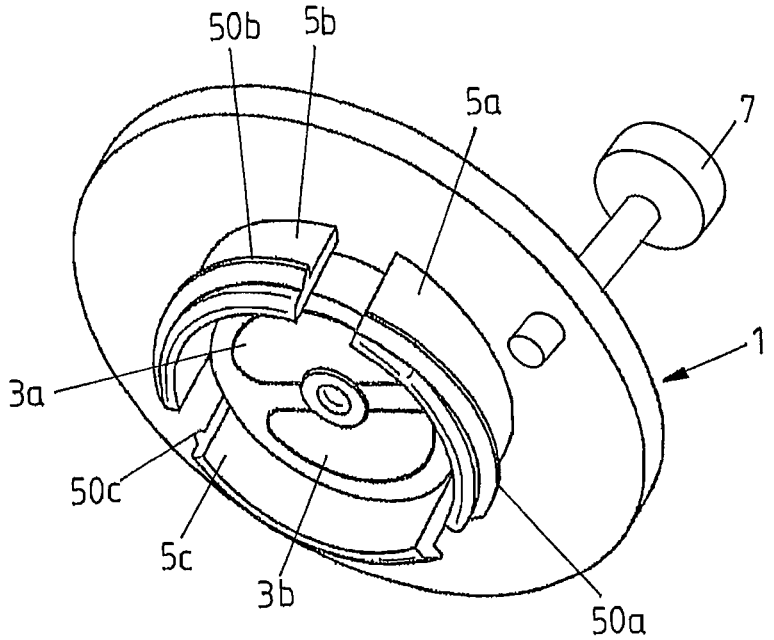
FIGS. 5*a*, 5*b* show views of a fifth embodiment of a lock device.
Figure 5A:
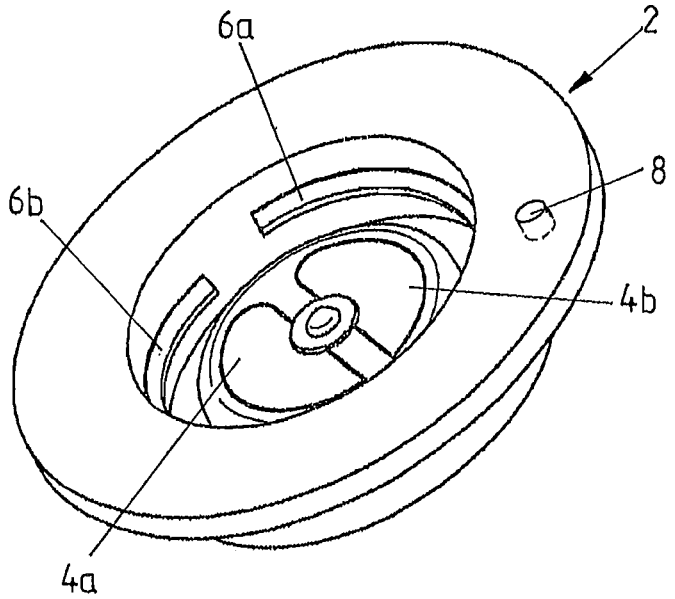
Figure 5B:
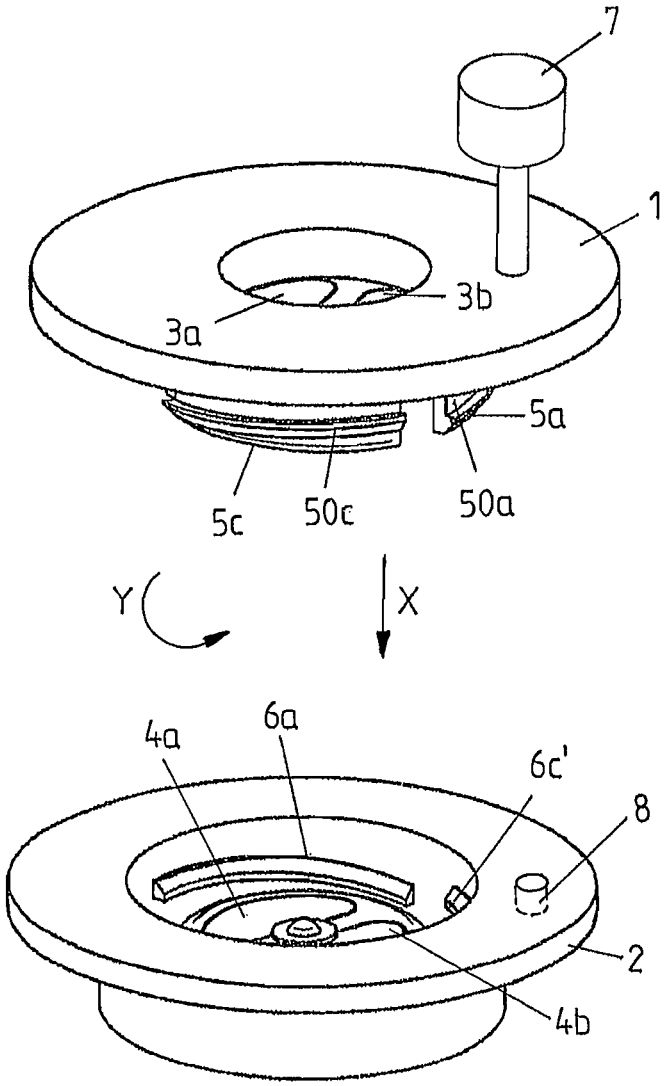

In a further exemplary embodiment of a lock device in the form of a rotation lock, illustrated in FIGS. 5*a* and 5*b*, the first connecting module 1 has three spring lock elements 5*a*, 5*b*, 5*c* having thread-shaped locking catches 50*a*, 50*b*, 50*c*, which in the closing position engage positive-lockingly with blocking pieces 6*a*, 6*b*, 6*c* in the form of locking catches on the second connecting module 2.

To establish the closing position the first connecting module 1 is attached onto the second connecting module 2 in the closing direction X, so that the spring lock elements 5*a*, 5*b*, 5*c* come into catch-locking engagement with the blocking pieces 6*a*, 6*b*, 6*c* of the second connecting module 2.

Two magnets 3*a*, 3*b* are arranged on the first connecting module 1 and two magnets 4*a*,4*b* are arranged on the second connecting module 2, which attract each other in pairs in such a way that—analogous to as it has been explained above with the help of the embodiment according to FIGS. 4*a* to 4*g*—the catch-locking connection of the connecting modules 1, 2 is automatically established in a magnetically supported manner, wherein the polarity of the magnets 3*a*, 3*b*, 4*a*, 4*b* at the same time also has the effect that the connecting modules 1, 2 are, upon establishing the connection, turned relative to each other into their due position for the catch-locking connection.

In the closing position the magnets 3*a*, 3*b*, 4*a*, 4*b* stand frontally attracting opposite to each other in pairs. To open the lock device the first connecting module 1 can be screwed in the opening direction Y relative to the second connecting module 2 in such a way that the thread-shaped locking catches 50*a*, 50*b*, 50*c* are screwed in the opening direction out of engagement with the likewise thread-shaped blocking pieces 6*a*, 6*b*, 6*c*. By the screwing movement the magnets 3*a*, 3*b*, 4*a*, 4*b* are also turned relative to each other, so that the magnetic attracting force, acting in the closing position, weakens and in the opened position is reversed into a repulsive force, so that taking out the first connecting module 1 from the second connecting module 2 can take place in a magnetically supported manner.

In the exemplary embodiment according to FIGS. 5*a*, 5*b* a locking device in the form of a bolt-shaped locking element 7, shiftably arranged on the first connecting module 1, is provided, which in the locked position lockingly engages with a recess 8 on the second connecting module 2 in such a way that turning the first connecting module 1 relative to the second connecting module 2 is not possible out of the closing position. The lock device is thereby secured in the closing position, wherein the locking element 7 can be pre-loaded relative to the first connecting module 1 (for example via a mechanical spring) in such a way that the locking element 7 upon closing the lock device comes automatically into its locking position. To open the lock device the locking element 7 has first to be actuated to then be able to turn the connecting modules 1, 2 against each other in the opening direction Y.

In a lock device illustrated in FIGS. 6*a* to 6*i*—analogous to the lock device illustrated in WO 2009/010049 A2—on blocking pieces 6*a*, 6*b* of a second connecting module 2, which in the closing position positive-lockingly engage with locking catches 50*a*, 50*b* of a spring lock element 5 on a first connecting module 1, force-deflecting run-up slopes 19*a*, 19*b* are provided, which upon a linear shifting of the first connecting module 1 in the opening direction Y push the locking catches 50*a*, 50*b*, elastic via spring legs 51*a*, 51*b*, out of engagement with recesses 19 of the blocking pieces 6*a*, 6*b*.

Figure 6A:
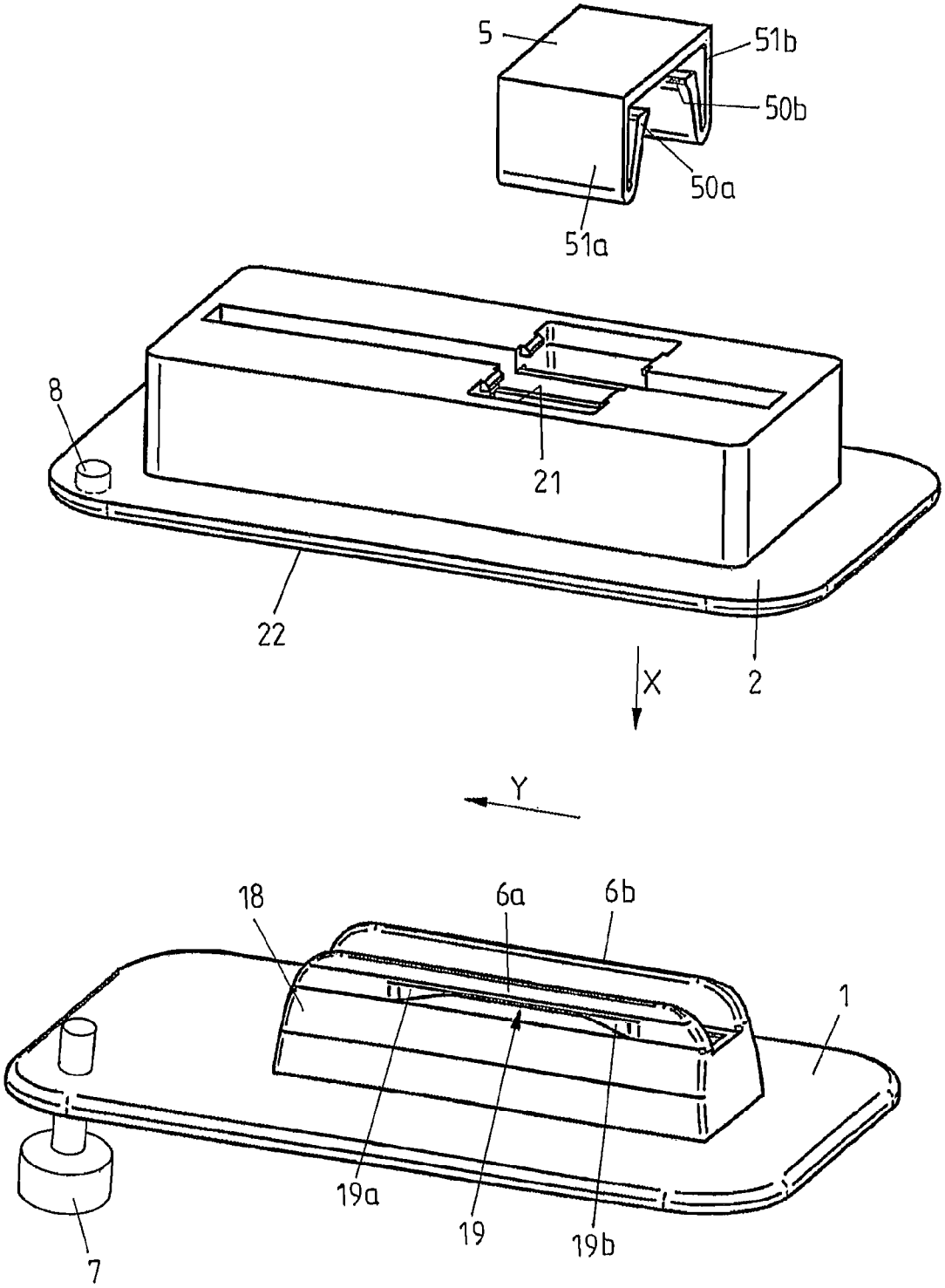
Figure 6F:
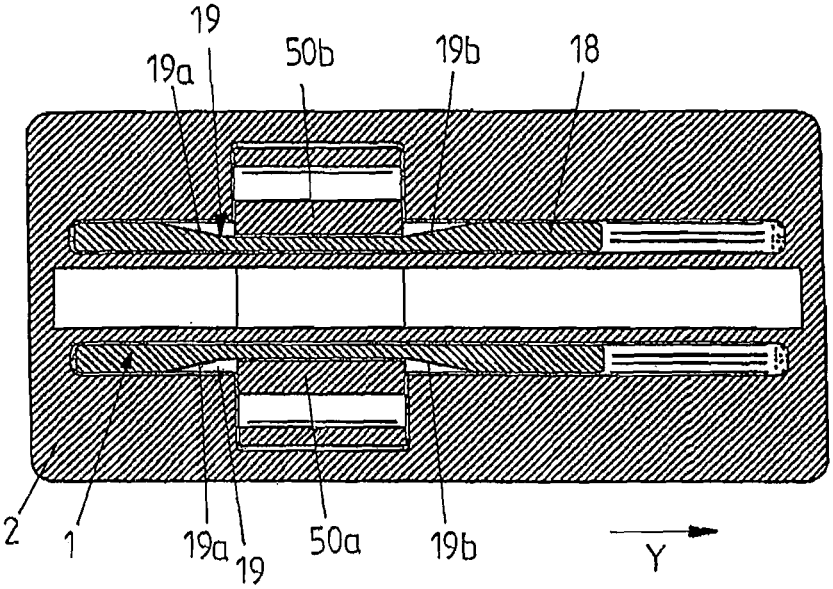

FIG. 6*a* shows the lock device in an exploded view. On the first connecting module 1*a* longitudinally extending, wedge-shaped plugging section 18 is formed, which for establishing the closing position is inserted into a plug housing 22 of the second connecting module 2, so that the blocking pieces 6*a*, 6*b* on the side of the plugging section 18 facing the second connecting module 2 come into engagement with the spring lock element 5, arranged on the plug housing 22, designed for example as sheet metal spring.

Two magnets 3*a*, 3*b*, 4*a*, 4*b* each are arranged on the connecting modules 1, 2, which in the closing position stand frontally attracting opposite to each other in pairs and are constructed in such a way that the catch-locking connection of the connecting modules 1, 2 is established largely automatically. The magnets 3*a*, 3*b*, 4*a*, 4*b* here at the same time also have the effect that the plugging section 18 of the first connecting module 1 and the plug housing 22 of the second connecting module 2 upon establishing the closing position are brought into their due position relative to each other, so that the locking catches 50*a*, 50*b* of the spring lock element 5 can come into positive-locking engagement with the blocking pieces 6*a*, 6*b*.

To release the connection the first connecting module 1 is shifted relative to the second connecting module 2 in the opening direction Y, so that the locking catches 50*a*, 50*b* run up onto the run-up slopes 19*a* and are thereby pushed out of engagement with the blocking pieces 6*a*, 6*b*, so that the first connecting module 1 can with its plugging section 18 be taken out of the plug housing 22 of the second connecting module 2.

FIGS. 6*b* and 6*c* show the lock device in the closing position and in a position shifted to open, FIGS. 6*d* and 6*e* show the lock device in cross section along the line A-A according to FIG. 6*b* or 6*c*, FIGS. 6*f* and 6*g* show the lock device in cross section along the line B-B according to FIG. 6*d* or 6*e*, and FIGS. 6*h* and 6*i* show the lock device in cross section along the line C-C.

Figure 6G:
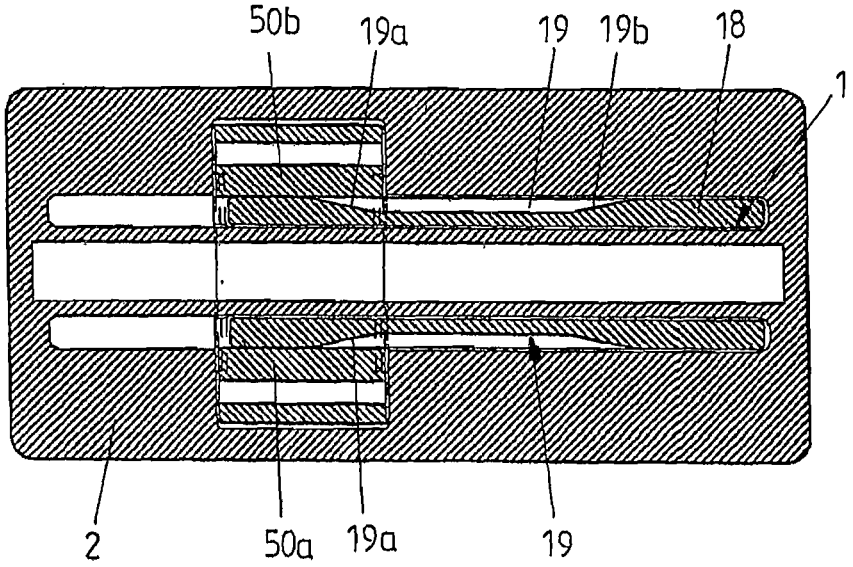
Figure 6H:
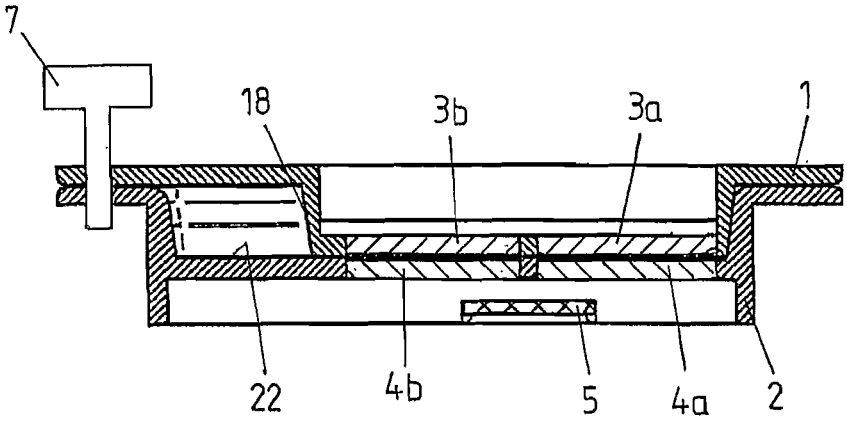

As is evident from the comparing views in the closing position (FIG. 6*b*, 6*d*, 6*f*, 6*h*), in the closing position the locking catches 50*a*, 50*b* are in positive-locking engagement with the blocking pieces 6*a*, 6*b*, and at the same time the magnets 3*a*, 3*b*, 4*a*, 4*b* lie frontally attracting opposite to each other in pairs (see FIG. 6*h*).

To open, the first connecting module 1 is shifted in the opening direction Y (FIGS. 6*c*, 6*e*, 6*g*, 6*i*), so that the locking catches 50*a*, 50*b* by running up onto the run-up slopes 19*a* are pushed out of the recess 19, located underneath the blocking pieces 6*a*, 6*b*, and the positive-locking engagement is terminated (see FIG. 6*g*). Thereby, at the same time also the magnets 3*a*, 3*b*, 4*a*, 4*b* are shifted relative to each other, so that in the position (FIG. 6*i*) shifted relative to each other, the magnets 3*a*, 4*b* with like poles stand repulsing opposite to each other and the magnetic attracting force acting in the closing position (FIG. 6*h*) is reversed into a force of repulsion, which magnetically supports taking away the first connecting module 1 from the second connecting module 2 by force action counter to the closing direction X. In this manner, the first connecting module 1 can readily be taken away from the second connecting module 2.

Figure 6I:
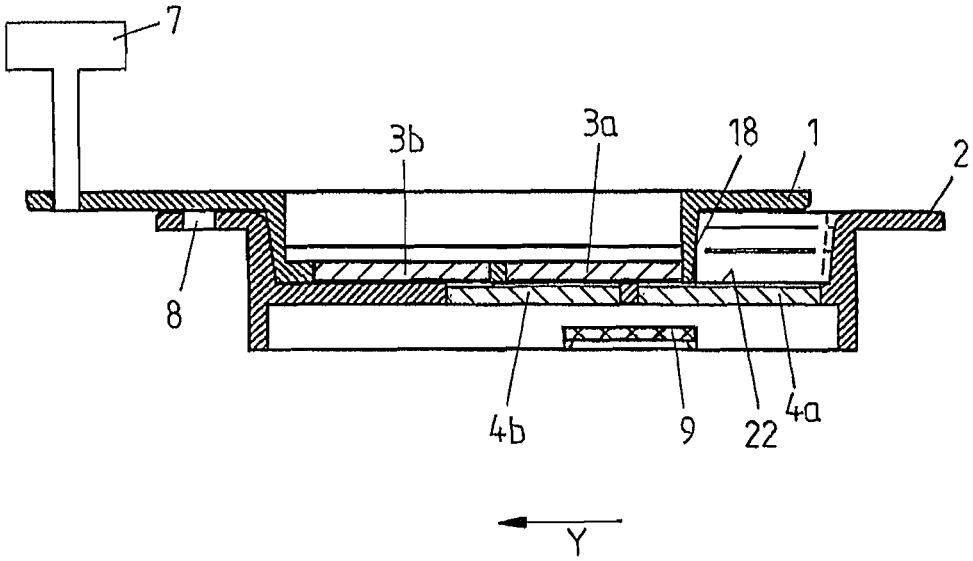

The shifting of the connecting modules 1, 2 out of the closing position is blocked by a locking device in the form of a locking element 7, which is movably arranged on the first connecting module 1, lockingly engages with a recess 8 on the second connecting module 2 in the locked position and is to be actuated to open the lock device by being pulled out of the recess 8 (see FIGS. 6*h* and 6*i*).

The lock device according to FIGS. 6*a* to 6*i* can for example be used for bags or satchels. The connecting modules 1 and 2 can for this purpose be fastened onto a bag, wherein the fastening can essentially take place in various manners, e.g. by sewing, adhesive bonding, riveting or screwing.

Figure 7A:
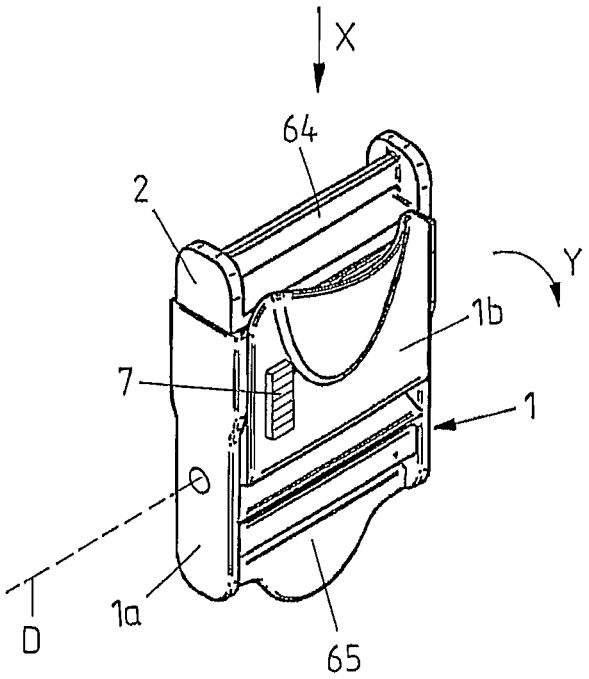
FIGS. 7*a*-7*g* show views of a seventh embodiment of a lock device.
Figure 7B:
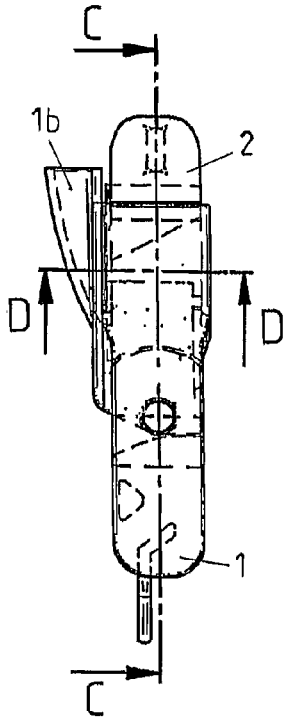
Figure 7C:
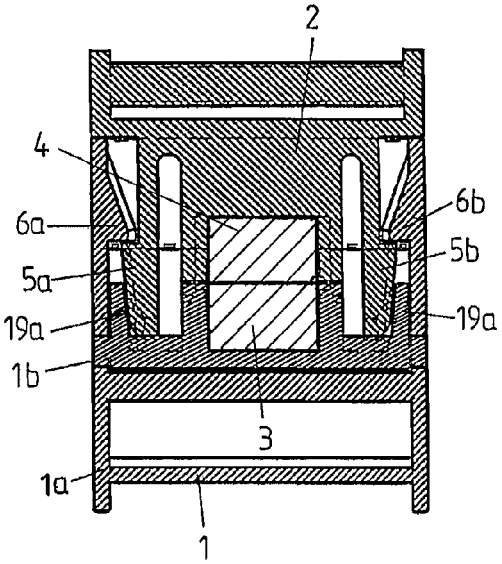
Figure 7D:
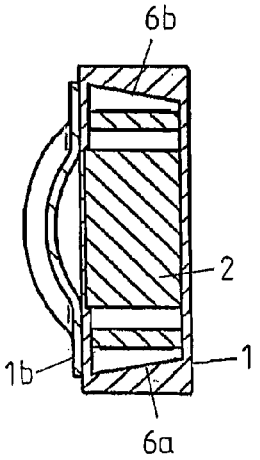
Figure 7E:
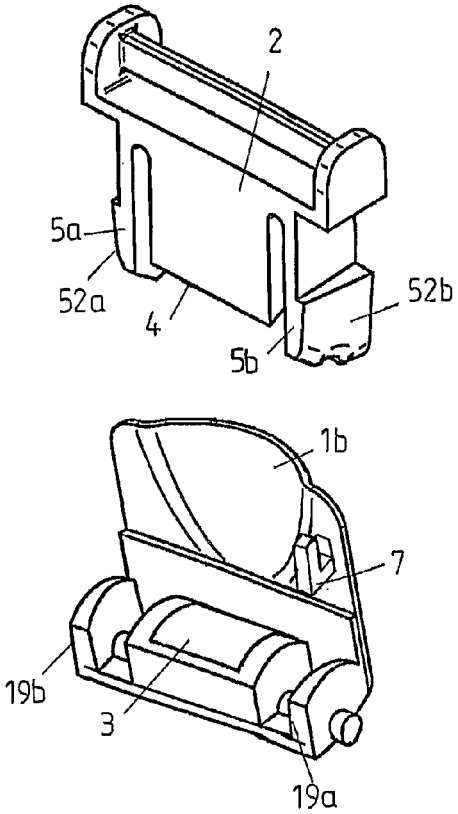
Figure 7G:
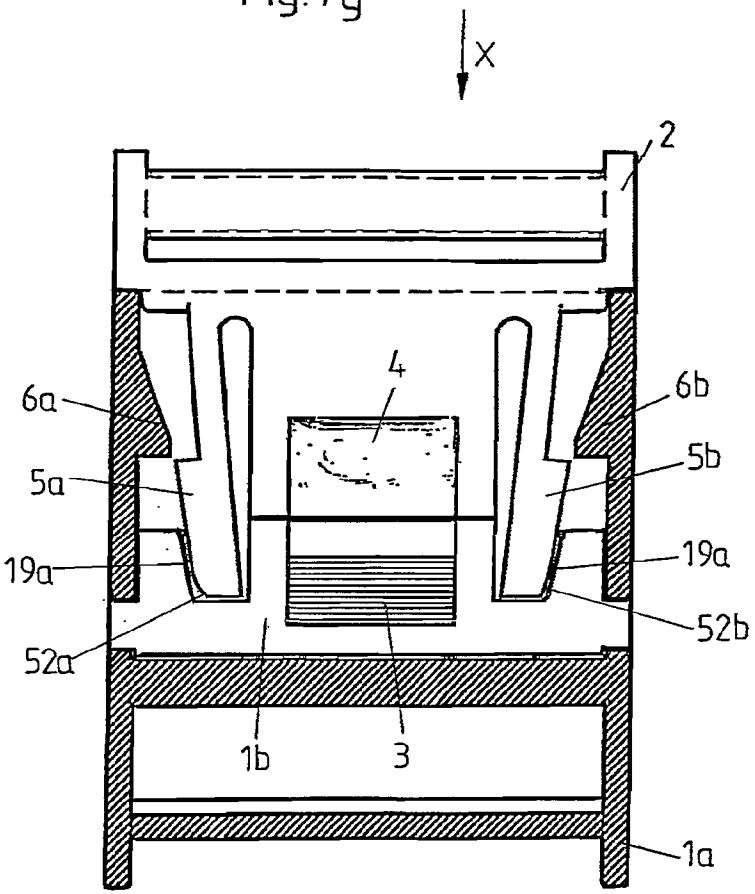
Figure 7F:
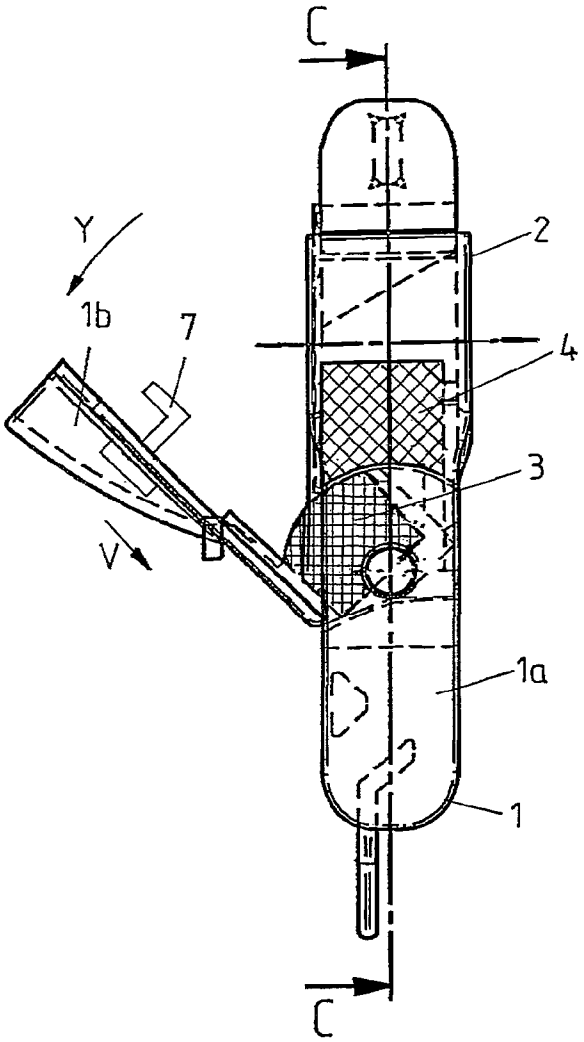

An exemplary embodiment of a lock device, illustrated in FIGS. 7*a* to 7*g*, is constructed as a clip buckle, in which a first connecting module 1 is designed as plug housing and a second connecting module 2 as plug, which each have a strap link 64, 65 (FIG. 7*a*) for fastening a strap. FIG. 7*a* shows the lock device in a perspective view in the closed state, FIG. 7*b* in a side view, FIG. 7*c* in a sectional view along the line C-C according to FIG. 7*b*, and FIG. 7*d* in a sectional view along the line D-D according to FIG. 7*b*. In FIG. 7*e* a module part 1*b* of the first connecting module 1, constructed as actuating element in the form of an actuating lever, and the second connecting module are illustrated in separate views. FIG. 7*f* shows the lock device in a side view in a partially cut-clear manner in a state actuated for opening, and FIG. 7*g* shows the lock device in a sectional view along the line C-C according to FIG. 7*f*.

The first connecting module 1 has a first module part 1*a* in the form of a casing and a second module part 1*b* in the form of an actuating lever, which is arranged pivotable on a swivel axis D on the first module part 1*a*. Blocking pieces 6*a*, 6*b* are provided on the first module part 1*a* (see FIG. 7*c*), which in the closing position (FIGS. 7*a*, 7*b*, 7*c*, 7*d*) engage positive-lockingly with spring lock elements 5*a*, 5*b* in the form of locking catches on the second connecting module 2 and thereby lock the first connecting module 1 with the second connecting module 2.

To open the lock device the second module part 1*b* in the form of the actuating lever of the first connecting module 1 can be pivoted, whereby the spring lock elements 5*a*, 5*b*, with run-up slopes 52*a*, 52*b* arranged upon them, run up onto run-up slopes 19*a*, 19*b* on the module part 1*b* and are thereby, as illustrated in FIG. 7*g*, pushed out of engagement with the blocking pieces 6*a*, 6*b*. The run-up slopes 19*a*, 19*b*, 52*a*, 52*b* of the spring lock elements 5*a*, 5*b* and of the module part 1*b* are bevelled in a corresponding manner, so that upon a pivoting movement of the module part 1*b* on the swivel axis D in the opening direction Y the run-up slopes 19*a*, 19*b*, 52*a*, 52*b* run up onto each other and push the elastic spring lock elements 5*a*, 5*b* out of engagement with the fixedly arranged blocking pieces 6*a*, 6*b*.

The run-up slopes 19*a*, 19*b*, 52*a*, 52*b*, moreover, act as ejection support in that they, in the actuated state (FIG. 7*g*), caused by their slopes create a force in the direction of ejection (counter to the closing direction X) and thereby mechanically support the release of the lock device.

On each the second module part 1*b* in the form of the actuating lever of the first connecting module 1 and on the second connecting module 2 a magnet 3, 4 is arranged respectively, which point towards each other with different poles and which hence attract each other to establish the closing position and in the closing position of the lock device. The magnets 3, 4 (one of which can also be constructed as a magnetic anchor) are here dimensioned in such a way that upon attaching the first connecting module 1 onto the second connecting module 2 the catch-locking connection of the spring lock elements 5*a*, 5*b* to the blocking pieces 6*a*, 6*b* is established in an automatic manner so that closing the lock device can take place simply and in a haptically pleasant manner.

Upon opening the lock device (FIG. 7*f*) also the magnets 3, 4 are pivoted relative to each other by actuating the module part 1*b*, so that the magnetic attracting force of the magnets 3, 4 is weakened and the first connecting module 1 can be detached from the second connecting module 2 without great effort.

Additionally, a locking device in the form of a hook-like locking element 7, arranged movably in a shifting direction V on the module part 1*b*, is provided, which in the locked state engages with the second connecting module 2 in such a way that the module part 1*b* cannot be pivoted on the swivel axis D relative to the second connecting module 2. Thereby, the lock device is locked and secured in its closing position and can only be opened when the locking element 7 has been moved in the shifting direction V out of its locking engagement.

Other locking devices are also conceivable here, which are to be actuated for example by a key or by entering a numerical code.

A lock device illustrated in FIGS. 8*a* to 8*f* is designed as a lock for strap ends on backpacks or bags or also for the holder of an ice pick or the like on a backpack. The lock device has two connecting modules 1, 2, the first connecting module 1 of which is configured with a module part 1*b*, like a casing, and a module part 1*a*, which can be rotated relative to the module part 1*b*, in the form of an actuating element.

The module part 1*a* has a rotation core 1*a*', on which a blocking piece 6 in the form of a ring-shaped locking catch is arranged on the end of the rotation core 1*a*' which is facing the second connecting module 2.

The blocking piece 6 in a closing position of the lock device engages positive-lockingly with locking catches 50*a*, 50*b* of a ring-shaped, elastic spring lock element 5, which is arranged torque-proof on a base plate 20 of the second connecting modules 2. The base plate 20 is connected to a module part 23, wherein the locking catches 50*a*, 50*b* of the spring lock element 5 reach through recesses 230 of the module part 23.

Figure 8A:
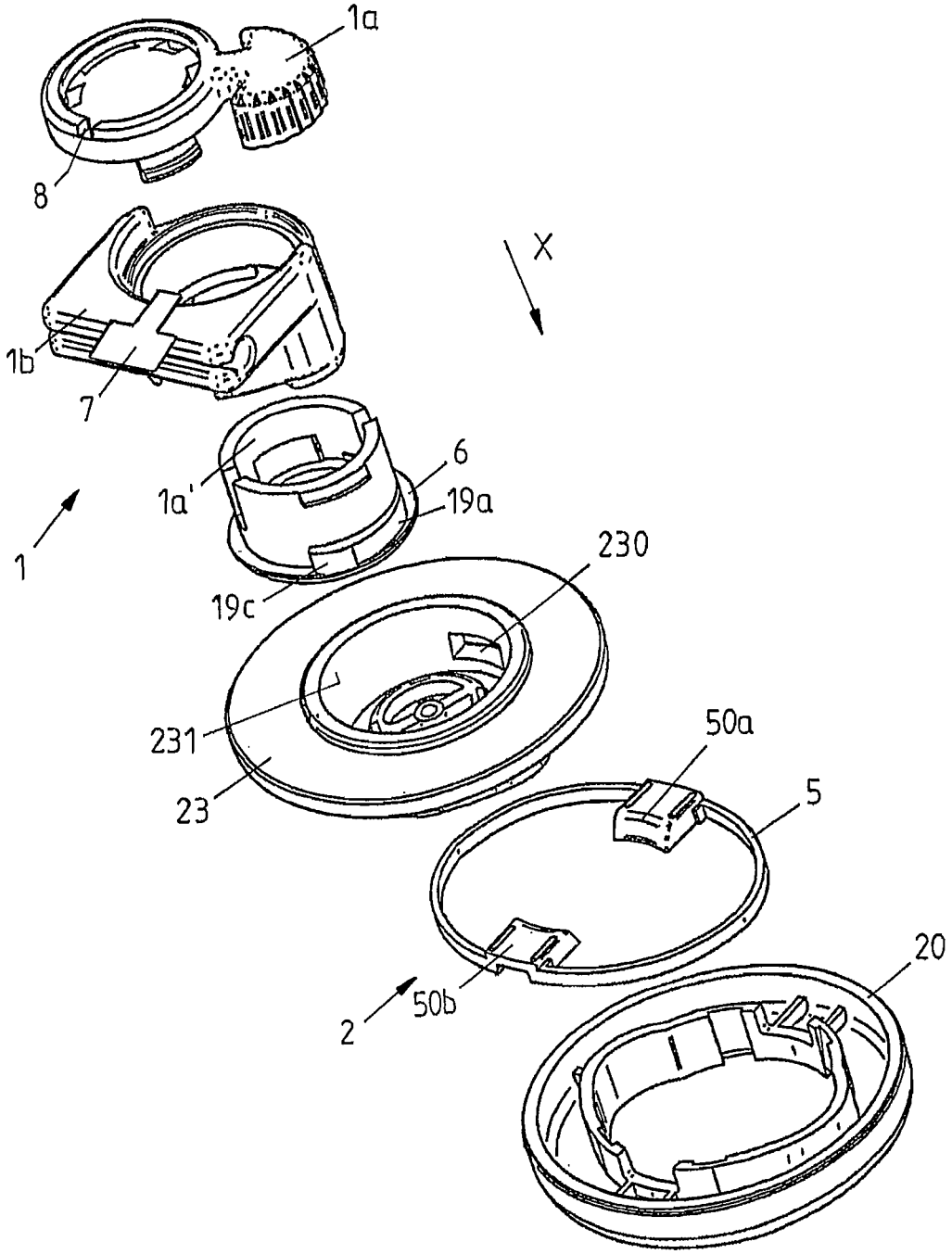
FIGS. 8*a*-8*f* show views of an eighth embodiment of a lock device.
Figure 8B:
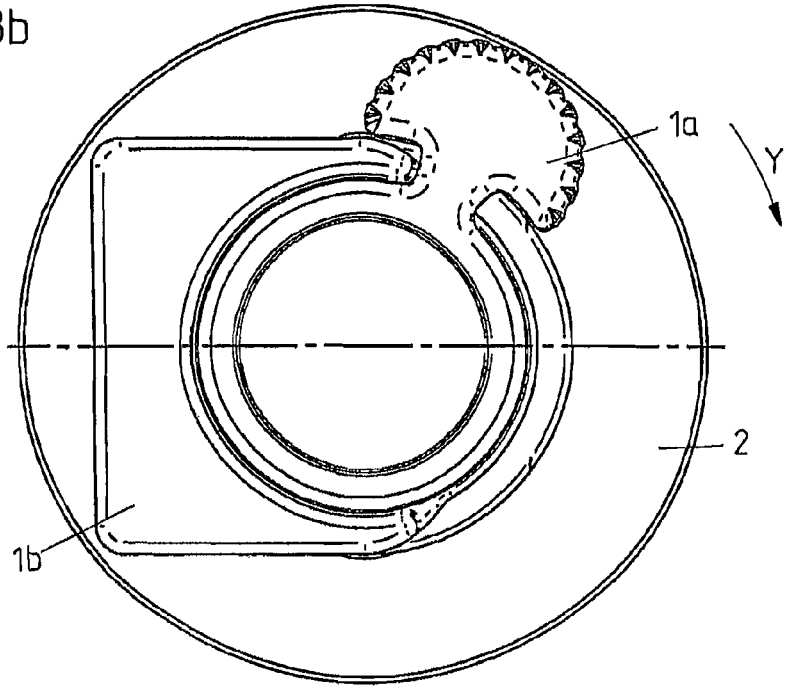
Figure 8C:
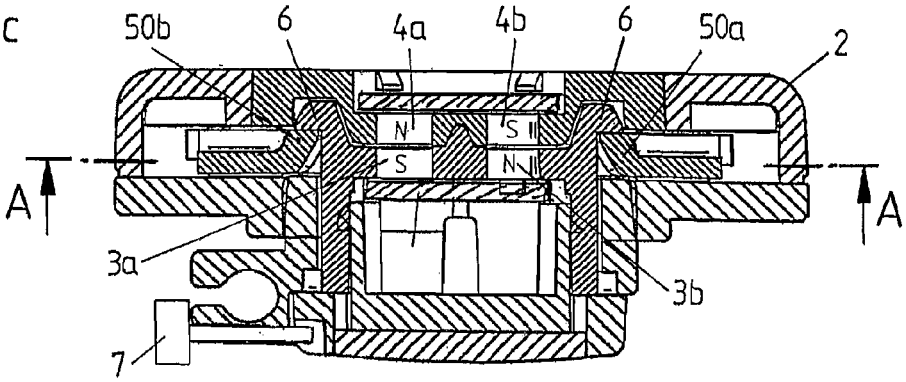
Figure 8D:
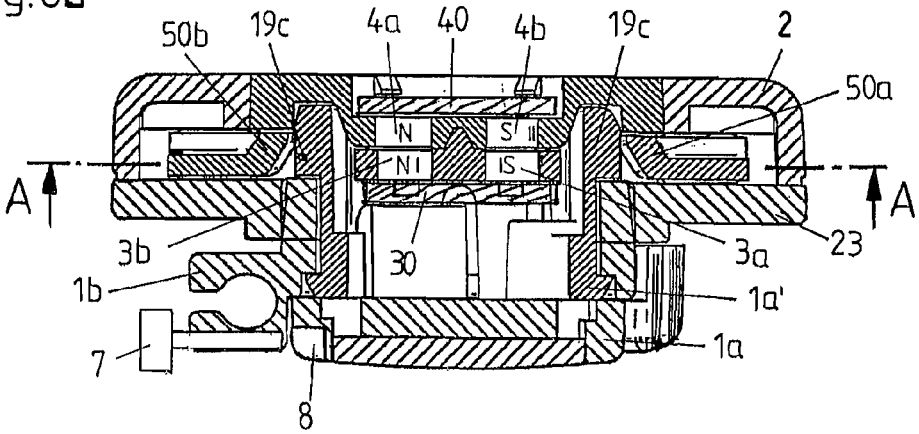
Figure 8E:
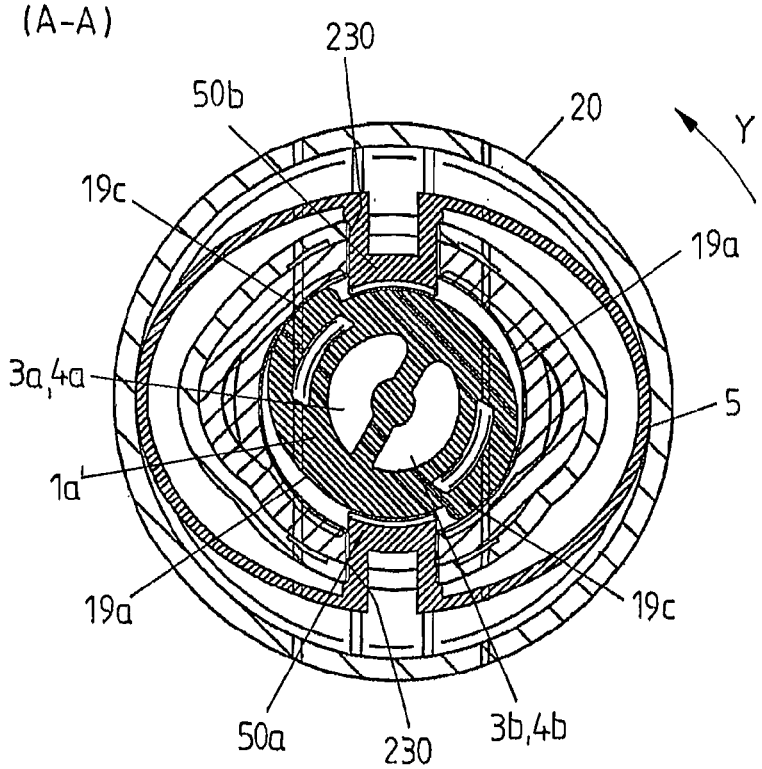
Figure 8F:
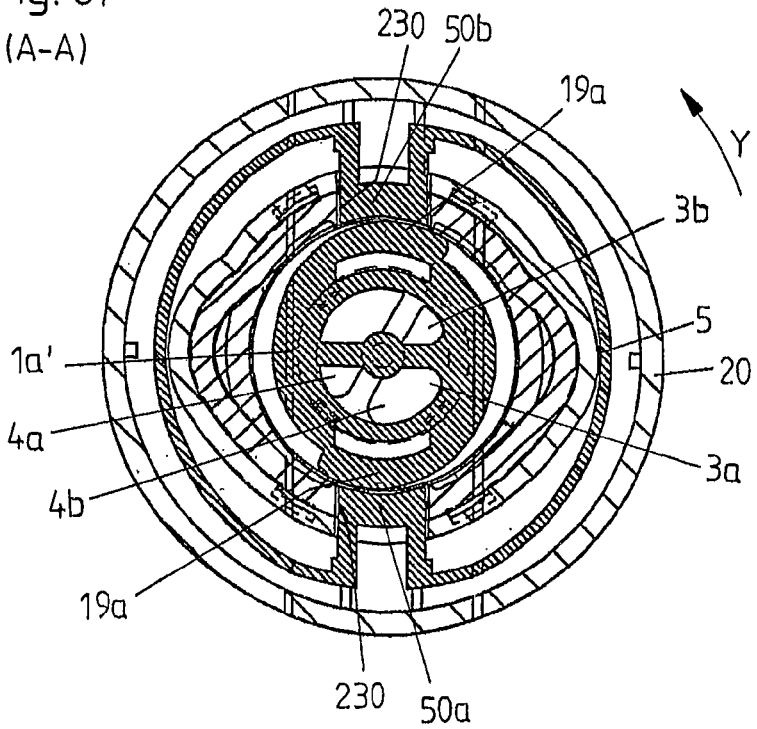

FIG. 8*a* shows the lock device in an exploded view and FIG. 8*b* in a top view. FIG. 8*c* and FIG. 8*d* show cross-sectional views, wherein the lock device in the illustration in FIG. 8*c* is positioned in the closing position and in FIG. 8*d* is shown in the actuated state. FIGS. 8*e* and 8*f* show sectional views along the line A-A according to FIG. 8*c* or 8*d*.

In the closing position (FIG. 8*c*, 8*e*) the rotation core 1*a*' of the first connecting module 1 engages with a cylindrical housing opening 231 of the module part 23 of the second connecting module 2 and engages positive-lockingly via the blocking pieces with the locking catches 50*a*, 50*b* of the spring lock element 5, so that the first connecting module 1 is held on the second connecting module 2.

Two magnets 3*a*, 3*b*, 4*a*, 4*b* each are arranged on the rotation core 1*a*' and on the module part 23 respectively, which magnetically attract each other to close the lock device and are here planned in such a way that they establish the catch-locking connection largely automatically (in other words, the magnets 3*a*, 3*b*, 4*a*, 4*b* are dimensioned in such a way that the magnetic attracting force exceeds the force required to establish the catch locking connection). The magnets 3*a*, 3*b*, 4*a*, 4*b* here also act restoringly in that they turn the rotation core 1*a*' by the effect of the magnetic attracting force into a position, in which the blocking piece 6 can lock with the locking catches 50*a*, 50*b*. For this purpose the magnets 3*a*, 3*b* have on their side facing the magnets 4*a*, 4*b* unlike poles, as vice versa also the magnets 4*a*, 4*b* have unlike poles, wherein the magnets 3*a*, 4*a* and 3*b*, 4*b* attract each other in pairs (see FIG. 8*c*).

To open the lock device the module part 1*a* in the form of the rotary actuating lever can be turned in the opening direction Y, whereby also the rotation core 1*a*' in the housing opening 231 of the module part 23 is turned. To bring the locking catches 50*a*, 50*b* out of engagement with the blocking piece 6, on the rotation core 1*a*' above the blocking piece 6 run-up slopes 19*a* and unlocking sections 19*c* are arranged, which are constructed in such a way that upon turning the rotation core 1*a*' out of the closing position (FIG. 8*e*) the locking catches 50*a*, 50*b* run up onto the run-up slopes 19*a* and after the turn by a predetermined angle in the opening direction Y come into the area of the unlocking sections 19*c*. By running up onto the run-up slopes 19*a* the locking catches 50*a*, 50*b* are pushed out of engagement with the blocking piece 6 so that the positive-locking engagement is terminated when the locking catches 50*a*, 50*b* are positioned in the area of the unlocking sections 19*c* (FIG. 8*f*).

By turning the rotation core 1*a*' at the same time also the magnets 3*a*, 3*b*, 4*a*, 4*b* are turned relative to each other, so that in the non-engaged position (FIGS. 8*d*, 8*f*) the magnets 3*a*, 4*b* and 3*b*, 4*a* stand opposite to each other with like poles at least predominantly and create a repulsive magnetic force, supporting the opening, so that the first connecting module 1 can in an easy and pleasant manner be taken away from the second connecting module 2.

The ring-shaped spring lock element 6 with its ring section is planned especially softly elastic and thereby offers especially soft haptics with, at the same time, a stable mechanical locking by transverse tension on the locking catches 50*a*, 50*b*. The locking catches 50*a*, 50*b* are each bevelled in such a way that they, to close the lock device, in the closing direction can come into catch-locking engagement with the blocking piece 6 in a positive-locking manner. A locking device is realized in the exemplary embodiment according to FIGS. 8*a* to 8*f* by a locking element 7 in the form of a bolt, movably arranged on the module part 1*a*, which in the locked position (FIG. 8*c*) engages with a recess 8 on the module part 1*a* of the first connecting module 1, so that the module part 1*a* cannot be turned relative to the second module part 1*b*. To open the lock device the locking element 7 has to be actuated, i.e. be pulled out of the recess 8 (FIG. 8*d*), so that turning the module part 1*a* becomes possible.

Figure 9A:
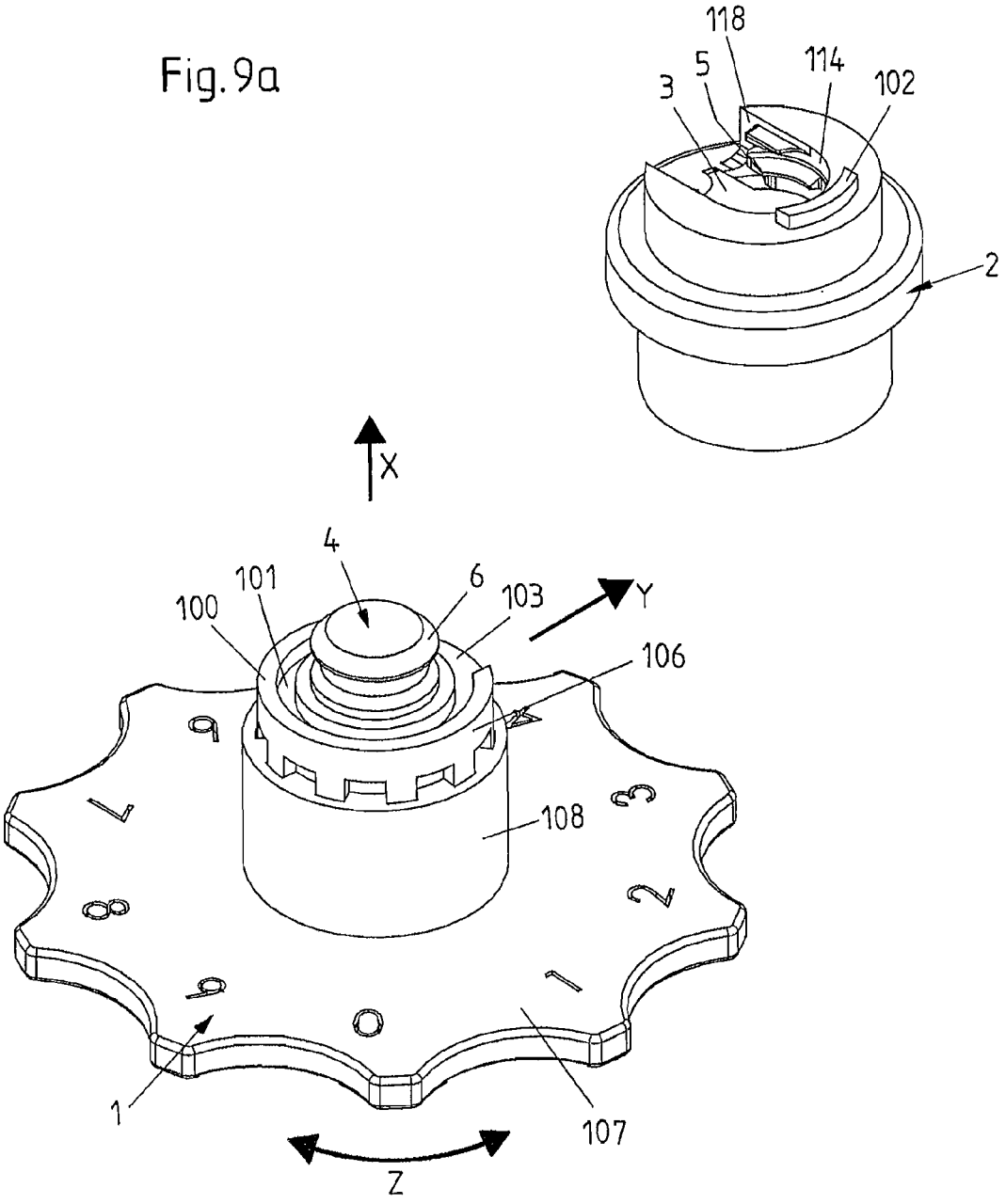
FIGS. 9*a*-9*n* show views of a further embodiment of a lock device.
Figure 9B:
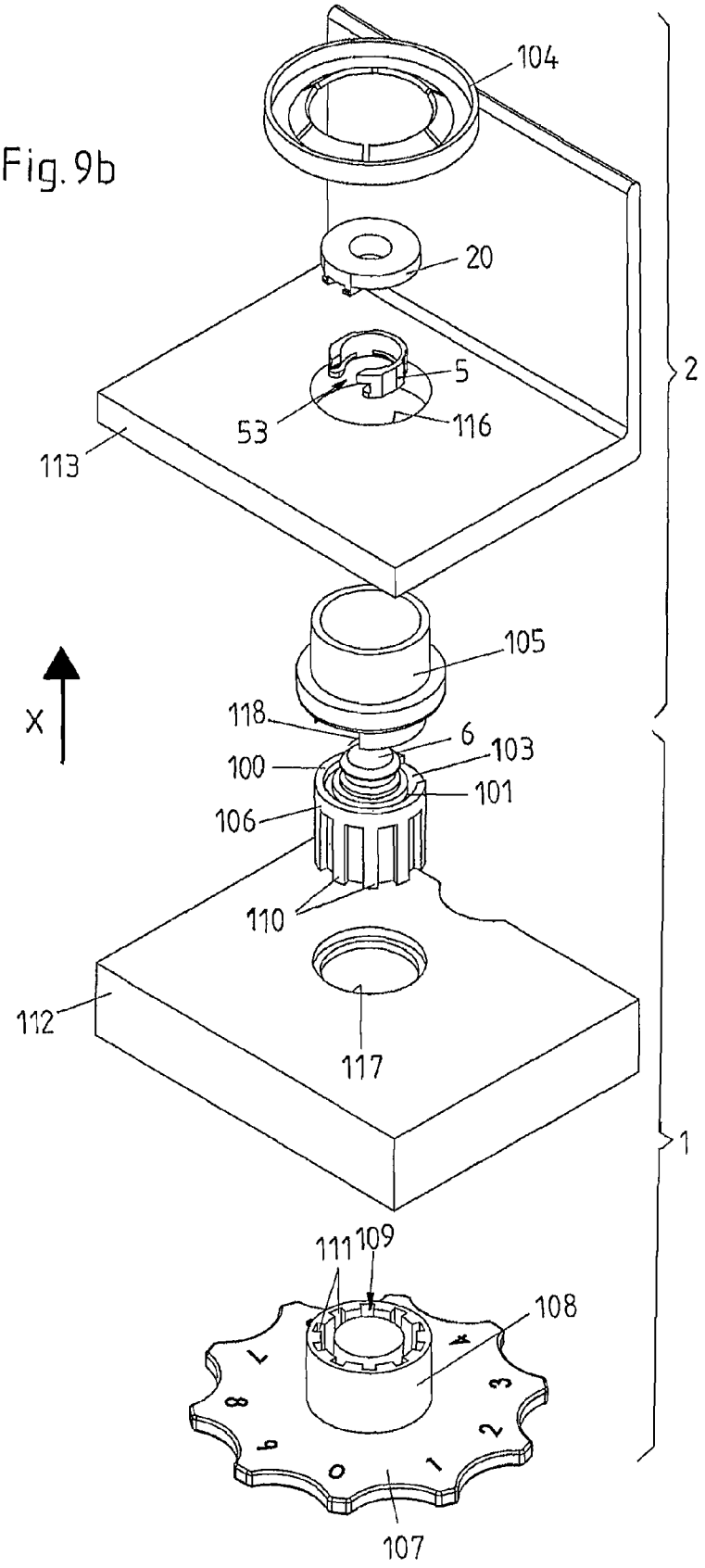
Figure 9C:
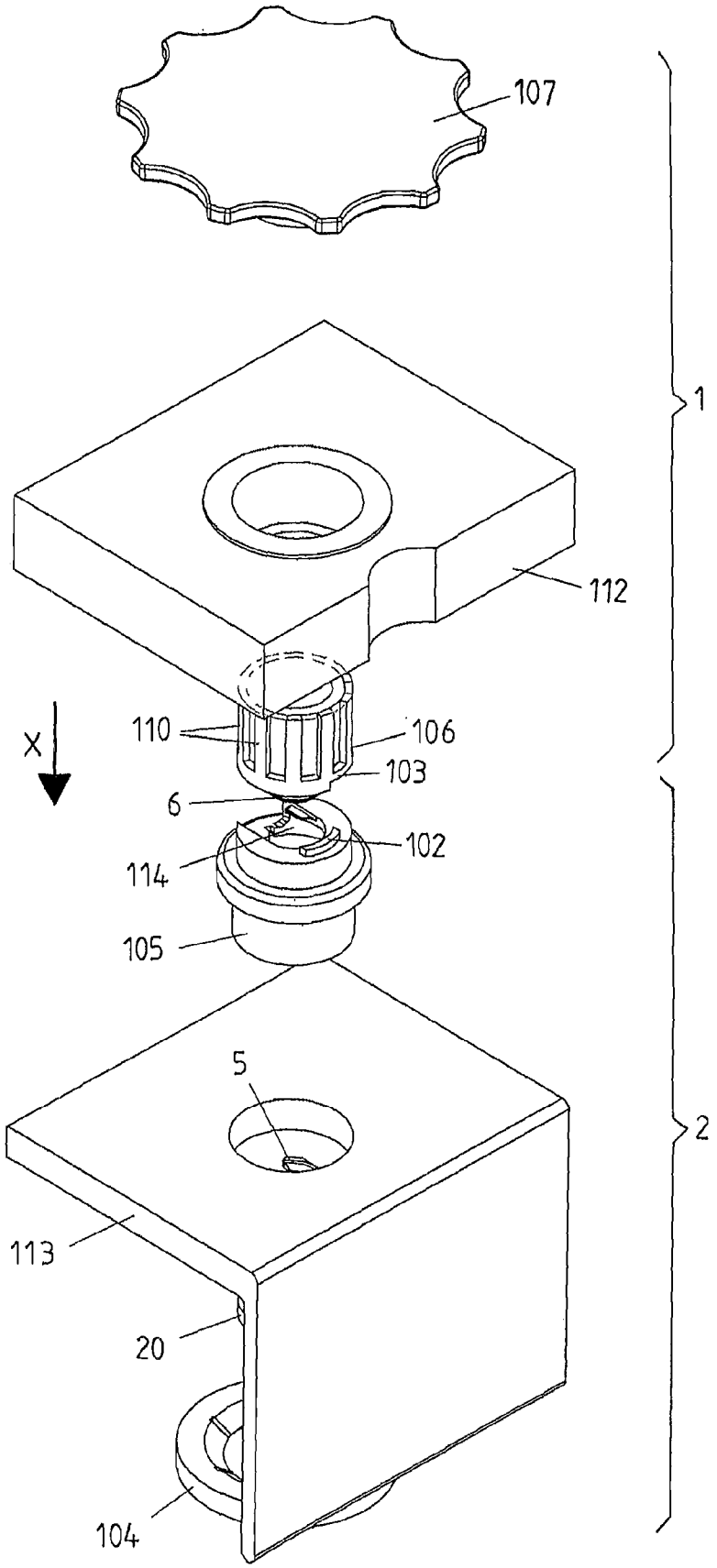
Figure 9D:
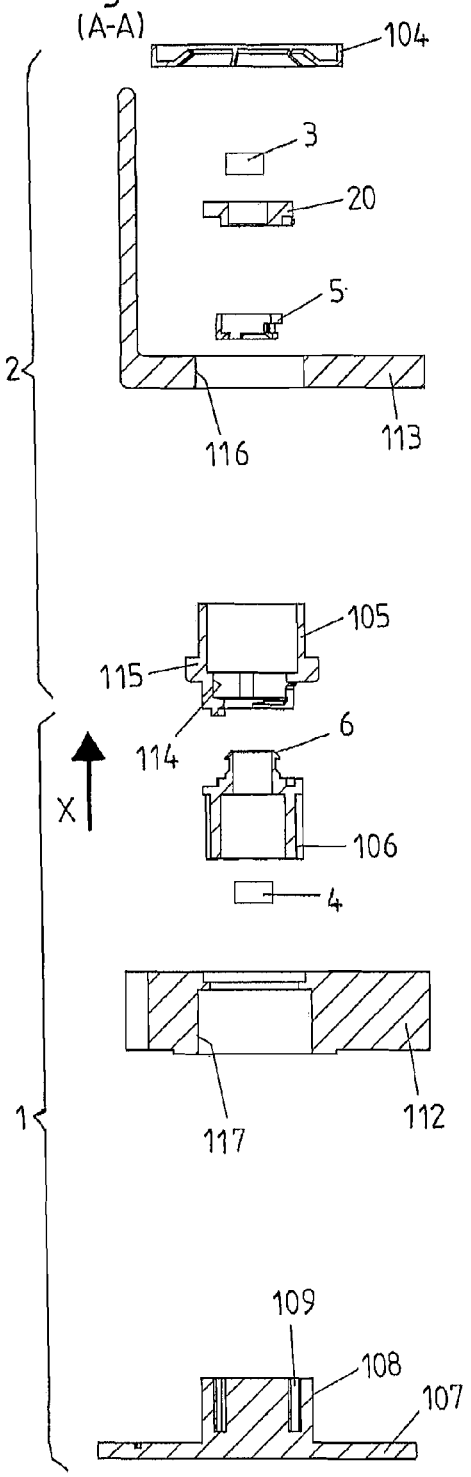
Figure 9E:
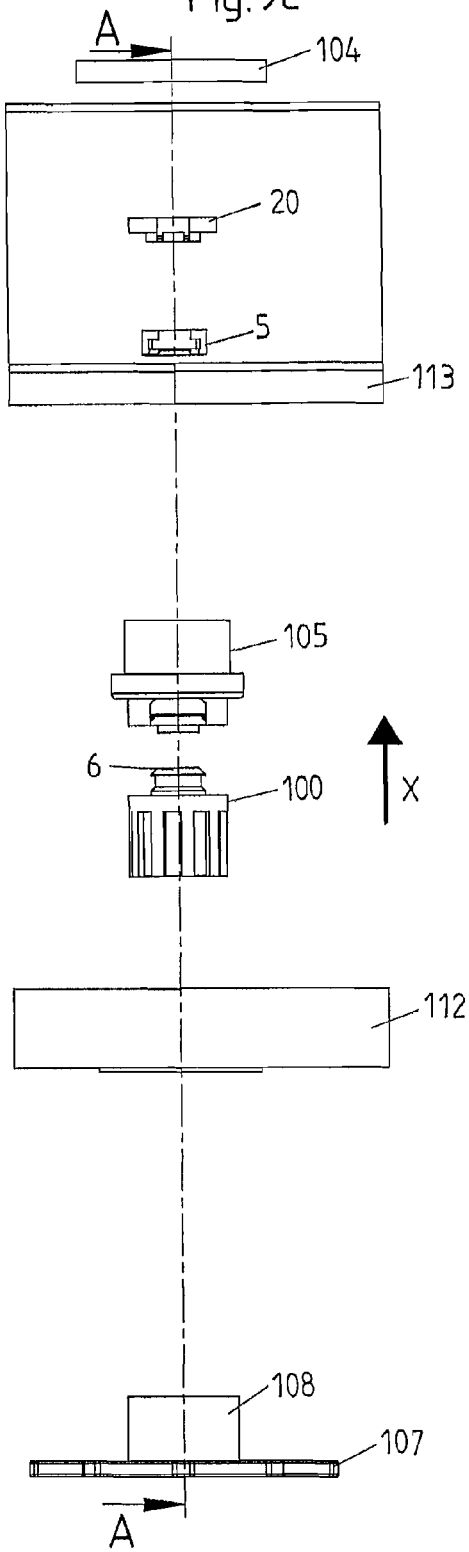
Figure 9F:
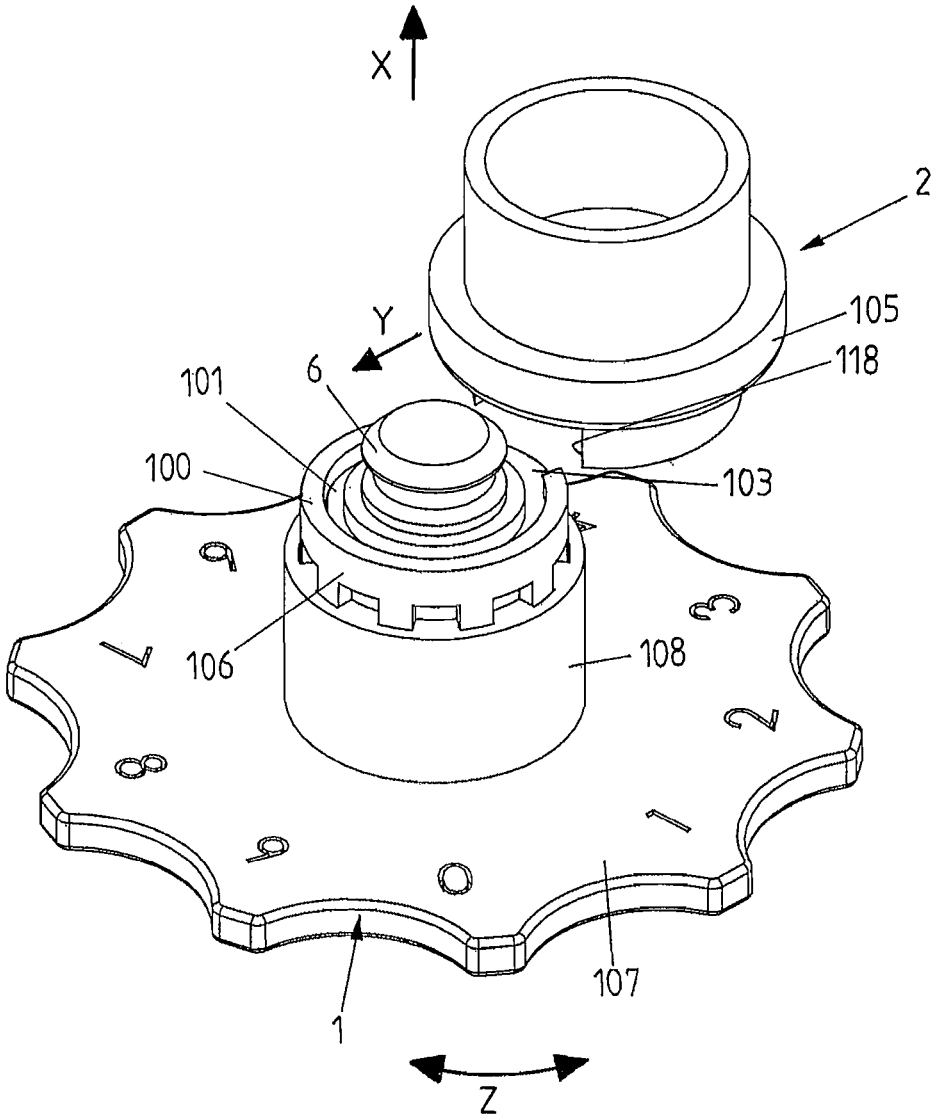
Figure 9G:
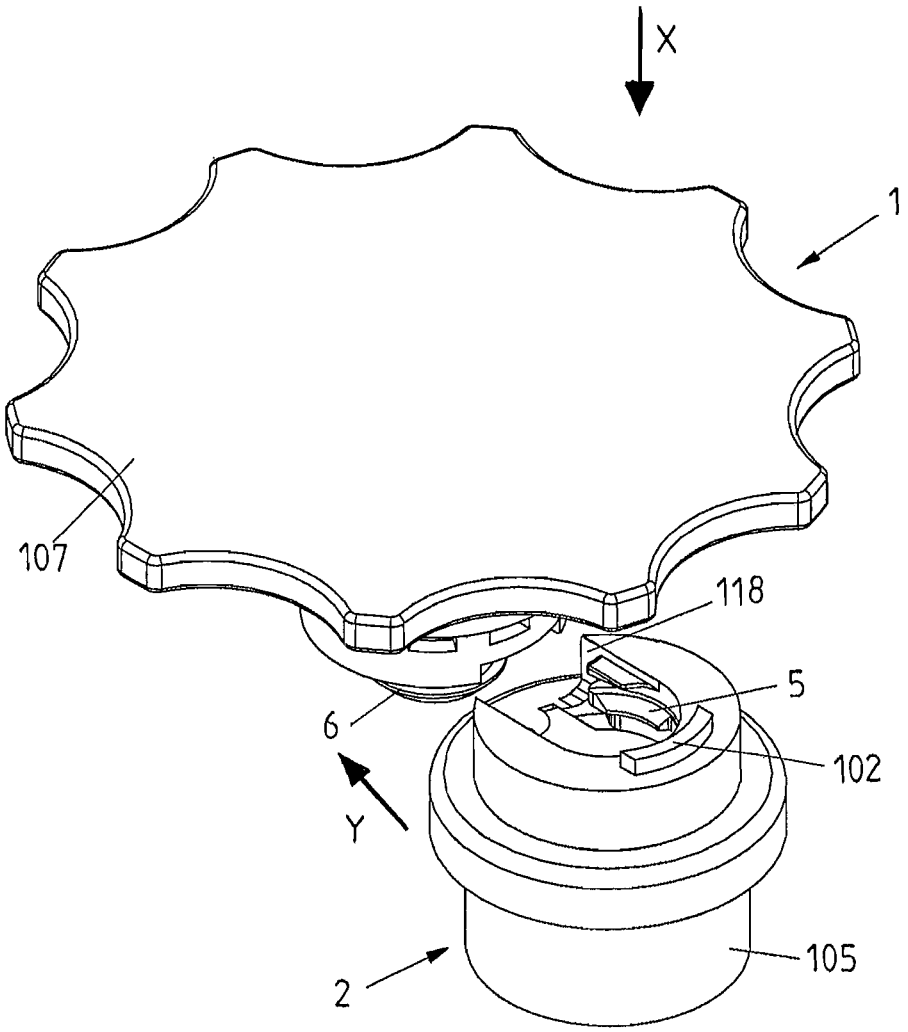
Figure 9H:
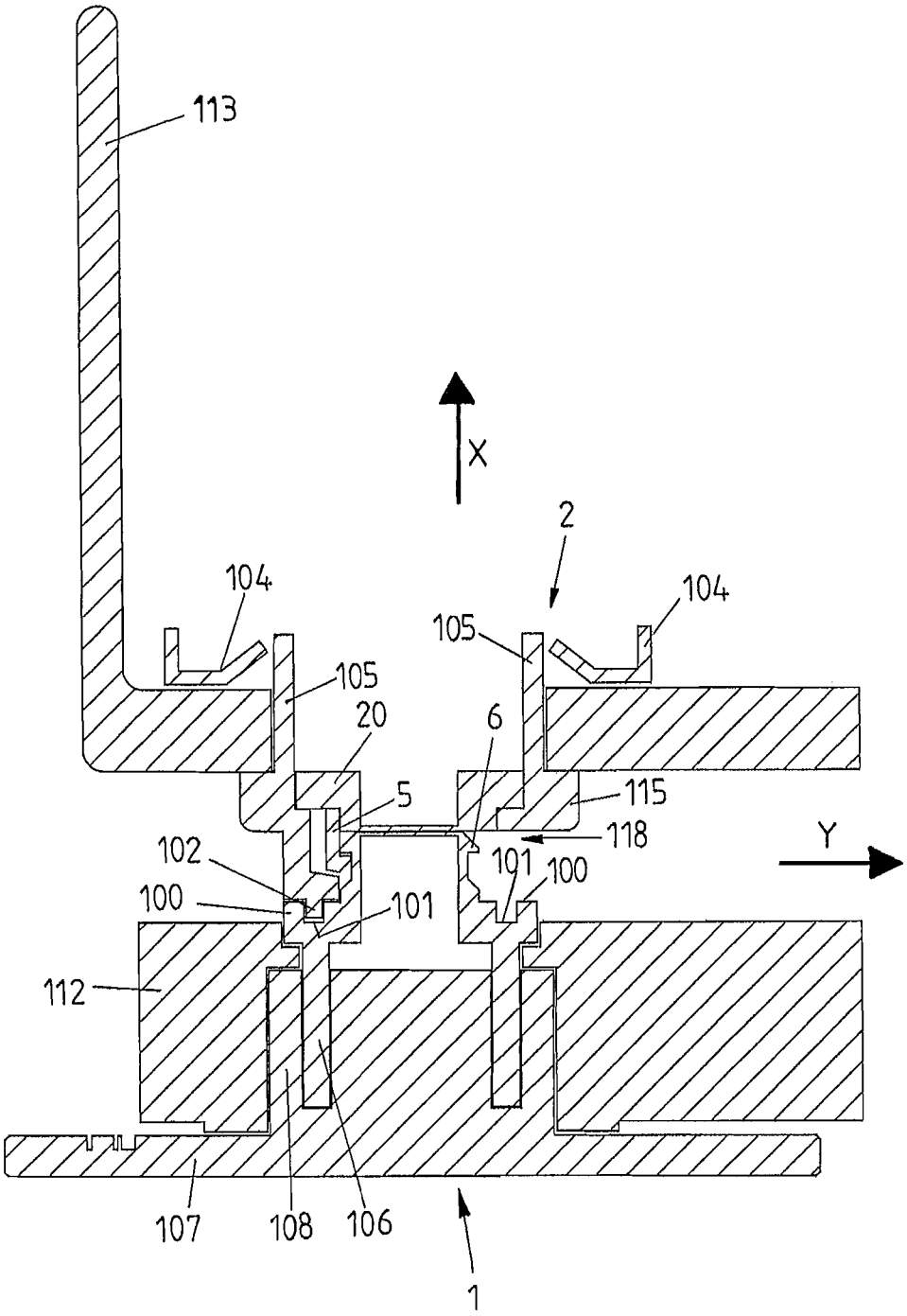
Figure 9I:
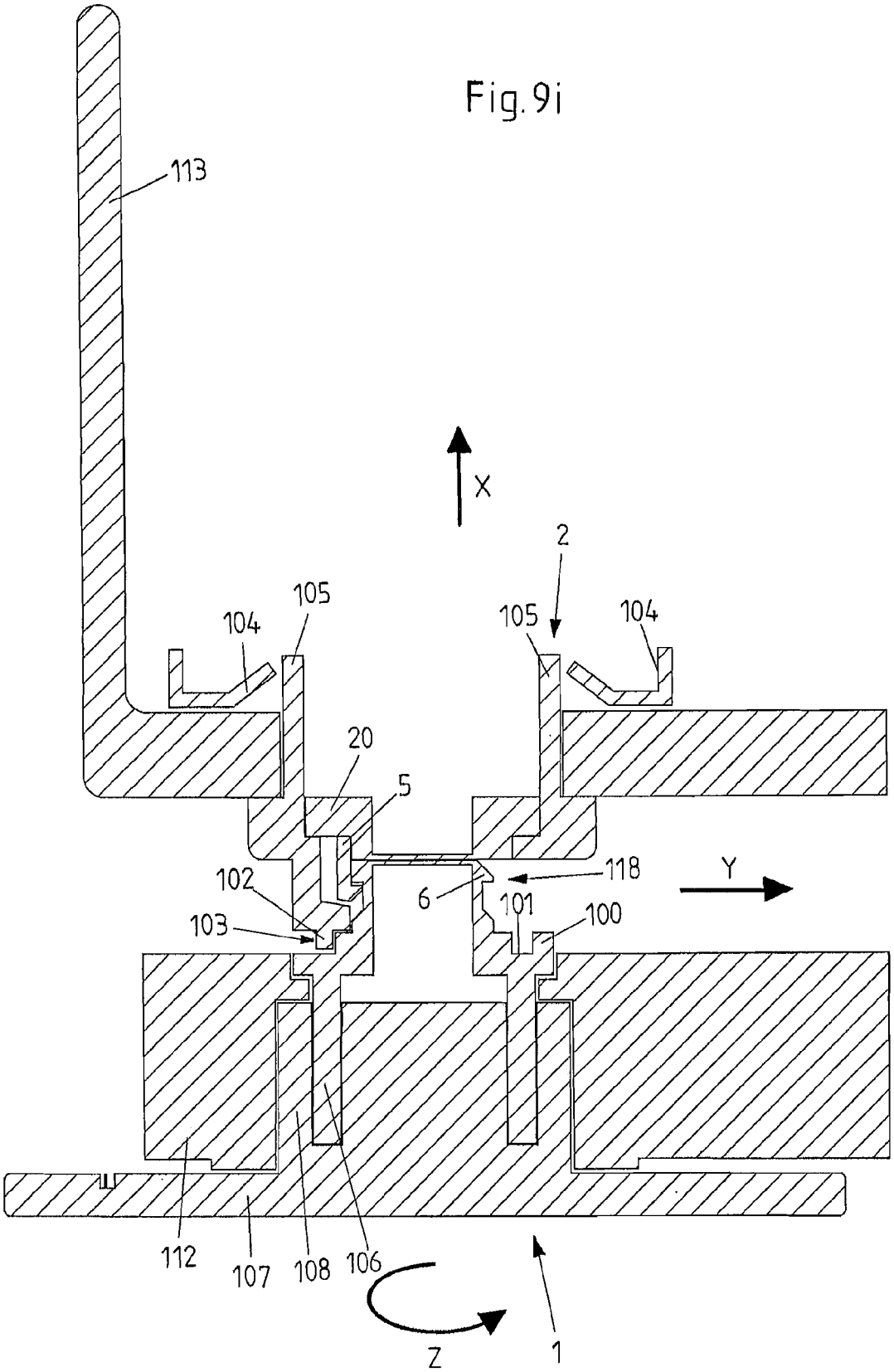
Figure 9J:
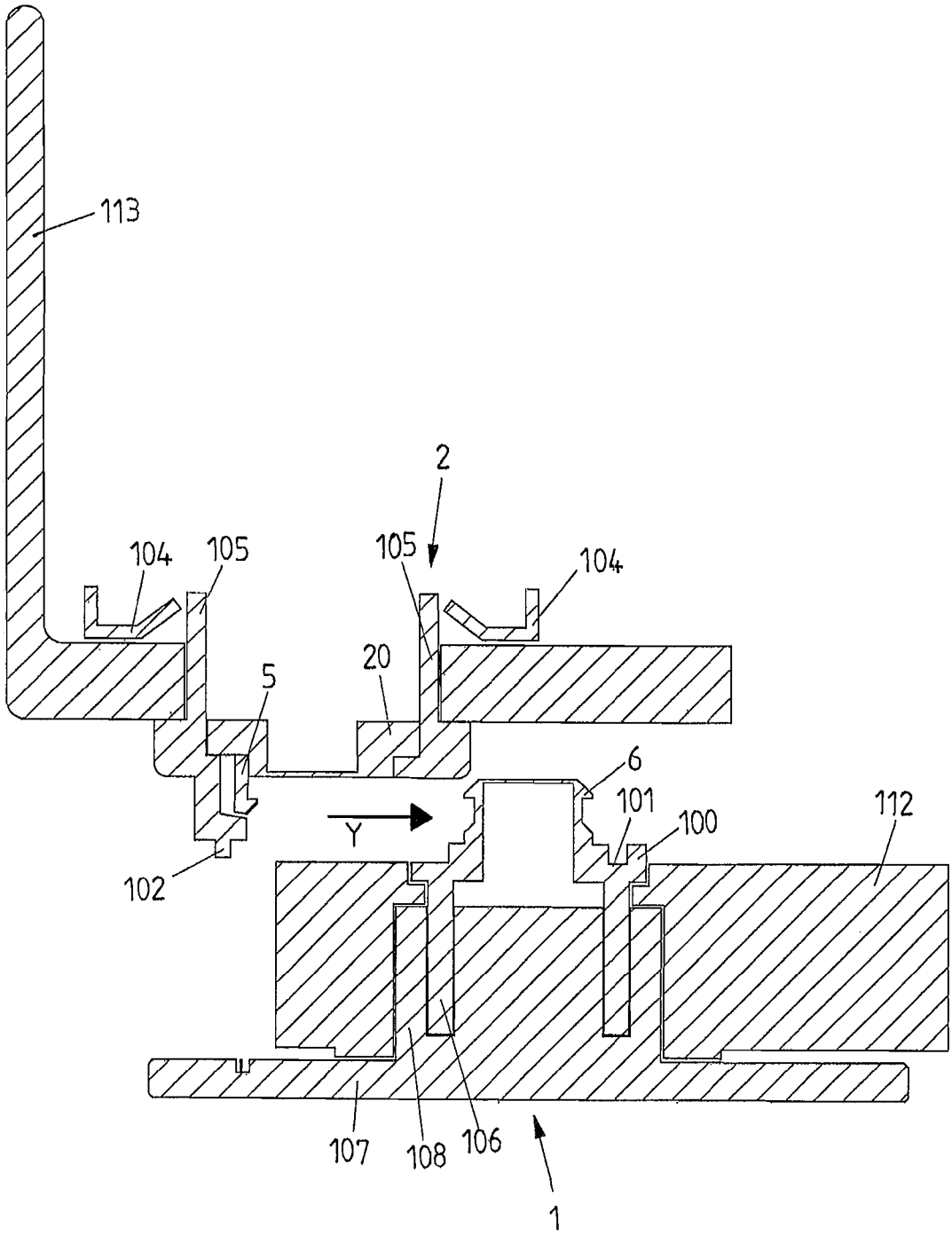
Figure 9K:
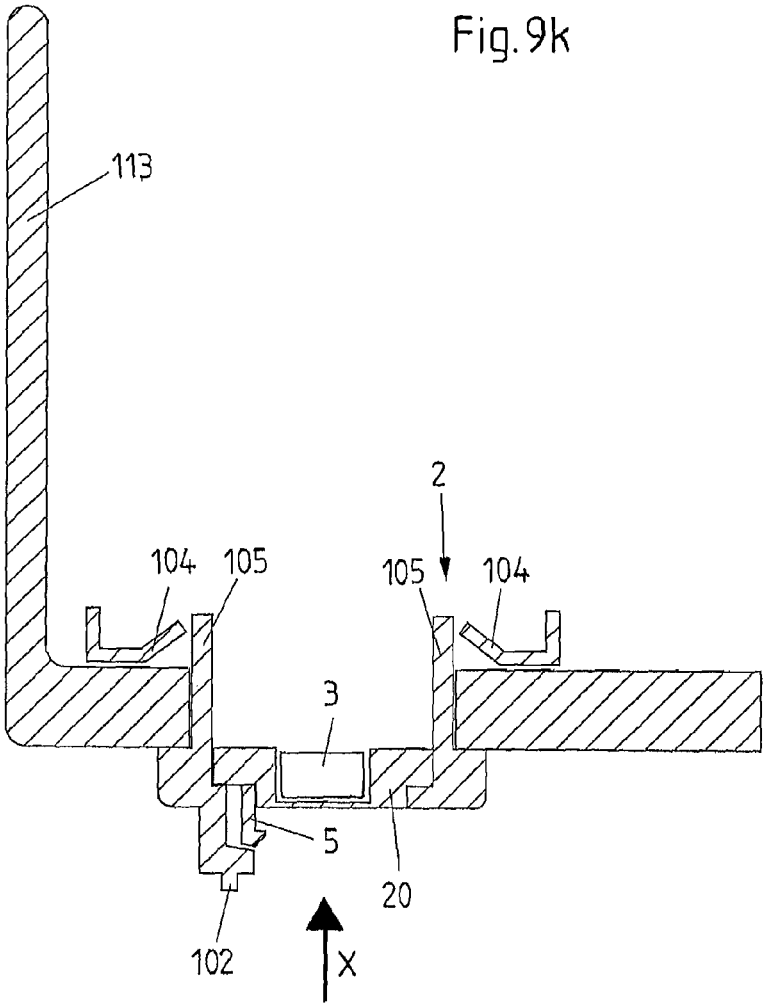
Figure 9K:
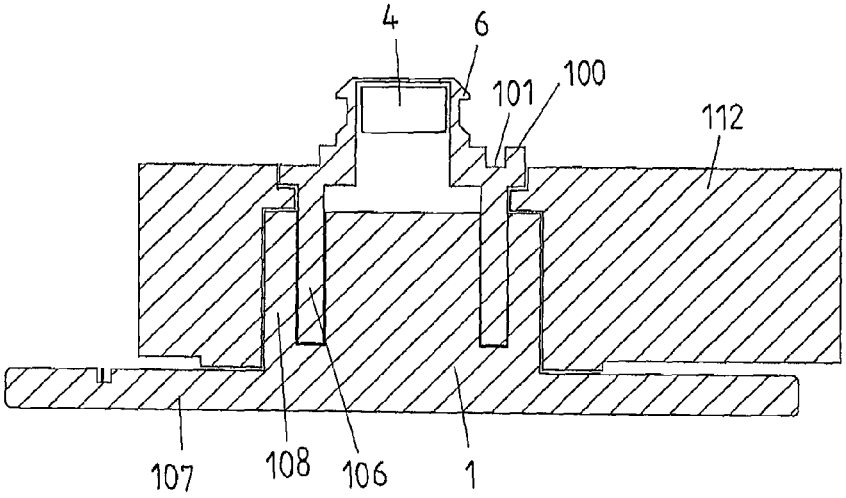

FIGS. 9*a* to 9*k* show different views of a further embodiment of a lock device, in which the locking device is not formed by a locking element, which is arranged separately on one of the connecting modules, but by the engagement of a locking element 102, fixedly arranged on one of the connecting modules 1, 2, with a groove 101 on the other of the connecting modules 1, 2, wherein the locking device can be unlocked by a rotation movement of the first connecting module 1 in an unlocking direction Z (corresponding to a direction of rotation) on the closing direction X. FIG. 9*a* shows here an overview, FIGS. 9*b* and 9*c* show exploded views once in a diagonal top angle perspective and once in a diagonal low angle perspective, FIG. 9*d* shows an exploded view in section, FIG. 9*e* an exploded view as viewed from the side, FIGS. 9*f* and 9*g* the lock device in the released state and FIGS. 9*h* to 9*k* sectional views of the lock device in the closed, locked state (FIG. 9*h*), in the closed but unlocked state (FIG. 9*i*), in the opened state (FIG. 9*j*) and prior to closing the lock device (FIG. 9*k*).

The lock device according to FIGS. 9*a* to 9*k* is basically designed according to the kind of lock device illustrated in FIGS. 3*a* to 3*f*. As far as is useful, in this case as also subsequently, the same reference signs are assigned to components with the same function, wherein additional components and, where applicable, also components which are modified in their function are designated other reference signs.

The first connecting module 1 in the lock device according to FIGS. 9*a* to 9*k* has a blocking piece 6 in the form of a protruding pin, carrying a ring-shaped locking catch, which is designed to come into catch-locking engagement with a spring lock element 5 in the form of a laterally opened ring element, arranged in a housing 114 on the second connecting module 2, as this has analogously been specified above in connection with the embodiment according to FIGS. 3*a* to 3*f*. A magnet 4 is arranged on the blocking piece 6 of the first connecting module 1 and a magnet 3 is arranged on a base plate 20 of the second connecting module 2, which cause a magnetic attracting force between the connecting modules 1, 2 and at least support the transfer of the lock device into its closing state, in which the spring lock element 5 is mechanically catch-lockingly engaged with the blocking piece 6.

With respect to the embodiment according to FIGS. 9*a* to 9*k* it shall be noted that the lock device can essentially also be configured without magnetic means 3, 4 and in this case would be designed as a purely mechanical lock device. The magnetic means in the form of the magnets 3, 4 or on the one hand a magnet 3, 4 and on the other hand a magnetic anchor serve to magnetically support the closing movement. When the magnetic means 3, 4 are dispensed with, the locking can be caused by attaching the connecting modules 1, 2 onto each other by application of force from outside when establishing the mechanical catch locking engagement via the blocking piece 6 and the spring lock element 5.

As illustrated in the exploded views according to FIGS. 9*b* and 9*c* the first connecting module 1 is arranged on a component 112, for example the cover of a bag, in that the component 112 is held positive-lockingly between a module part 106 and a handle element 107, wherein the first connecting module 1 can be rotated relative to the component 112 in an opening 117. The second connecting module 2 is arranged fixedly on another component 113, for example the body of a bag, in that the component 113 is torque-proof clamped between a holding element 104 and a collar 115 of a module part 105 of the second connecting module 2 (see also FIGS. 9*d* and 9*h*).

The first connecting module 1 is made of the module part 106 and the handle element 107, which is connected torque-proof to the module part 106, wherein the module part 106 is via axially running bars 110, arranged on a cylindrical shell surface, positive-lockingly plugged into a recess 109 and grooves 111, which are arranged thereupon and are likewise running axially, so that the component 112 is held between the module part 106 and the handle element 107.

In the locked, closed state, illustrated in FIG. 9*h*, the spring lock element 5 engages catch-lockingly and positive-lockingly with the blocking piece 6, so that the first connecting module 1 cannot be removed counter to the closing direction X from the second connecting module 2. At the same time, the locking element 102, protrudingly arranged on the front side of the second connecting module 2 facing the first connecting module 1 and formed shaped like a circular arc, engages with the groove 101 on the first connecting module so that the first connecting module 1 cannot be moved in the opening direction Y (which runs transverse to the closing direction X) relative to the second connecting module 2. As evident from FIG. 9*h*, the locking element 102 is laying in this locked, closed state in the groove 101, which is confined outwards by a ring shoulder 100 (see also FIG. 9*a*).

Indeed, in the closed and locked state of the lock device, illustrated in FIG. 9*h*, a movement of the first connecting module 1 counter to the closing direction X and also in the opening direction Y transverse to the closing direction X is impossible. But the first connecting module 1 can be turned relative to the second connecting module 2 and thereby be moved in the unlocking direction Z, corresponding to a direction of rotation.

By turning the first connecting module 1 relative to the second connecting module 2 the lock device comes into the state illustrated in FIG. 9*i*, in which the locking element 102, arranged on the second connecting module 2, has been moved in the groove 101 in such a way that it comes to lie in the area of a recess 103 on the outer ring shoulder 100, and thus the locking element 102 is no longer blocked. The first connecting module 1 can in this position be moved in the opening direction Y relative to the second connecting module 2, in that the blocking piece 6 is moved through a lateral opening 118 of the housing 114 and is removed from the engagement with the spring lock element 5.

The state of the lock device, opened in such a way, is illustrated in FIG. 9*j*. In this state the first connecting module 1 has been moved in the opening direction Y relative to the second connecting module 2 and thereby been brought out of engagement with the second connecting module 2. The lock device is thus opened.

FIG. 9*k* shows the state prior to the renewed locking of the lock device. For the locking, the first connecting module 1 can in the closing direction X be attached onto the second connecting module 2, whereby the blocking piece 6 comes into catch-locking engagement with the spring lock element 5 and thereby establishes a mechanical catch locking engagement of the first connecting module 1 with the second connecting module 2.

To ensure that the locking device—made of the locking element 102, the groove 101 and the ring shoulder 100—locks automatically upon attaching the first connecting module 1 onto the second connecting module 2, restoring means can be provided, which for example by using a mechanical spring pre-load the first connecting module 1 into the position introduced in FIG. 9*h*. Instead of mechanical restoring means in the form of springs or the like it can, however, also be provided that the magnets 3,4, arranged on the first connecting module 1 and on the second connecting module 2, cause a magnetic attracting force not only in the closing direction X, but also around the closing direction X (for example by using two differently polarized pairs of magnets), so that on account of the magnetic means 3, 4 the first connecting module 1, upon attachment onto the second connecting module 2, is automatically brought into the desired locked position according to FIG. 9*h* on account of the acting magnetic forces.

In an alternative embodiment the first and the second connecting module 1, 2 can also be designed and arranged in such a way that gravity moves both connecting modules 1, 2 preferably into the locked position. For example, the first connecting module 1 could be attached on a mobile phone and the second connecting module 2 on a belt holder. The locking element 102, the groove 101 and the ring shoulder 100 are then advantageously adjusted in such a way that the mobile phone normally hangs vertically downwards like a pendulum in such a way that the connecting modules 1, 2 are securely locked relative to each other (see position according to FIG. 9*h*). To take off, the mobile phone is then rotated and unlocked until it can be taken out of its holder (this happens especially intuitively when the mobile phone is rotated by 180° and taken upwards out of the holder (second connecting module 2)).

Advantageously, the locking element 102 and the recess 103 are not exactly of the same size, but the recess 103 is in the circumferential direction slightly larger, so that unlocking the connecting modules can take place in a predetermined tolerance range of the rotation angle.

The lock device illustrated in FIGS. 9*a* to 9*k* is suited in an advantageous manner to form a combination lock, due to the fact that from outside with suitable design and arrangement it cannot be seen, in which position the lock device is unlocked.

Figure 9L:
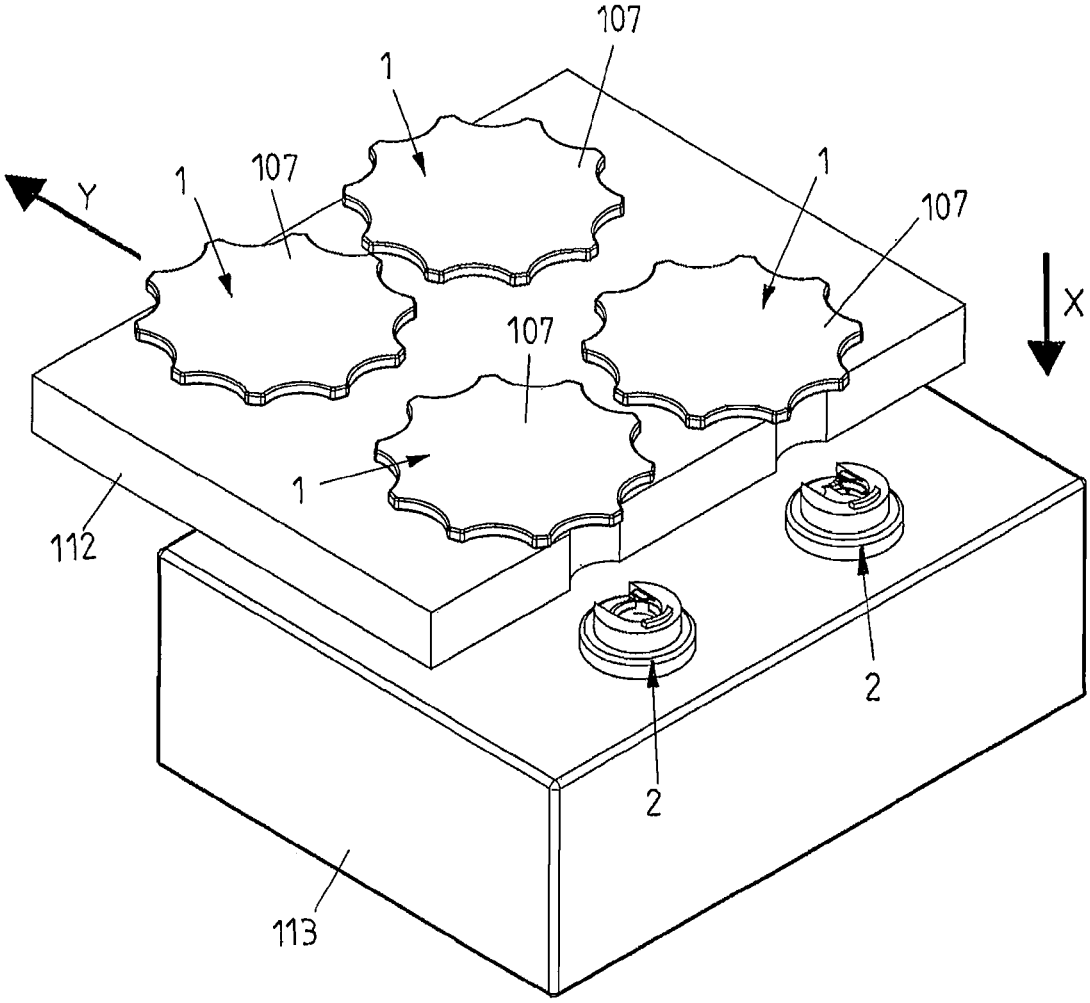
Figure 9M:
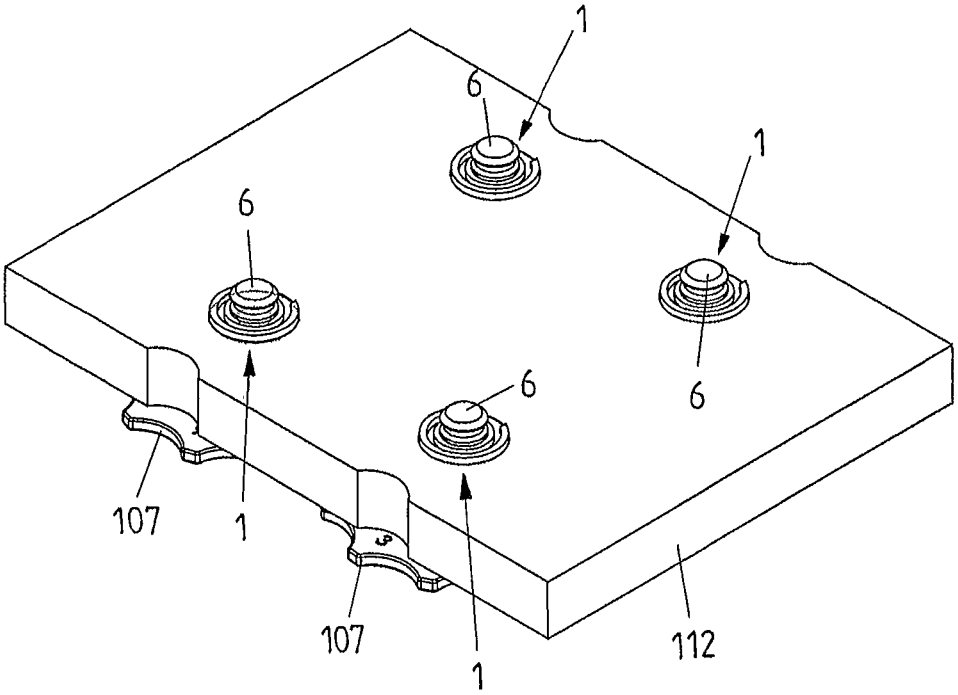
Figure 9N:
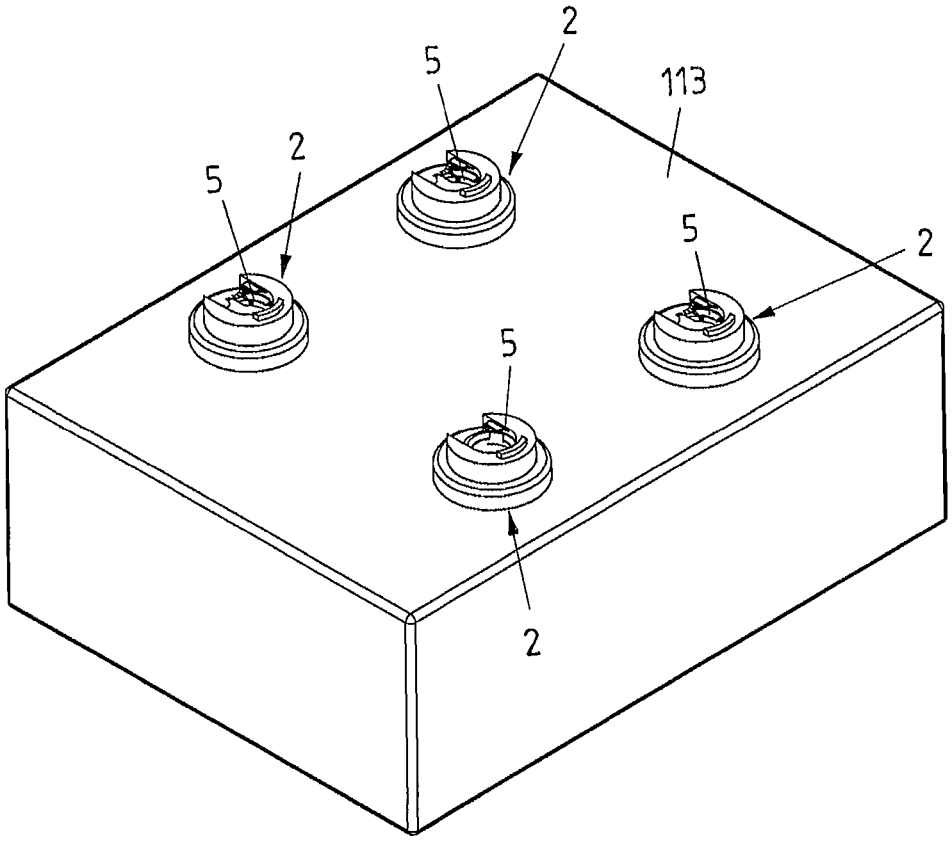

The views according to FIGS. 9*l* to 9*m* show an exemplary embodiment of such a combination lock, wherein in the illustrated embodiment four lock devices of the kind specified previously according to FIGS. 9*a* to 9*k* have been combined, by arranging four first connecting modules 1 on a first component 112 and four second connecting modules 2 on a second component 113. The lock devices can be closed by attaching the connecting modules 1, 2 onto each other, as specified previously, wherein the lock devices in the closed state can only be opened by shifting the first connecting modules 1 in the opening direction Y together, when the first connecting modules 1 have each been brought into an unlocked position (see FIG. 9*i*).

In the present exemplary embodiment the opening direction Y is a linear shifting. Equally, the opening direction Y can also correspond to a rotation movement around a centre of rotation of the whole device. The recesses 103 of the individual connecting modules 1 in this case each lie tangentially to concentric circles around this centre (in the simplest case all recesses lie tangentially on a circle).

The result is a device, which can only be opened when the combination on the connecting modules 1 is correctly set, but which is locked when only one of the connecting modules 1 stands in a locked state with the second connecting module 2.

Obviously, other arrangements of the connecting modules 1, 2 and another number of lock devices are also conceivable, wherein by increasing the number of the connecting modules 1, 2 the combinatory security is increased.

As mentioned previously and evident for example from FIG. 9*b*, the first connecting module 1 consists of a handle element 107 and a module part 106, positive-lockingly plugged into this handle element 107. The module part 106 can here be plugged into the handle element 107 in various turning positions on the closing direction X, wherein by the turning position of the module part 106 the position of the lateral recess 103 in the ring shoulder 100 relative to the handle element 107 can be predefined. By plugging in the module part 106 the position of the handle element 107, in which the lock device is unlocked, can be predefined to in this manner set a numerical code for a combination lock of the kind illustrated in FIGS. 9*l* to 9*m*.

In FIGS. 10*a* to 10*f* an embodiment of a lock device as a kind of clip buckle is illustrated, wherein the lock device has a first connecting module 1, made of two module parts 1*a*, 1*b*, and a second connecting module 2, which with a plug element 200 can be plugged into a housing 201 on the first module part 1*a* of the first connecting module 1. The second module part 1*b* of the first connecting module 1 is mounted pivotable on a rotation axis D on the first module part 1*a*, wherein the second module part 1*b* is composed of a lock element 209 and an actuating element 208.

On each the plug element 200 of the second connecting module 2 and on the lock element 209 of the first connecting module 1 respectively, magnetic means in the form of two magnets 3, 4 or in the form of on the one hand a magnet and on the other hand a magnetic anchor are arranged, which magnetically support transferring the lock device into its closed state. To close the lock device, the first connecting module 1 is here with the housing 201, arranged on the first module part 1*a*, attached onto the plug element 200 of the second connecting module 2 and shifted onto the plug element 200, so that catch locking elements 202, 203, arranged on the plug element 200, come into engagement with an engaging catch 211 on the lock element 209 of the second module part 1*b*.

In the locked state the locking catch 211 of the lock element 209 is plugged into an insertion opening 213 of the plug-in element 200 and is catch-lockingly connected to the catch locking elements 202, 203 so that the first connecting module 1 cannot be removed from the second connecting module 2 counter to the closing direction X.

The catch locking elements 202, 203 are arranged on the plug element 200 of the second connecting module 2, wherein the catch locking elements 202, 203 are mounted elastically on the first module part 1*a* of the first connecting module 1 by spring elements 204, 205. This shall yet be further explained subsequently with the help of the embodiment according to FIGS. 11*a* to 11*v*.

Figure 10A:
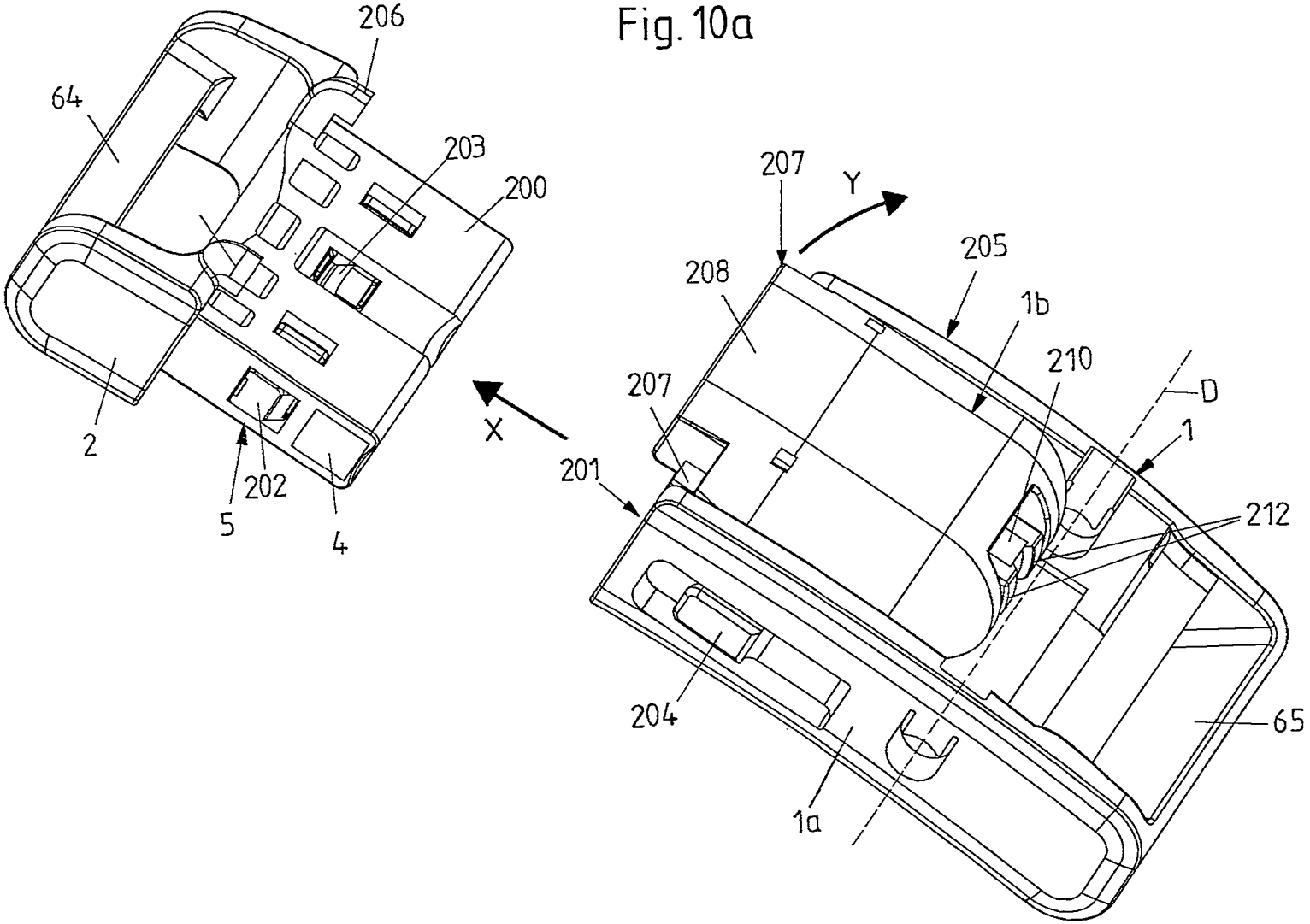
FIGS. 10*a*-10*f* show views of yet another further embodiment of a lock device as a kind of clip buckle having a pivotable actuating lever and FIGS. 11*a*-11*v* show views of yet another further embodiment of a lock device as a kind of clip buckle having a pivotable actuating lever, however, having a locking device which is modified compared with the embodiment according to FIGS. 10*a*-10*f.*
Figure 10B:
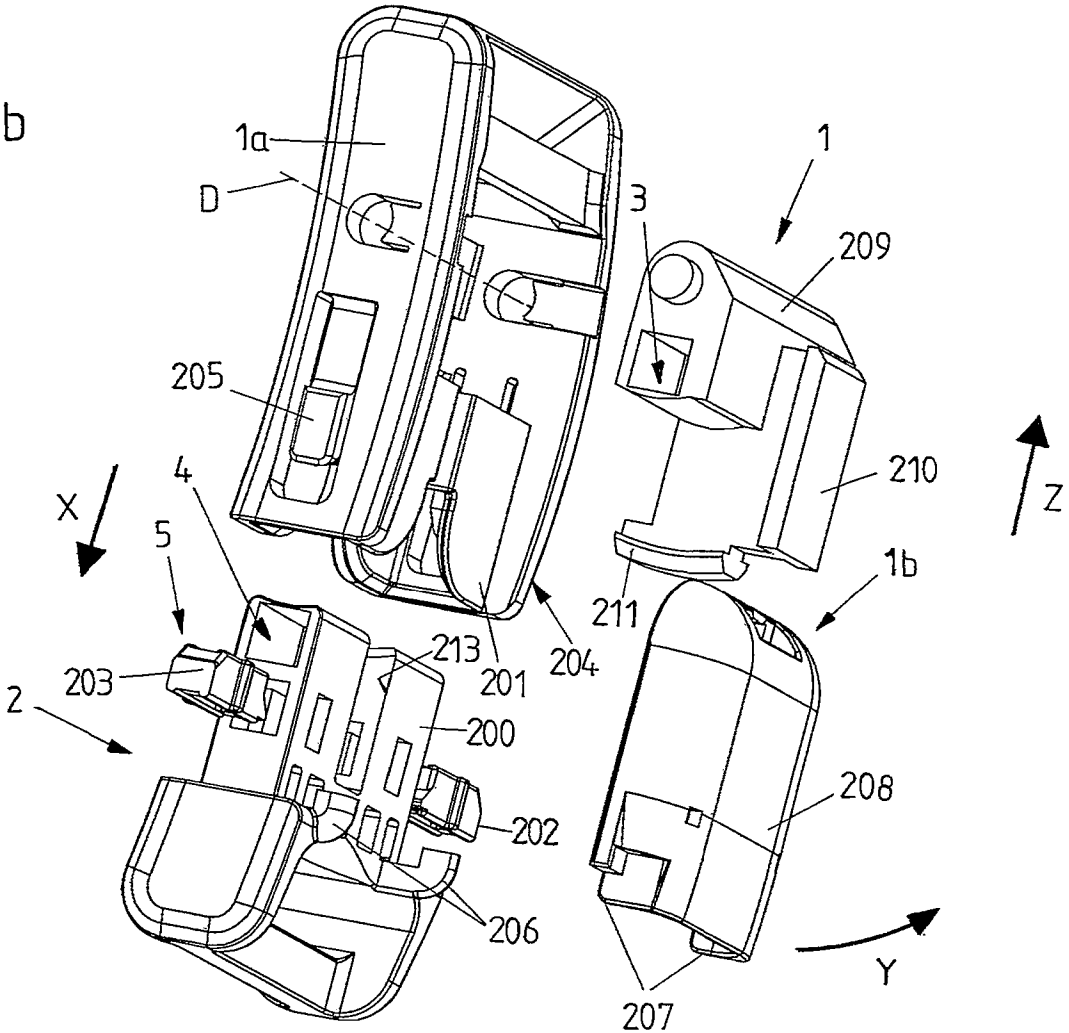
Figure 10C:
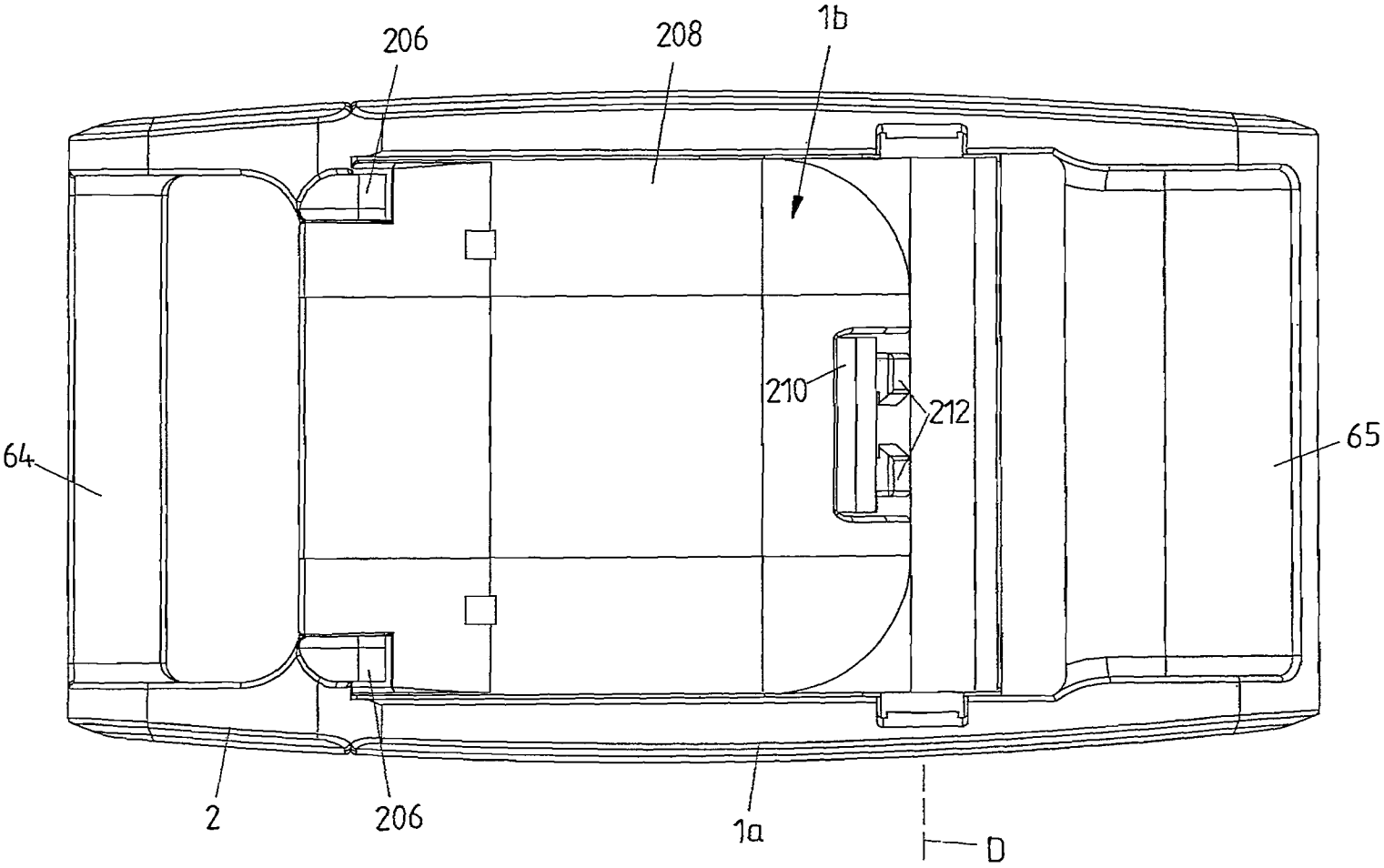

The actuating element 208 is mounted on the lock element 209 shiftably via a slide guiding rail 210 along an unlocking direction Z, wherein the actuating element 208 can be pre-loaded into the position illustrated in FIG. 10*c* mechanically by using suitable spring means or magnetically by using suitable magnetic means.

Figure 10D:
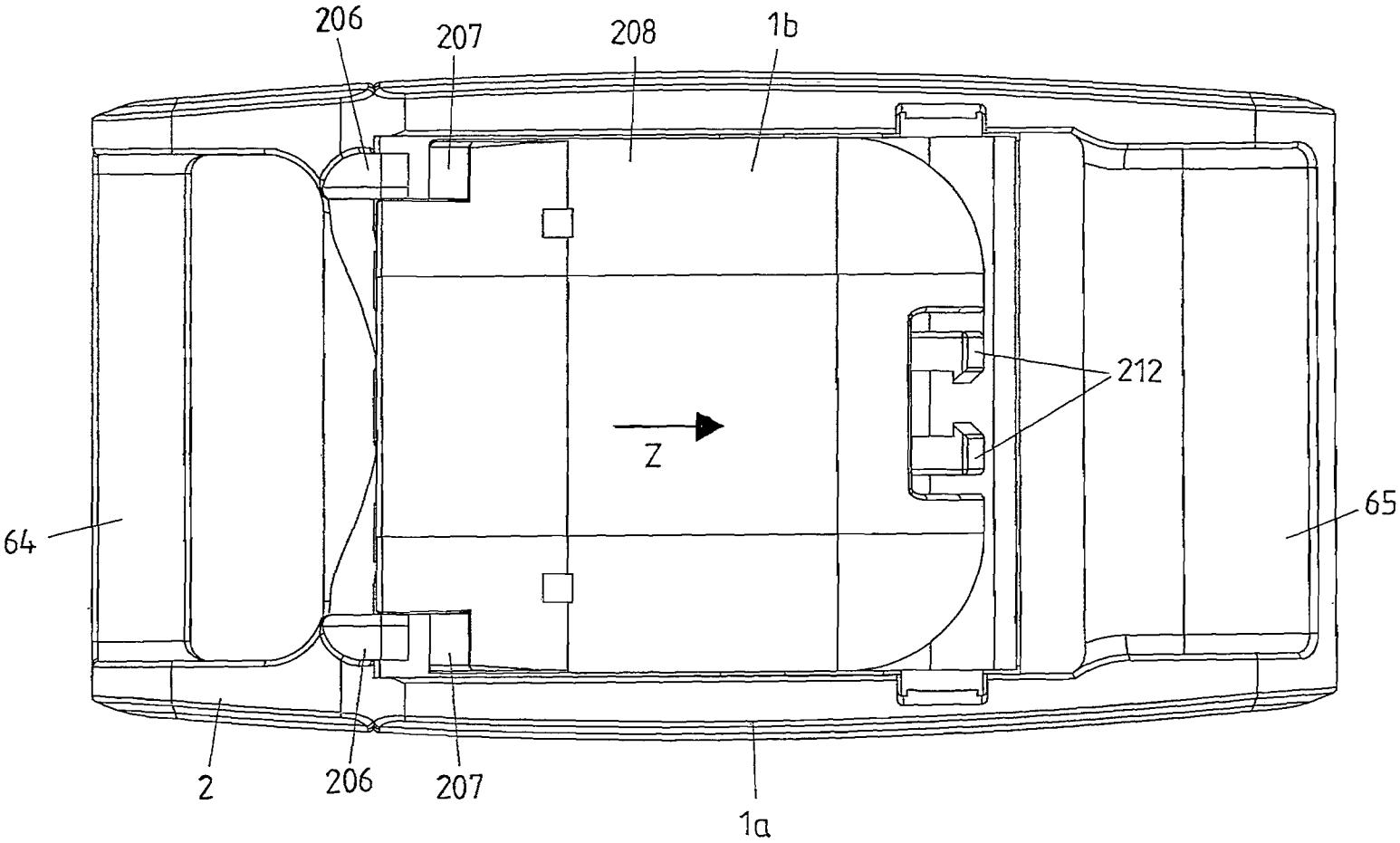
Figure 10E:
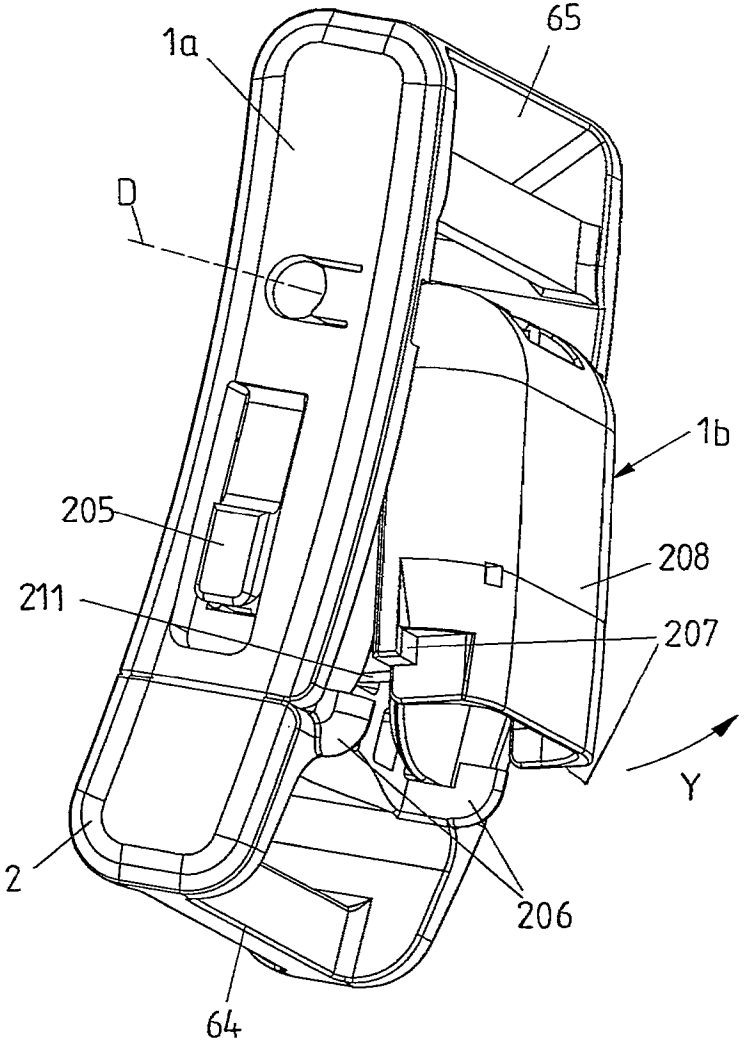
Figure 10F:
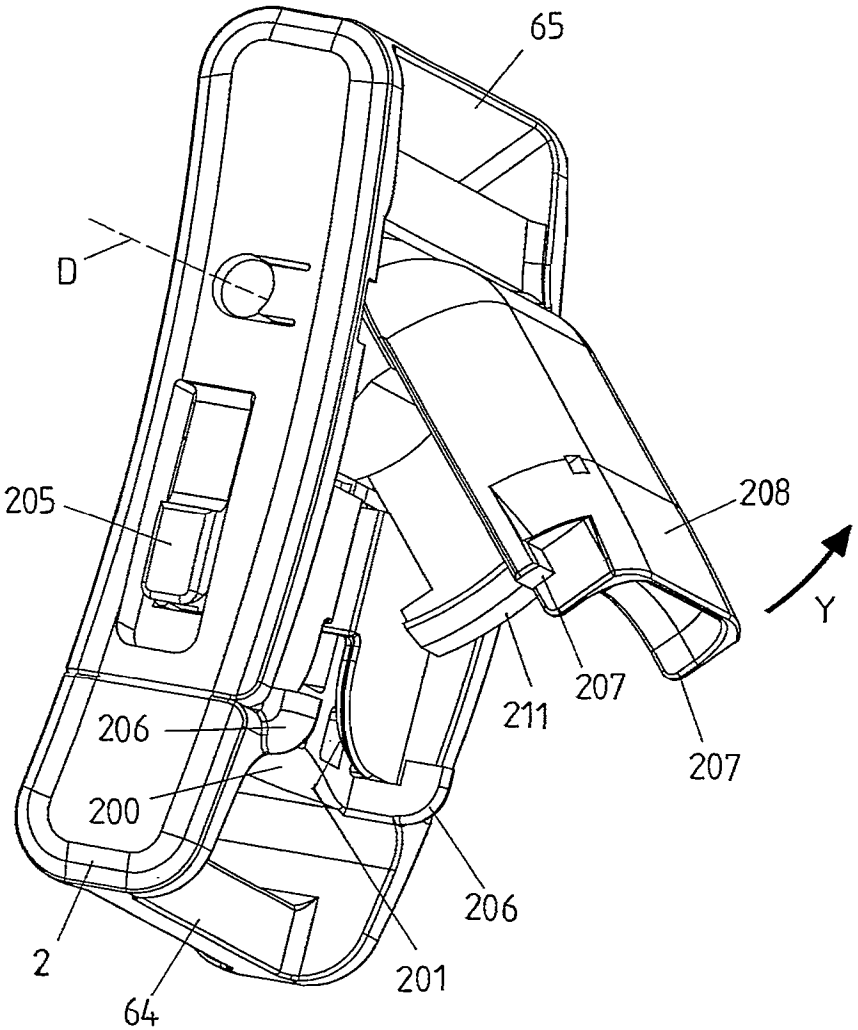

In its basic manner of operation the lock device according to FIGS. 10*a* to 10*f* is similar to the embodiment of the lock device according to FIGS. 7*a* to 7*g*. The lock device can be opened, in that the second module part 1*b*, made of the lock element 209 and the actuating element 208, is pivoted on the rotation axis D relative to the first module part 1*a* and moved in the opening direction Y on the rotation axis D. Hereby, the engaging catch 211 of the lock element 209 is moved relative to the catch locking elements 202, 203 and is brought out of engagement with these, so that the first connecting module 1 can be taken away from the second connecting module 2 as soon as the engaging catch 211 no longer engages with the catch locking elements 202, 203. This state is illustrated in FIG. 10*f*.

In the locked, closed state, illustrated in FIG. 10*c*, the actuating element 208 of the second module part 1*b* of the first connecting module 1 is positioned in a position in which it engages positive-lockingly via engaging elements 207 with locking elements 206 on the second connecting module 2 in such a way that the second module part 1*b* cannot be pivoted in the opening direction Y on the rotation axis D. In the closed position according to FIG. 10*c* the lock device is thereby locked and cannot readily be opened. In particular, the second module part 1*b* of the first connecting module 1 cannot be moved in the opening direction Y and thereby the engaging catch 211 can also not be removed from the area of the catch locking elements 202, 203.

In the closed, locked state of the lock device end stops 212 of the actuating element 208 on the end are in contact with the slide guiding rail 210 (see FIG. 10*c*).

The engaging elements 207 in this manner together with the locking elements 206 realize a locking device, which in the closed, locked state of the lock device blocks a movement of the second module part 1*b* of the first connecting module 1 in the opening direction Y and counteracts an opening of the lock device.

By shifting the actuating element 208 along the slide guiding rail 210 on the lock element 209 counter to the closing direction X the locking can be released by bringing the engaging elements 207 out of engagement with the locking elements 206 on the second connecting module 2.

The unlocked, but still closed state of the lock device is illustrated in FIG. 10*d*. The actuating element 208 has been moved in the unlocking direction Z, contrary to the closing direction X, and the engaging elements 207 have thereby been removed from the engagement with the locking elements 206.

After unlocking, the second module part 1*b* (made of the actuating element 208 and the lock element 209) can be pivoted in the opening direction Y on the rotation axis D—as illustrated in FIG. 10*e*—to in this manner bring the engaging catch 211 out of engagement with the catch locking elements 202, 203 and to release the mechanical catch locking engagement between the connecting modules 1, 2.

The released state, in which the connecting modules 1, 2 can be removed from each other, is illustrated in FIG. 10*f*.

Figure 11B:
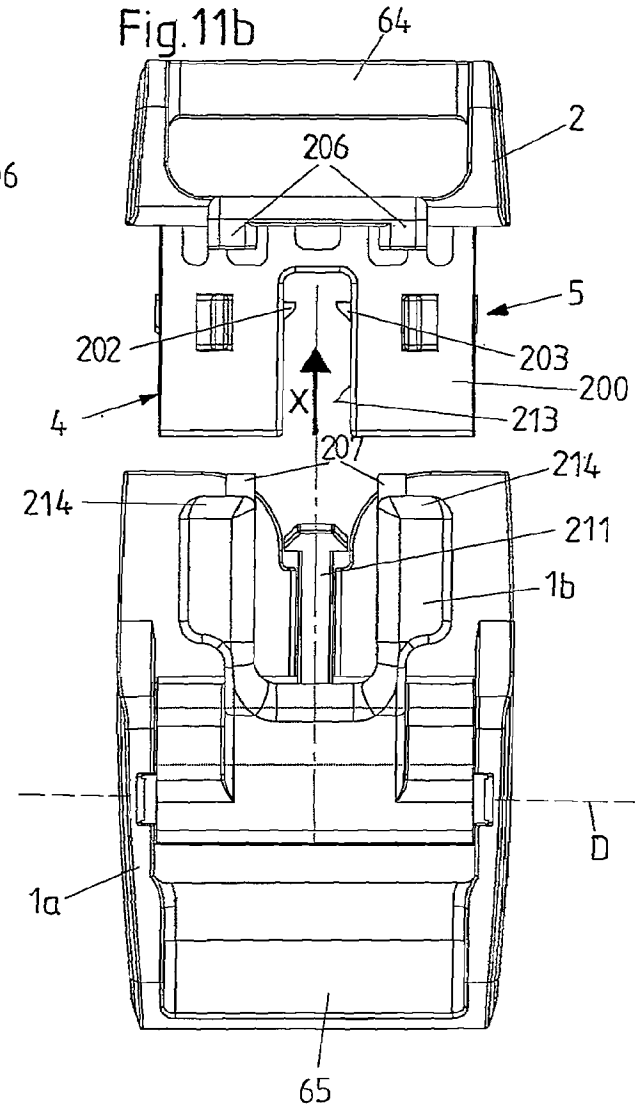
Figure 11A:
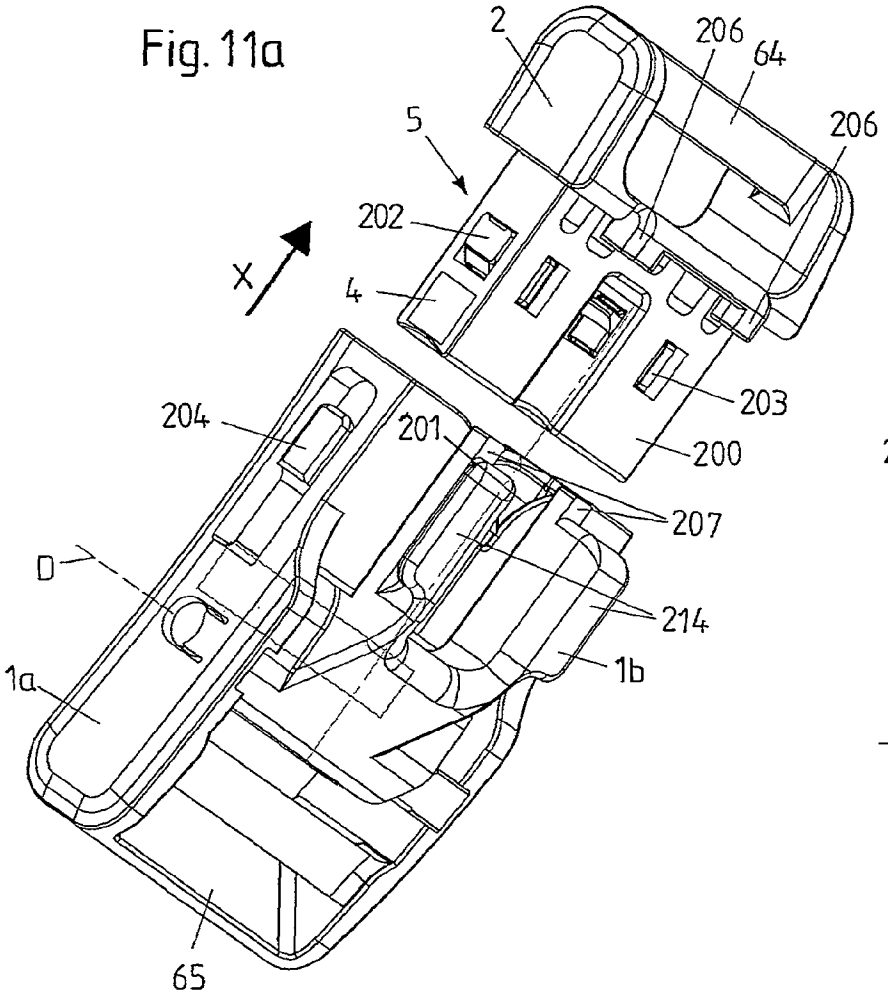
Figure 11F:
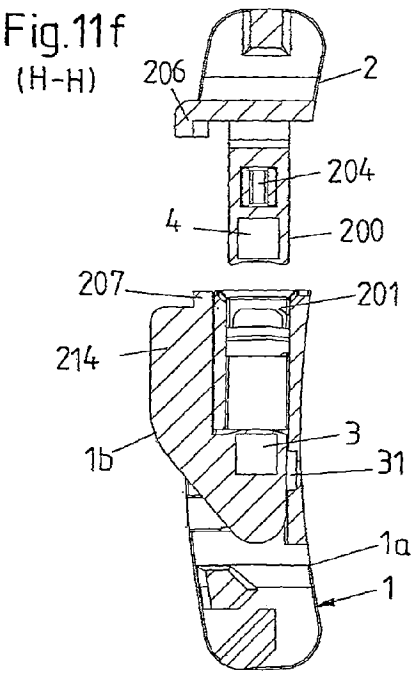
Figure 11E:
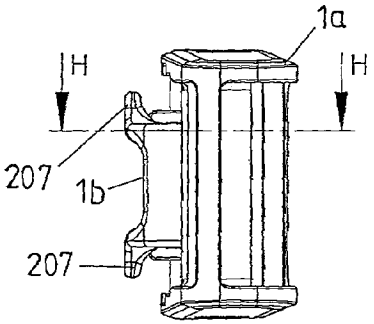
Figure 11D:
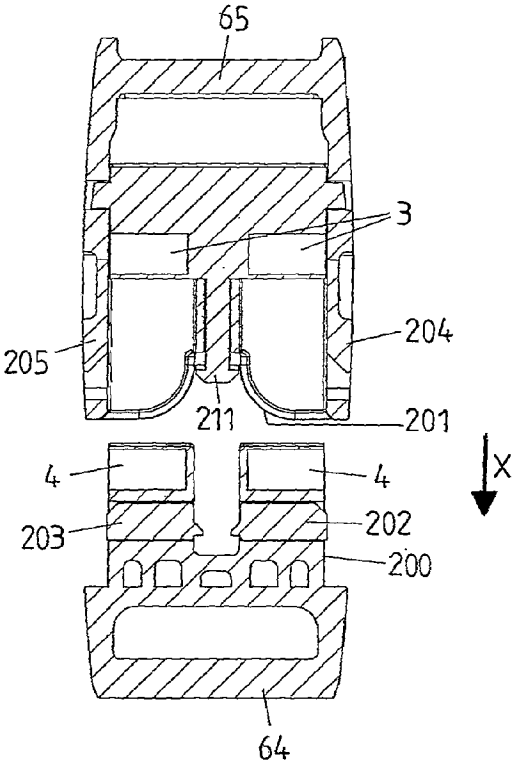
Figure 11C:
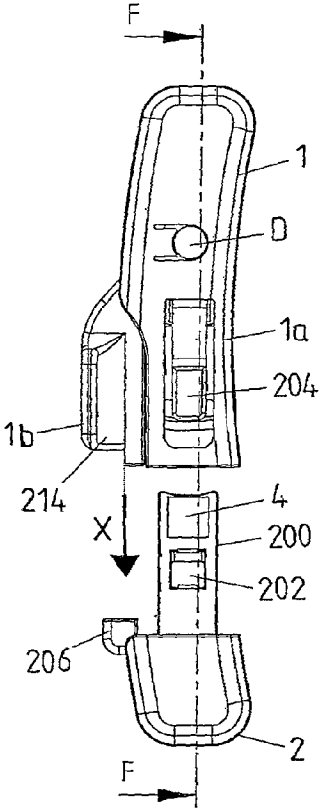
Figure 11H:
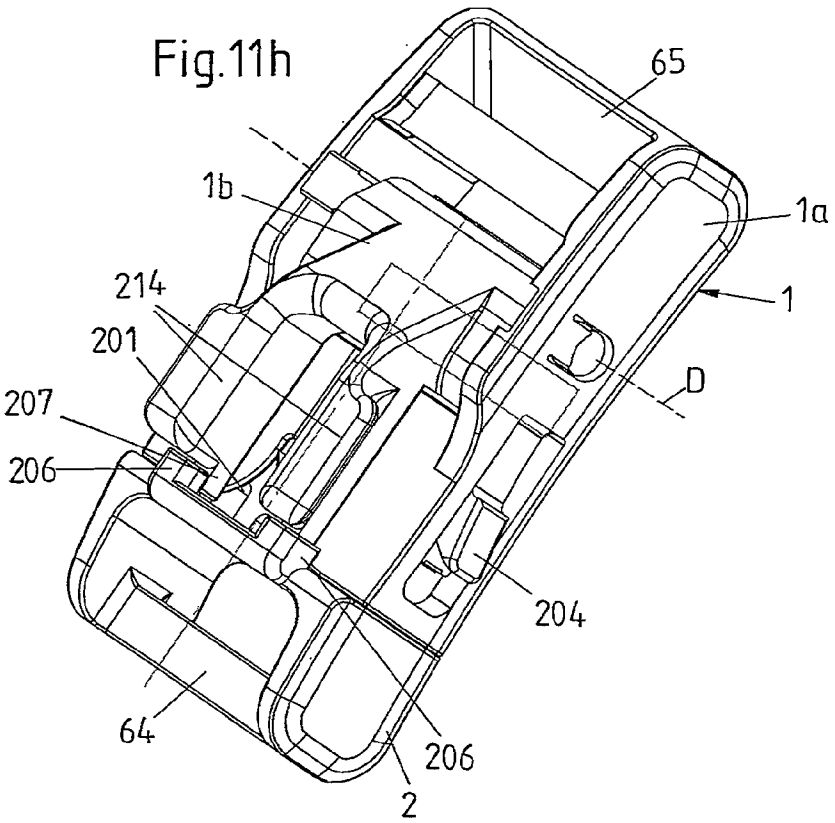
Figure 11G:
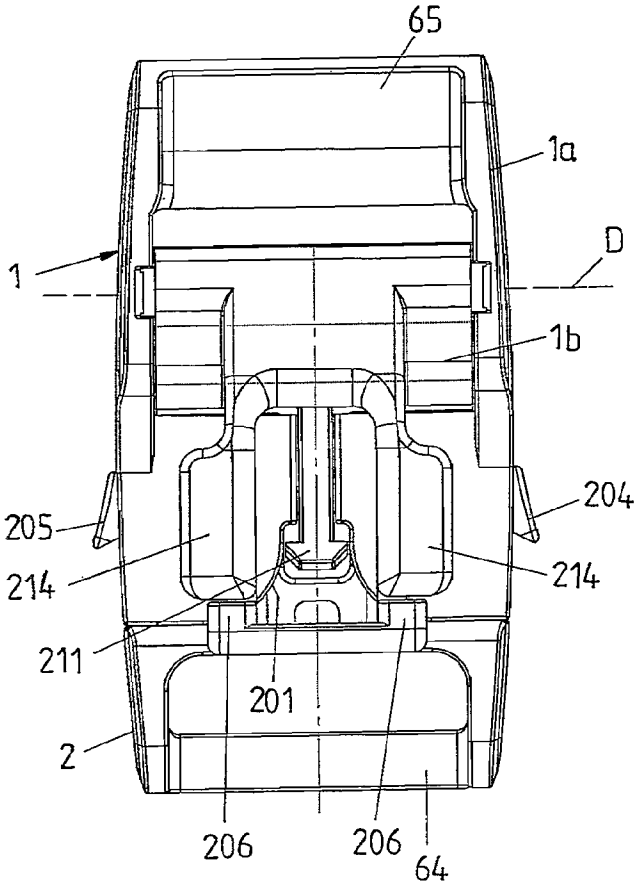
Figure 11L:
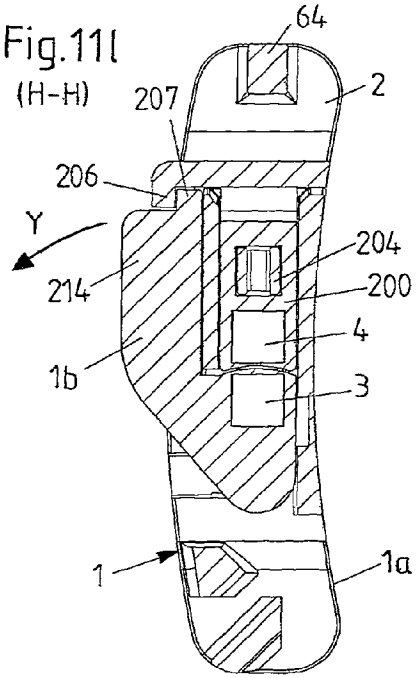
Figure 11K:
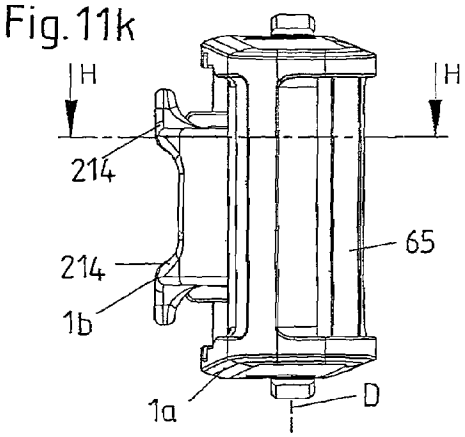
Figure 11J:
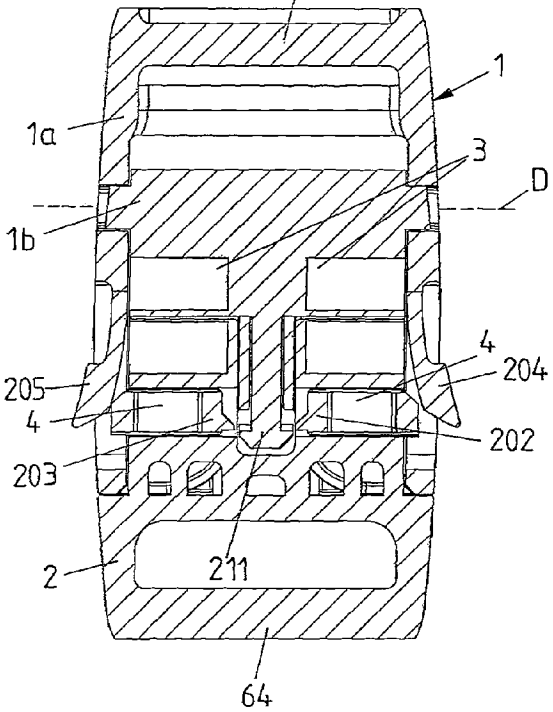
Figure 11I:
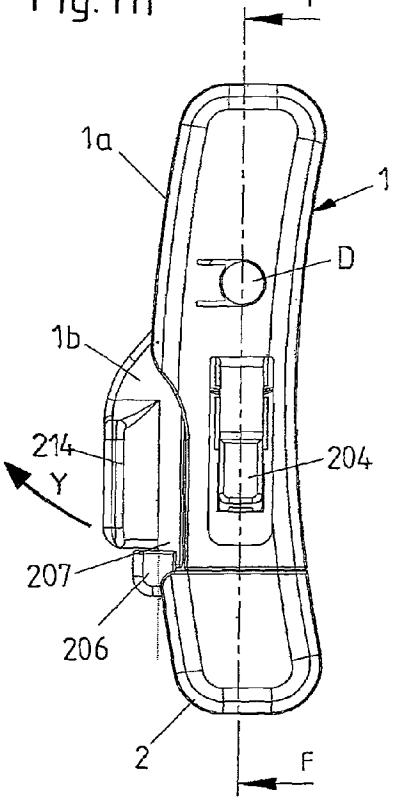
Figure 11N:
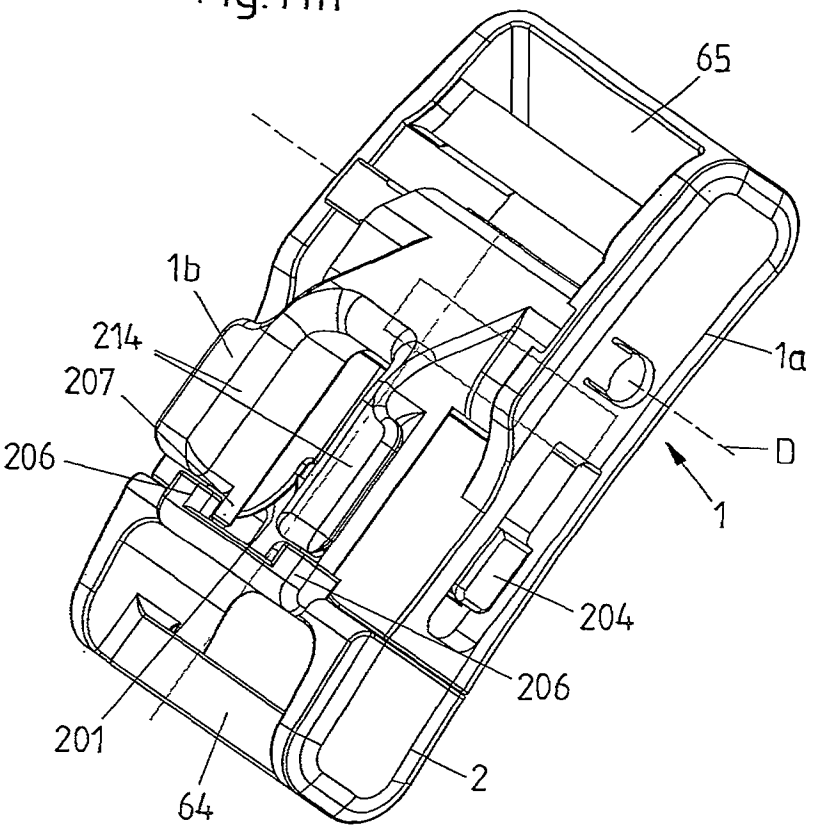
Figure 11M:
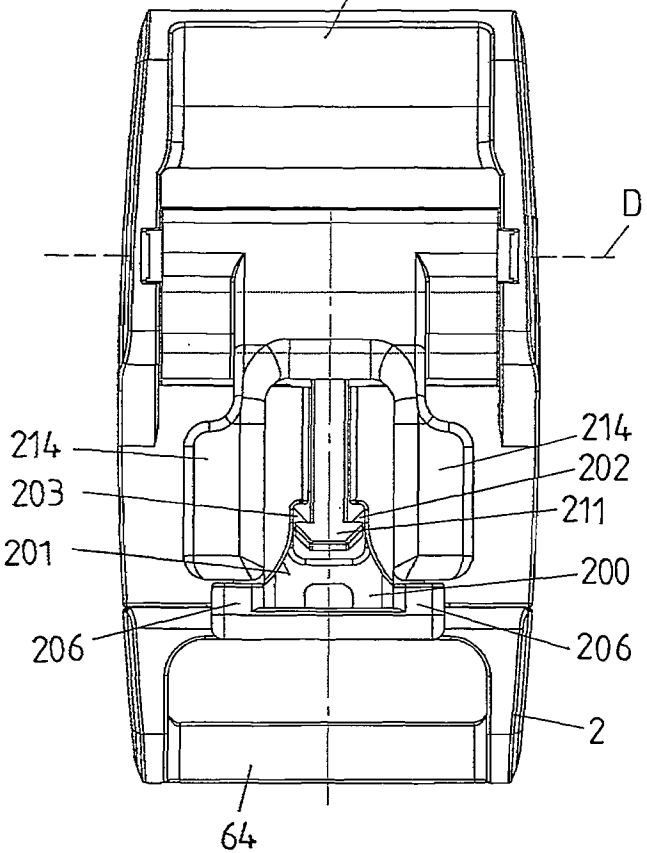
Figure 11R:
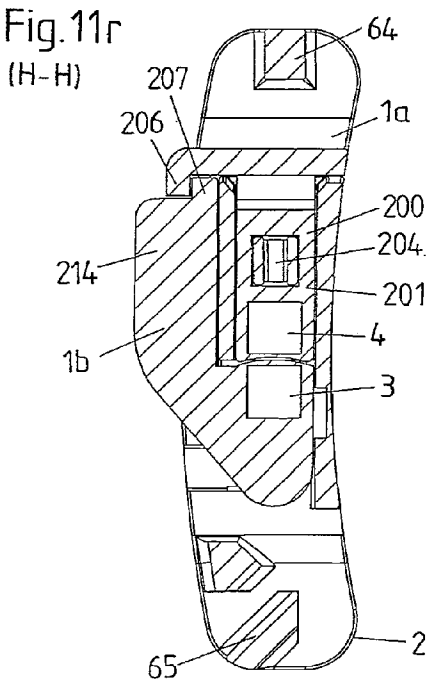
Figure 11Q:
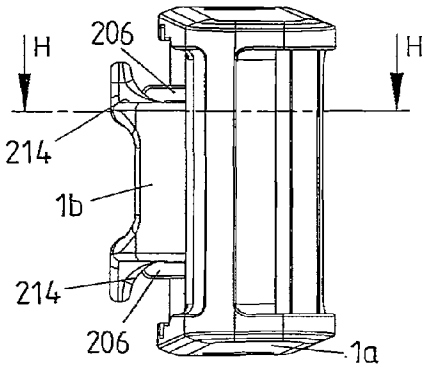
Figure 11P:
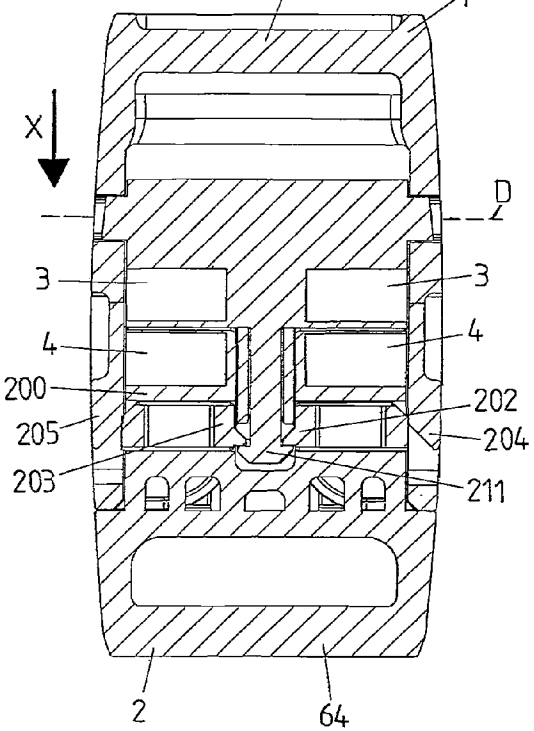
Figure 11O:
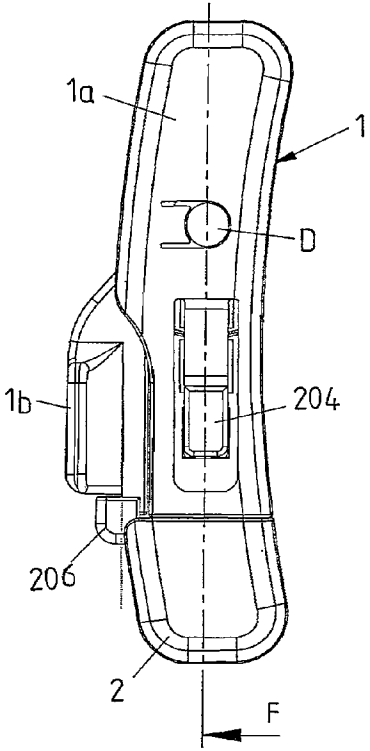
Figure 11T:
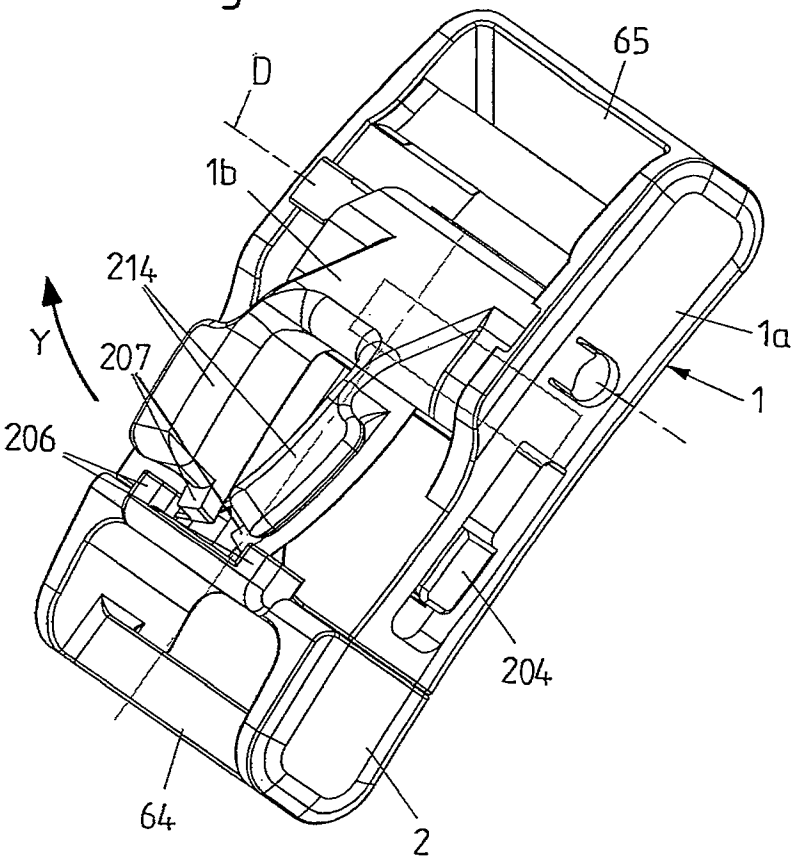
Figure 11S:
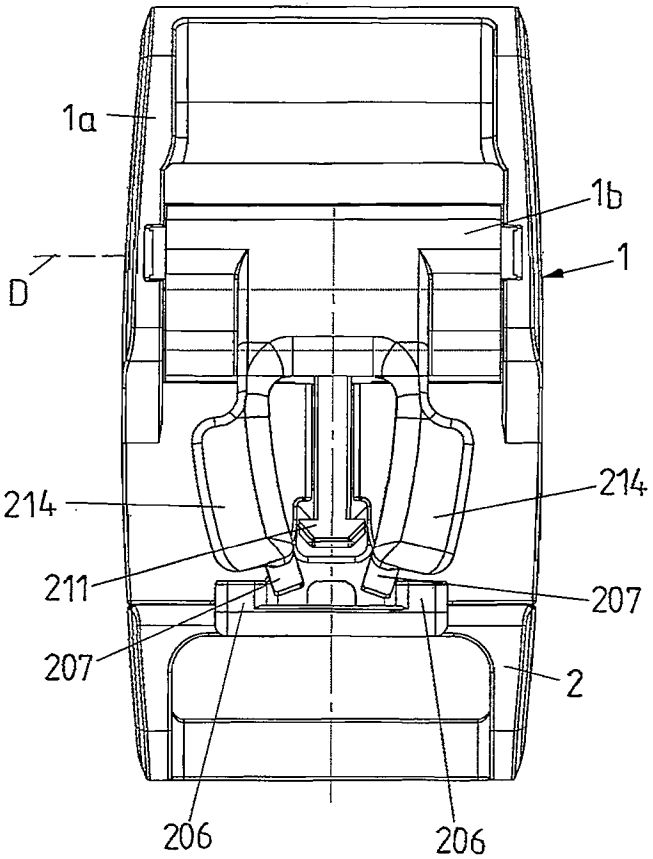
Figure 11V:
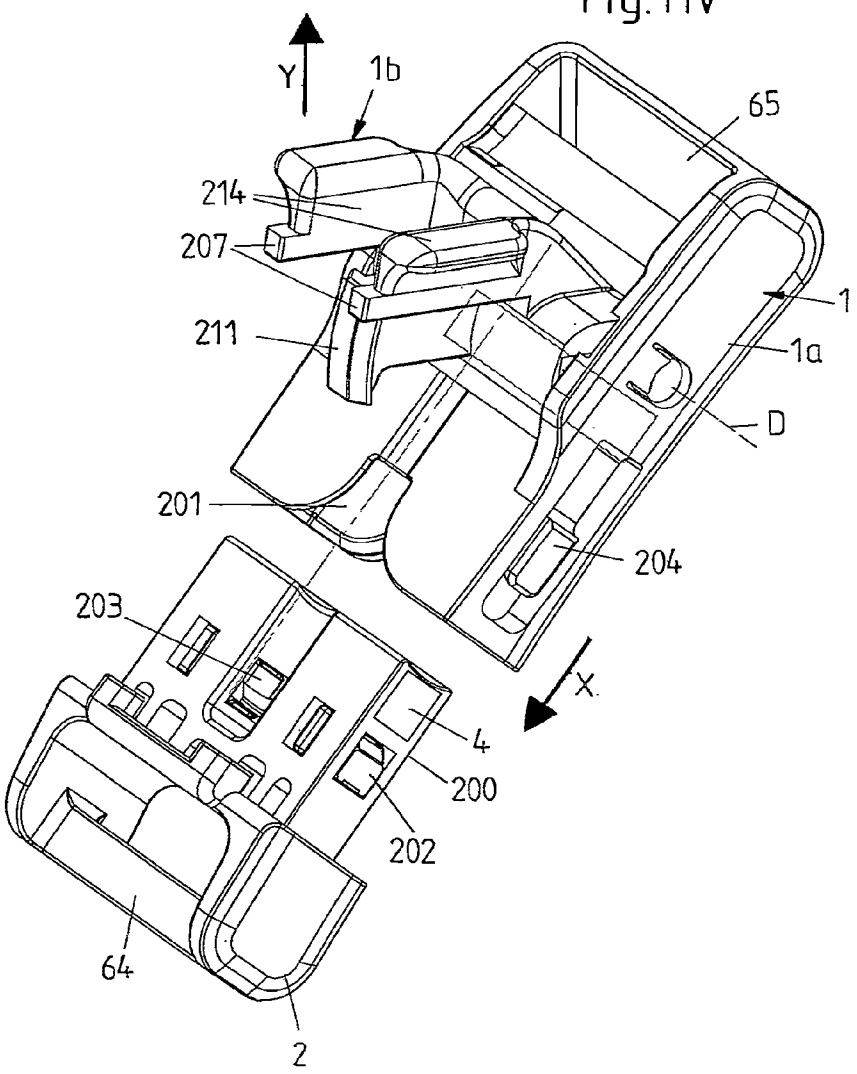

An embodiment of a lock device, modified compared with the embodiment according to FIGS. 10*a* to 10*f*, is illustrated in FIGS. 11*a* to 11*v* in various views. Differences arise essentially in the design of the locking device. The manner of operation of the lock device is otherwise largely identical so that reference can be made to the previous specification.

Figure 11U:
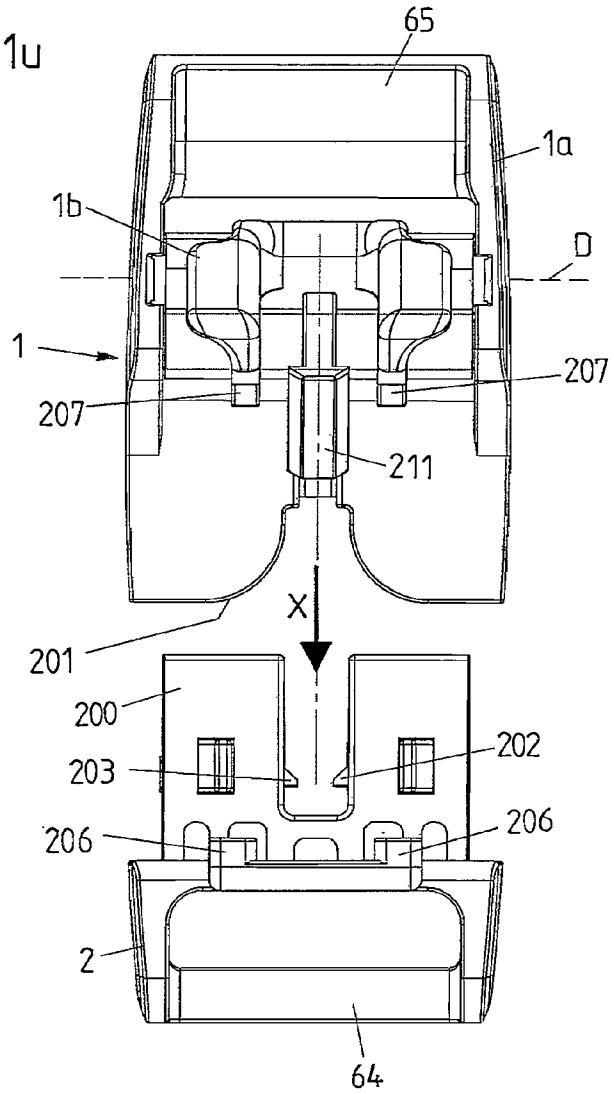

FIGS. 11*a* to 11*f* show the lock device in the opened state prior to closing, FIGS. 11*g* to 11*l* show the lock device upon closing, FIGS. 11*m* to 11*r* show the lock device in the closed, locked state, FIGS. 11*s* and 11*t* show the lock device in the closed but unlocked state, and FIGS. 11*u* and 11*v* show the lock device in the yet again opened state.

The lock device according to FIGS. 11*a* to 11*v* differs from the lock device according to FIGS. 10*a* to 10*f* essentially in the design of the second module part 1*b* of the first connecting module 1. In contrast to the lock device according to FIGS. 10*a* to 10*f*, in the lock device according to FIGS. 11*a* to 11*v* the second module part 1*b* is designed in one piece with two elastic arms 214 arranged thereupon, which each carry an engaging element 207 for the engagement with a locking element 206 on the second connecting module 2.

To unlock the lock device from its closed, locked state (see FIGS. 11*m* to 11*r*) these arms 214 are pushed towards each other (see FIGS. 11*s* and 11*t*), so that the engaging elements 207 come out of engagement with the locking elements 206 on the second connecting module 2 and the second module part 1*b* can be pivoted in the opening direction Y on the rotation axis D and the engaging catch 211 can be brought out of engagement with the catch locking elements 202, 203 on the second connecting module 2 (see FIGS. 11*u* and 11*v*). In this opened state the first connecting module 1 can then be taken away counter to the closing direction X from the second connecting module, and the lock device can thereby be released.

The arms 214 are designed sufficiently flexible and guarantee a secure locking of the lock device in the closed, locked state. The arms 214 with the engaging elements 207 arranged thereupon at the same time guarantee an automatic locking upon establishing the closing state of the lock device, when a suitable pre-loading of the second module part 1*b*—mechanic or magnetic or caused by gravity—into the position illustrated in FIGS. 11*a* to 11*e* is provided.

This return can for example be caused by magnets 3, 4, arranged on the second module part 1*b* and on the second connecting module 2, which magnetically attract each other upon the transfer of the lock device into the closing state and thereby on the one hand support the closing movement and on the other hand automatically cause a return of the second module part 1*b* into the position illustrated in FIGS. 11*a* to 11*f*.

Alternatively, the return can also be caused by a return anchor 31 (see FIG. 11*f*), arranged on the first module part 1*a* of the first connecting module 1, in the form of a ferromagnetic anchor (or by a corresponding return magnet) and the magnet 3, arranged on the second module part 1*b*, which magnetically attract each other and thereby automatically cause a return of the second module part 1*b* into the position illustrated in FIGS. 11*a* to 11*f*.

As the locking device has to be unlocked by actuating both arms 214 (namely by a pushing towards each other of these two arms 214) to open the lock device, the closing state of the lock device is securely locked and reliably secured against an unintended opening.

FIGS. 11*g* to 111 show the lock device upon transferring the connecting modules 1, 2 into their closing state. As already mentioned previously, the catch locking elements 202, 203 are arranged shiftably on the second connecting module 2, but here not mounted directly elastic on the second connecting module 2. The elastic mounting of the catch locking elements 202, 203 for the realization of the spring lock element 5 rather takes place via spring elements 204, 205, which are provided on the first module part 1*a* of the first connecting module 1. This has the purpose to make possible an easy mechanical catch-locking engagement of the connecting modules 1, 2 upon the transferring into the closing state, but at the same time to provide a secure, highly enduring mechanical catch locking engagement when the closing state is established.

To transfer the lock device into its closing state the first connecting module 1 is attached with the housing 201 arranged thereupon onto the plug element 200 of the second connecting module 2. Herein, the engaging catch 211 is inserted into the insertion opening 213 on the plug element 200 until the engaging catch 211 enters into contact with the catch locking elements 202, 203, which are shiftably arranged transverse to the closing direction X on the second connecting module 2.

As the catch locking elements 202, 203 are not pre-loaded against the second connecting module 2, but instead are arranged smoothly shiftable on the second connecting module 2, the engaging catch 211 can upon contact with the catch locking elements 202, 203, for the time being, shift these readily outwards and thereby move past the locking catches, designed on the catch locking elements 202, 203.

Upon further plugging the first connecting module 1 onto the plug element 200, however, the spring elements 204, 205 come into contact with the catch locking elements 202, 203 on the rear side and pre-load these inwards in a direction towards each other in such a way that, after the engaging catch 211 has moved past the catch locking elements 202, 203, the positive-locking engagement of the engaging catch 211 with the catch locking elements 202, 203 is automatically established.

As the engaging catch 211 enters into contact with the catch locking elements 202, 203, when these are not yet (or not yet completely) loaded by the spring elements 204, 205, the force required to establish the mechanical catch locking engagement can be reduced, which has the effect that the magnets 3, 4 of the connecting modules 1, 2, serving to support the closing movement, can, where applicable, be dimensioned smaller.

By suitable adjustment of the spring elements 204, 205, the catch locking elements 202, 203 and the engaging catch 211 to each other, a tilting upon establishing the closing state can, moreover, be prevented, wherein in the closing state, by the spring elements 204, 205 acting upon the catch locking elements 202, 203, the mechanical catch locking engagement is securely established in the closing state. The result is a smooth and haptically pleasant closing process with automatic or almost automatic catch locking engagement.

In the closed, locked state, illustrated in FIGS. 11*m* to 11*r*, the catch locking elements 202, 203 then engage positive-lockingly with the engaging catch 211 in such a way that the first connecting module 1 cannot be removed counter to the closing direction X from the second connecting module 2 without the second module part 1*b* to unlock and to open having been actuated.

The idea underlying the invention can basically also be realized in other embodiments. In particular, the invention is independent of the movement of the lock device which is to be carried out for actuation, which can take place rotating, tilting or shifting, wherein the connecting modules are either shifted against each other as a whole or are actuated via an actuating device.

The additional locking device can be designed as a simply designed locking element, but also as a combination lock or as a lock which is actuated by a key.

Depending on the embodiment, the restoring means can cause the automatic return of the locking device into the locking position, for example by a pre-loading mechanical spring, by magnetic means or by gravity.

Also, the return of the connecting modules into a position, in which a catch-locking engagement to establish the closing position is possible, can take place by additional restoring means, for example by using a mechanical spring, or also, as specified above, by the magnetic effect of the magnets (or anchors) provided anyway or by gravity.

Furthermore, instead of the magnetic means, other pre-loading, force-generating means can also be used, for example by means of spring means, or gravity or an actuation force or a momentum can be made use of.

In other words: a mechanical lock is provided, which catch-lockingly closes by attaching a first connecting module onto a second connecting module in a closing direction by force action (magnetic force, spring force, gravity), wherein the first connecting module cannot readily be taken away counter to this closing direction from the second connecting module, but instead, to open, is to be moved in an opening direction, differing from the closing direction, wherein a locking device prevents the shifting of the connecting modules relative to each other in a locking position, but can be unlocked to open the lock.

A lock device of the specified kind is suited for a multitude of different uses and can be employed advantageously. In this way the lock device can be employed as a lock for bags, backpacks, suitcases, furniture or other storage or transport means or containers. The lock device can moreover be employed for the detachable connection of components or flexible tension means such as ropes or straps (e.g. for mountain climbing equipment or sailing equipment or also for dog collars, tow ropes or other ropes or cords), for fastening motorcycle or bicycle accessories onto a motorcycle or a bicycle (as e.g. for fastening saddlebags or other bags or pouches, tools or the like) or for baby car seats, strollers or child carriers. Moreover, the lock device can be employed for fastening mobile phones, weapons, truncheons or other utensils (e.g. for the police) onto a belt holder.

This list is herein in no way restrictive. Essentially, an application of a lock device of the kind specified is possible and advantageous everywhere, where an easily closing, but at the same time in the closed state securely locked and enduring lock is desired.

The invention claimed is:

1. A lock device, comprising:

a first connecting module and a second connecting module, wherein the first connecting module can be arranged in a closing direction on the second connecting module and is in a closing position mechanically catch-lockingly engaged with the second connecting module, wherein the first connecting module can be detached from the second connecting module by a movement of the first connecting module or of a part of the first connecting module in an opening direction, which is directed substantially transverse to the closing direction, and an unlockable locking device comprising a locking element operative to lock the first connecting module or the part of the first connecting module with respect to the second connecting module such that, in a locked state of the locking element, a movement of the first connecting module or the part of the first connecting module relative to the second connecting module in the opening direction is prevented, if the first connecting module and the second connecting module are positioned in the closing position, wherein the locking element is constituted to automatically assume the locked state upon arranging the first connecting module on the second connecting module for closing the lock device, and wherein, separate to the locking device, on one of the first connecting module and the second connecting module at least one spring lock element and on the other of the first connecting module and the second connecting module at least one blocking piece is arranged to form a spring catch locking, the spring catch locking, in the closing position, mechanically locking the first connecting module with respect to the second connecting module against forces acting in a direction opposite the closing direction, but not preventing a movement of the first connecting module or said part of the first connecting module with respect to the second connecting module in the opening direction.

2. The lock device according to claim 1, wherein the movement in the opening direction is a shifting movement transverse to the closing direction, a rotation movement in a plane transverse to the closing direction or a pivoting movement on a rotation axis transverse to the closing direction.

3. The lock device according to claim 1, wherein to release the first connecting module from the second connecting module the first connecting module or the part of the first connecting module can be moved relative to the second connecting module in such a way that the at least one spring lock element and the at least one blocking piece of the spring catch locking come out of engagement.

4. The lock device according to claim 1, wherein to release the first connecting module from the second connecting module the at least one spring lock element and the at least one blocking piece of the spring catch locking are shifted relative to each other in such a way that the at least one spring lock element along the opening direction gets out of range of the at least one blocking piece.

5. The lock device according to claim 1, wherein to release the first connecting module from the second connecting module the at least one spring lock element and the at least one blocking piece of the spring catch locking are shifted relative to each other in such a way that the at least one spring lock element is pushed out of engagement with the at least one blocking piece by running up onto a run-up slope transverse to the opening direction.

6. The lock device according to claim 1, further comprising magnetic means which, to support the transferring of the first connecting module into the closing position, cause a magnetic attracting force between the first connecting module and the second connecting module.

7. The lock device according to claim 6, wherein the magnetic means are designed in such a way that by the movement in the opening direction the magnetic attracting force between the first connecting module and the second connecting module is weakened.

8. The lock device according to claim 7, further comprising restoring means to transfer the first connecting module or the part of the first connecting module into a position, in which the first connecting module can be catch-lockingly engaged with the second connecting module, wherein the magnetic means act as restoring means.

9. The lock device according to claim 6, wherein for the realization of the magnetic means at least one magnet each, or on the one hand at least one magnet and on the other hand at least one magnetic anchor, are arranged on the first connecting module and on the second connecting module, respectively.

10. The lock device according to claim 9, wherein by the movement in the opening direction the at least one magnet or the magnetic anchor of the first connecting module and the at least one magnet or the magnetic anchor of the second connecting module are moved relative to each other in such a way that the magnetic attracting force weakens.

11. The lock device according to claim 1, further comprising restoring means to transfer the first connecting module or the part of the first connecting module into a position, in which the first connecting module can be catch-lockingly engaged with the second connecting module.

12. The lock device according to claim 1, wherein the locking element is movably arranged on the first connecting module or on a part of the first connecting module to engage with a recess on the second connecting module or on a second part of the first connecting module in such a way that a movement of the first connecting module or of the part of the first connecting module in the opening direction to release the first connecting module from the second connecting module is prevented.

13. The lock device according to claim 1, wherein the locking device is designed to be actuated by means of a key or a numerical code.

14. The lock device according to claim 1, wherein the locking device can be unlocked by moving the first connecting module or a part of the first connecting module in an unlocking direction.

15. The lock device according to claim 14, wherein the unlocking direction differs from the opening direction and is not directed parallel to it.

16. The lock device according to claim 14, wherein the unlocking direction differs from the opening direction and from the closing direction and is not directed parallel to these.

17. The lock device according to claim 14, wherein the locking device is formed by a locking element which is arranged on the first or the second connecting module and which in a locked, closed state of the lock device engages with a groove on the other of first and second connecting module.

18. The lock device according to claim 17, wherein the opening direction is directed transverse to the closing direction, and the unlocking direction is designed as a direction of rotation around the closing direction, wherein by turning the first connecting module or a part of the first connecting module in the unlocking direction the locking element can be disengaged from the groove.

* * * * *